US006543770B1

(12) United States Patent
Kaji et al.

(10) Patent No.: US 6,543,770 B1
(45) Date of Patent: Apr. 8, 2003

(54) CARD INVERTING DEVICE, CARD GAME MACHINE, AND CARD INVERTING METHOD

(75) Inventors: Toshiyuki Kaji, Tokyo (JP); Jiro Yoshida, Tokyo (JP); Tomoyuki Kawano, Tokyo (JP); Takuya Kawakami, Tokyo (JP); Hiroshi Yagi, Tokyo (JP); Noriaki Ueda, Tokyo (JP); Takao Yamauchi, Tokyo (JP); Naoki Nakamura, Tokyo (JP)

(73) Assignee: Sega Corporation, Tokyo (JP)

( * ) Notice: Subject to any disclaimer, the term of this patent is extended or adjusted under 35 U.S.C. 154(b) by 0 days.

(21) Appl. No.: 09/787,287

(22) PCT Filed: Jul. 18, 2000

(86) PCT No.: PCT/JP00/04821

§ 371 (c)(1),
(2), (4) Date: Jun. 26, 2001

(87) PCT Pub. No.: WO01/05473

PCT Pub. Date: Jan. 25, 2001

(30) Foreign Application Priority Data

Jul. 19, 1999 (JP) ..... 11-205295
May 31, 2000 (JP) ..... 2000-163667

(51) Int. Cl.[7] ..... A63F 9/00
(52) U.S. Cl. ..... 273/148 R; 273/149 R; 273/309
(58) Field of Search ..... 273/148 R, 149 R, 273/309

(56) References Cited

U.S. PATENT DOCUMENTS 5,224,712 A * 7/1993 Laughlin et al. ..... 273/148 R
6,270,404 B2 * 8/2001 Slines et al. ..... 273/309
6,361,044 B1 * 3/2002 Block et al. ..... 273/149 R

FOREIGN PATENT DOCUMENTS

JP 58-193982 2/1983
JP 3-264082 11/1991
JP 11-47435 2/1999
TW 356731 4/1999

* cited by examiner

*Primary Examiner*—Marguerite McMahon
(74) *Attorney, Agent, or Firm*—Dickstein Shapiro Morin & Oshinsky LLP

(57) ABSTRACT

The present invention aims to reverse and transport a card in an automated card game machine, and relates to a card reversing device that reverses and transports each card, with no one touching the card. The present invention also relates to such a card game machine and a card reversing method. Each card placed on a card placement unit of a table is pulled by the magnetic force of a magnetic circuit having three electromagnet units. Accordingly, when a slider that supports the magnetic circuit is moved by a card transportation mechanism, the card slides on the upper surface of the card placement unit as if to follow the movement of the magnetic circuit. With one end portion of the card being attracted to the center electromagnet unit, the card is reversed by 180 degrees by the repulsive force generated between the other end portion of the card and the left-side electromagnet unit.

30 Claims, 44 Drawing Sheets

FIG. 4
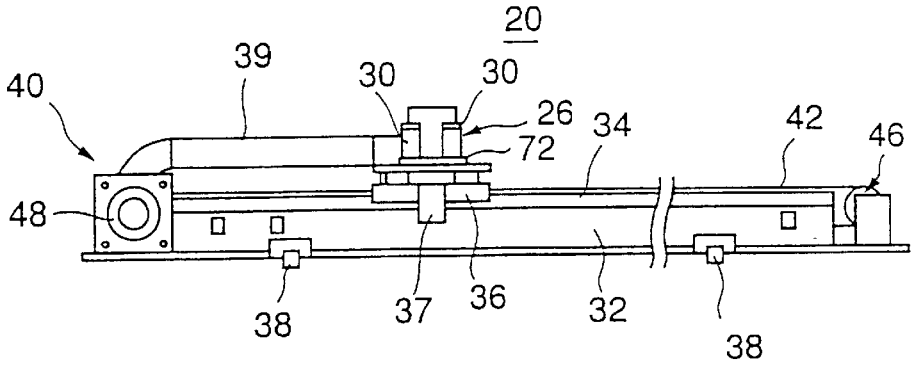
FIG. 5B FIG. 5A
FIG. 5C
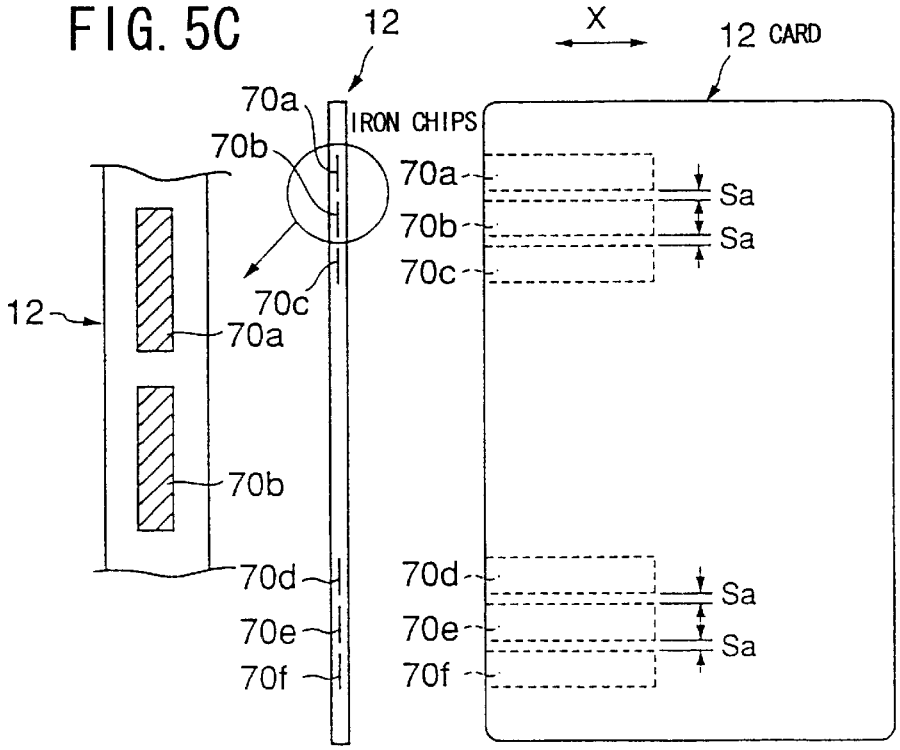

MAGNETIC FORCE (N POLE)
TRANSPORTATION START
TRANSPORTATION END

TIME
MAGNETIC FORCE (S POLE)
MAGNETIC FORCE OF THE RIGHT-SIDE ELECTROMAGNET
MAGNETIC FORCE (N POLE)
MAGNETIC FORCE OF THE CENTER ELECTROMAGNET

TIME
MAGNETIC FORCE (S POLE)
MAGNETIC FORCE (N POLE)

TIME
MAGNETIC FORCE OF THE LEFT-SIDE ELECTROMAGNET
MAGNETIC FORCE (S POLE)

CARD INVERTING DEVICE, CARD GAME MACHINE, AND CARD INVERTING METHOD

TECHNICAL FIELD

The present invention relates to a mechanism for a full-automatic card game machine, and to a card game machine located in a place of entertainment such as an amusement arcade.

BACKGROUND ART

At a place of entertainment such as an amusement arcade, card game machines that play card games such as poker, blackjack, or fortune telling, are found.

In those card game machines, a plurality of cards are displayed on a CRT display, so that players can enjoy a card game by exchanging the cards displayed on the device or distributing and then reversing the cards to show the faces of the cards.

However, in the above conventional card game machine, the faces of the cards are displayed on the CRT display device. Compared with an actual card game in which the cards are actually distributed, the cards displayed on the CRT display device lack reality. As a result, players can feel no excitement when reversing a card, or no satisfactory feeling when wining a game.

Also, in the conventional card game machine, the faces of the cards can be freely changed by a computer-controlled operation, it seems to the players that the faces of the cards displayed on the CRT display device are easily changed. As a result, the players cannot trust the fairness of the game.

Furthermore, in the conventional card game machine, it is difficult to perform automatically a series of operations from the distribution of the cards to the collection of the cards. Especially, in a card game, dividends change with stakes, and if a human hand intervenes in the distribution of the cards, the players might suspect that the cards are manipulated according to the stakes. As a result, the players become less enthusiastic about participating in the card game.

DISCLOSURE OF THE INVENTION

The object of the present invention is to provide a card reversing device, a card game machine, and a card reversing method, in which the above problems are eliminated.

A specific object of the present invention is to provide a card reversing device, a card game machine, and a card reversing method, by which players can enjoy a card game with reality and also visually enjoy the card game.

Another specific object of the present invention is to automatically perform a series of movement of transporting a card to a location in front of each player, reversing the card, adjusting the orientations of cards collected after each game, and distributing the cards again to the players.

To achieve the above objects, a card having a magnetic material buried therein is reversed by magnetic force, so that real cards, instead of make-believe cards displayed on a display device, can be transported and distributed to players, making the card game look like an actual game. According to the present invention, the cards can be transported and reversed, with no one touching the cards, players can enjoy the card game while marveling at the transportation and reversal movements of the cards. Also, since actual cards are transported and reversed, the credibility in the game is higher than in the case where the cards are displayed on a display device. Furthermore, since the transportation and reversal of the cards can be automatically performed, the present invention can be applied not only to a card game machine but also to a placement of entertainment such as a casino.

To achieve the above objects of the present invention, the cards are reversed by magnetic force on the table, so that the cards appear as of they spontaneously reversed themselves. In this manner, players can also visually enjoy the card game.

To achieve the above objects of the present invention, each card placed on the table is pulled by magnetic force, and a mechanism that pulls each card is moved, thereby moving each card placed on the table. Thus, each card can be transported to a desired position, with no one touching the card.

To achieve the above objects, a virtual rotational axis for reversing each card by pulling a linear-type magnetic material buried in the card toward a magnet located below the table is formed. A mechanism that discharges air to the bottom surface of each card to reverse the card is also employed. In this manner, the cards can be moved as if they spontaneously reverse themselves, and players can also visually enjoy the card game.

To achieve the above objects of the present invention, a card supply mechanism in accordance with the present invention includes: a first card orientation adjusting mechanism that adjusts cards in a longitudinal direction and a transverse direction; a second card orientation adjusting mechanism that adjusts the cards so that the face sides of all the cards face in the same direction; and a third card orientation adjusting mechanism that adjusts the orientations of the card in the same direction. The cards to be supplied to the card discharging mechanism are stacked in the same direction, so that the magnetic members buried in the cards can be stacked on one another at the same location.

Further, to achieve the above objects, the present invention provides a card game machine that comprises: a card discharging mechanism that discharges one out of a plurality of cards each having a magnetic material buried therein; a table on which each card supplied from the card discharging mechanism is placed; a magnetic force generating unit that is located below the table and attracts each card supplied from the card discharging mechanism onto the table by magnetic force; a card transportation mechanism that moves the magnetic force generating unit so as to transport each card placed on the table; a magnetic force control unit that switches the magnetic force of the magnetic force generating unit so as to reverse each card transported to a location in front of a player by the moving of the magnetic force generating unit; a card collecting mechanism that collects the cards reversed on the table; and a card supply mechanism that adjusts the orientations of all the cards collected by the card collecting mechanism and supplies to the card discharging mechanism. The card discharging mechanism discharges one of the cards onto the table, and the card is then transported from the table to a location in front of a player. After the end of the game, the cards are collected, and the orientations of the collected cards are adjusted. The cards are then returned to the card discharging mechanism.

BRIEF DESCRIPTION OF THE DRAWINGS

FIG. 4 is a side view of the card transportation mechanism 20;

FIG. 5A is a plan view of a card 12;

FIG. 5B is a side view of the card 12;

FIG. 5C is an enlarged side view of the card 12;

FIG. 21B shows the magnetic flux when the magnetic force of the permanent magnet 84A is on;

FIG. 23B is a front view showing a situation in which the magnetic force of the permanent magnets 84A and 84B of the first modification is on;

PREFERRED EMBODIMENTS FOR CARRYING OUT THE INVENTION

The following is a description of embodiments of the present invention, with reference to the accompanying drawings.

Figure 1:
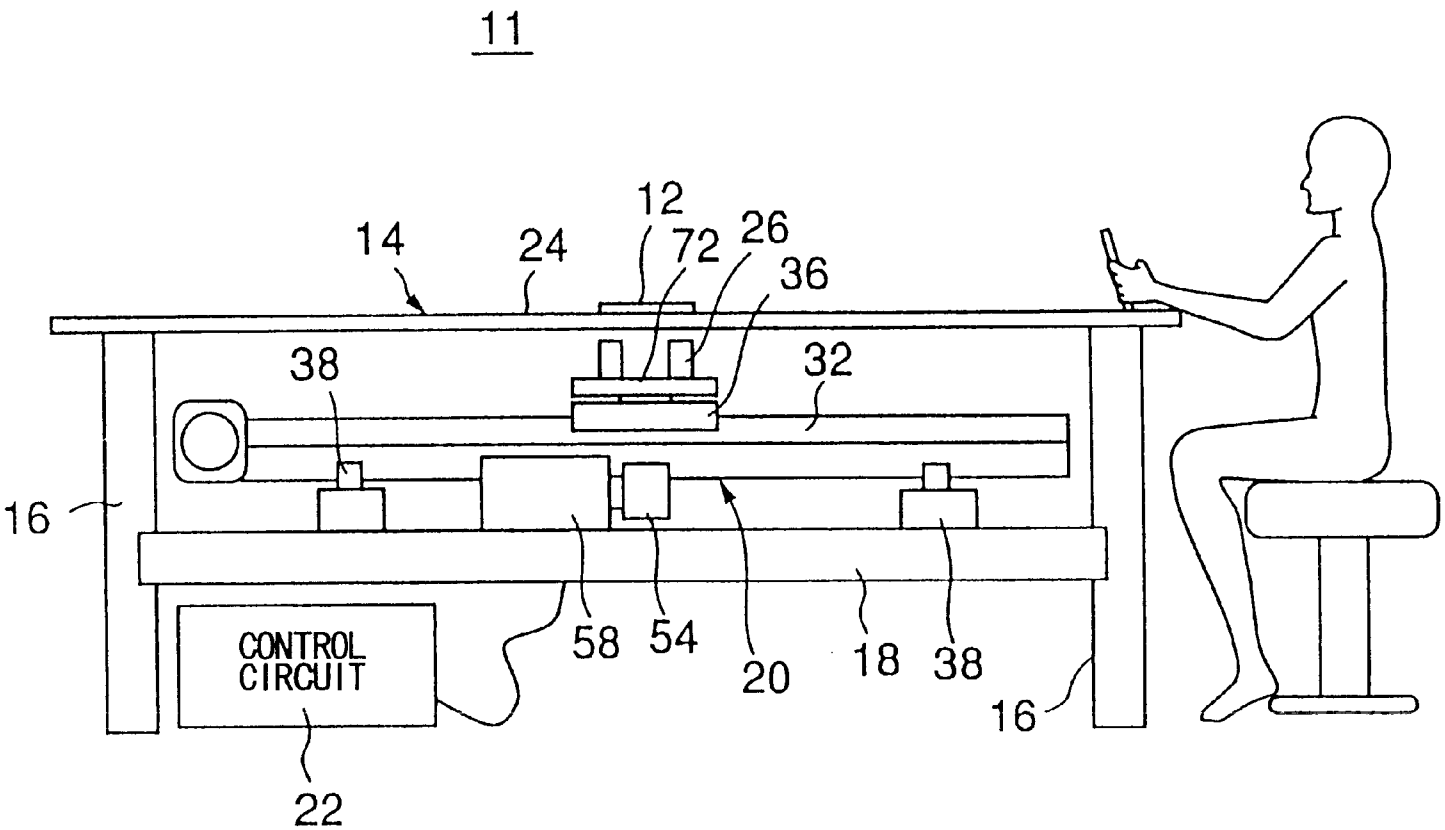
FIG. 1 is a side view of one embodiment of a card game machine in accordance with the present invention.
Figure 2:
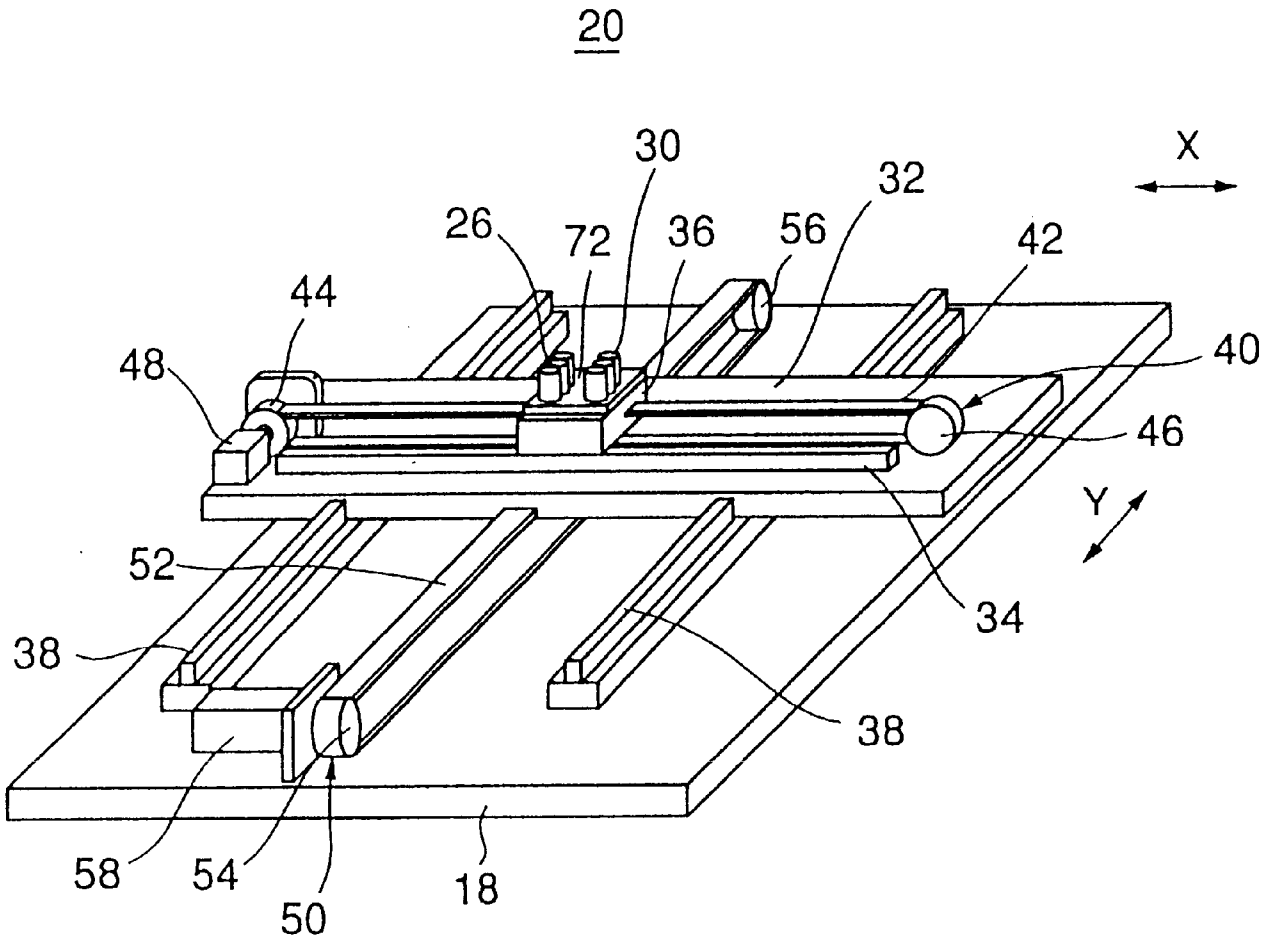
FIG. 2 is a perspective view of a card transportation mechanism.

FIG. 1 is a side view of one embodiment of a card game machine in accordance with the present invention. FIG. 2 is a perspective view of a card transportation mechanism.

As shown in FIGS. 1 and 2, the card game machine 11 comprises a table 14 on which a card 12 is placed, a card transportation mechanism (XYθ table) 20 supported by a fixed base 18 that bridges the legs 16 of the table 14, and a control circuit 22 that controls the card transportation mechanism 20.

The card transportation mechanism 20 comprises a magnetic circuit 26 that is located in the vicinity of the lower surface of a card placement unit 24 of the table 14, and a slider (a mobile member) 36 that supports and moves the magnetic circuit 26 in the X and Y directions.

Figure 3:
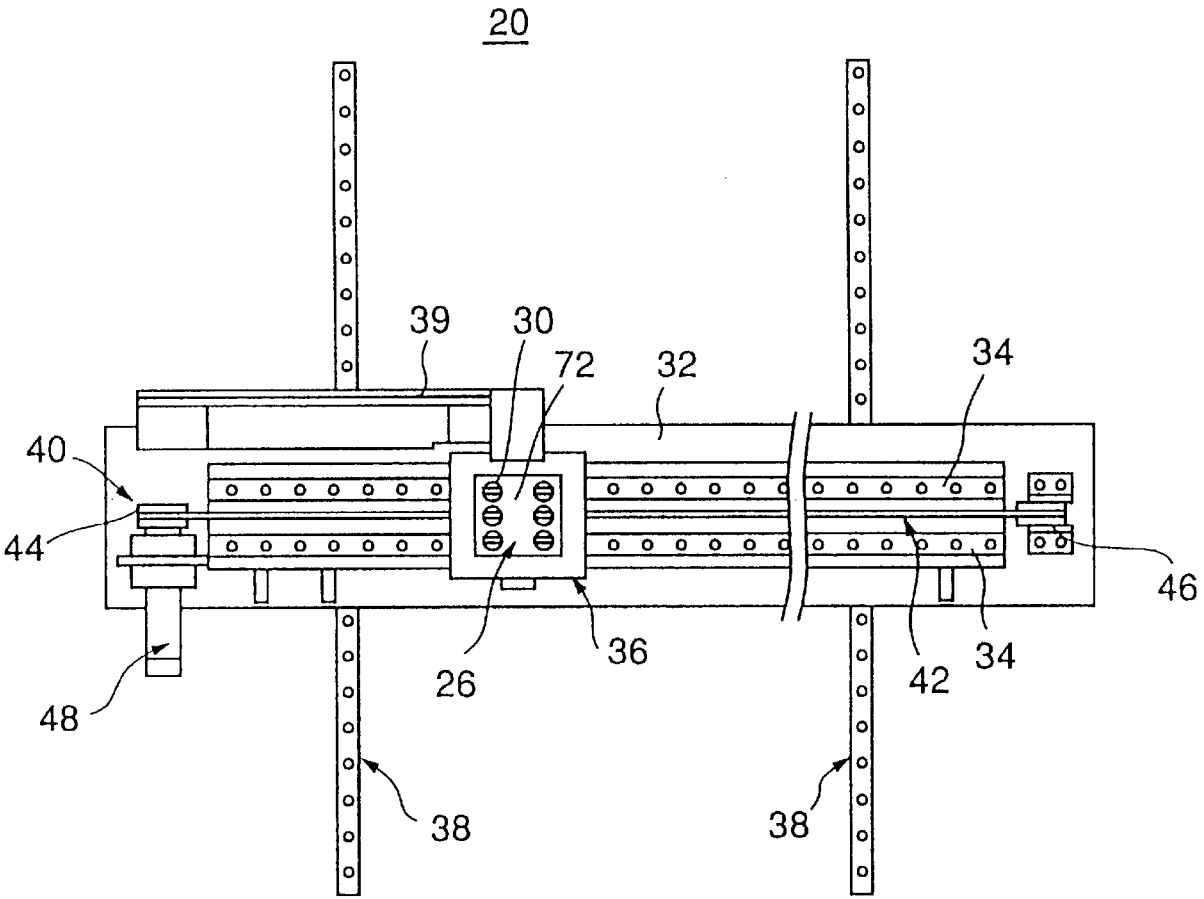
FIG. 3 is a plan view of the card transportation mechanism 20.

FIG. 3 is a plan view of the card transportation mechanism 20, and FIG. 4 is a side view of the card transportation mechanism 20.

As shown in FIGS. 3 and 4, the card transportation mechanism 20 comprises a mobile base 32 that extends in the X direction, a pair of X-direction guide rails (guide members) 34 that are supported by the mobile base 32, the slider (the mobile member) 36 that moves along the X-direction guide rails 34, and a pair of Y-direction guide rails (guide members) 38 that extend in the Y direction. An X-direction driving mechanism 40 that moves the slider 36 in the X direction is placed on the mobile base 32.

The X-direction driving mechanism 40 comprises a belt 42 that is joined to the slider 36, a pair of pulleys 44 and 46 around which the belt 42 is wound, and a servo motor (a driving unit) 48 provided with a gear for rotating the pulley 44. When the motor 48 is driven to transmit its rotation driving force to the pulley 44, the belt 42 is wound in the rotation direction of the pulley 44, thereby moving the slider 36 in the X direction.

As shown in FIG. 2, a Y-direction driving mechanism 50 that moves the mobile base 32 along the Y-direction guide rail 38 is also placed on the fixed base 18. The Y-direction driving mechanism 50 has the same structure as the X-direction driving mechanism 40, comprising a belt that is joined to the mobile base 32, a pair of pulleys 54 and 56 around which the belt 52 is wound, and a servo motor (a driving unit) 58 provided with a gear for rotating the pulley 54. When the motor 58 is driven to transmit its rotation driving force to the pulley 54, the belt 52 is wound in the rotation direction of the pulley 54, thereby moving the mobile base 32 in the Y-direction.

The magnetic circuit 26 is placed on the upper surface of the slider 36, which moves the magnetic circuit 26 in the X direction or the Y direction. Since an iron chip (a ferromagnetic material) is buried in the card 12 placed on the card placement unit 24 of the table 14 as described later, the card 12 is pulled by the magnetic force of the magnetic circuit 26, and moved in the X direction or the Y direction, following the movement of the slider 36. In this embodiment, the magnetic circuit 26 comprises six electromagnets 30 ($\mathbf{30}_1$ to $\mathbf{30}_6$) in three pairs.

The magnetic circuit 26 can be rotatively moved in the horizontal direction (θ direction) on the upper surface of the slider 36. The slider 36 is equipped with a motor 37 that rotates a rotation base 72 in the θ direction. The magnetic circuit 26 is mounted on the rotation base 72. Therefore, the card 12 placed on the card placement unit 24 is rotated in the rotational direction of the rotation base 72, and thus shifted toward the player.

The motor 37 is connected to a cable (not shown) guided by a cable guide 39 connected to a side of the slider 36. The cable guide 39 guides and bends the cable in a U-shape. As the slider 36 moves, the U-shaped portion also moves.

In this embodiment, the X-direction driving mechanism 40 and the Y-direction driving mechanism 50 are made up of belts and pulleys. However, it is also possible to form the X-direction driving mechanism 40 and the Y-direction driving mechanism 50 from racks and pinions or linear motors.

FIG. 5A is a plan view of the card 12. FIG. 5B is a side view of the card 12. FIG. 5C is an enlarged side view of the card 12.

As shown in FIGS. 5A to 5C, the card 12 is made of a non-magnetic synthetic resin material, and six iron chips 70 (70*a* to 70*f*) are buried along a long side of the card 12. Each of the iron chips 70 (70*a* to 70*f*) is a plate-like magnetic material, such as soft iron, which is difficult to magnetize. Each of the iron chips 70 is thinner than the card 12. The iron chips 70 are arranged in parallel with each other, extending in the short-side direction (the X direction), which is perpendicular to the long side. More specifically, each of the iron chips 70 (70*a* to 70*f*) is formed by insert molding and extends from one long side of the card 12 in the short-side direction (the X direction). In this structure, the iron chips 70 (70*a* to 70*f*) are buried in the card 12 and cannot be seen from the outside.

In this embodiment, the three iron chips 70*a* to 70*c* are arranged at predetermined intervals at the upper left portion of the card 12, while the other three iron chips 70*d* to 70*f* are arranged at predetermined intervals at the lower left portion of the card 12.

It should be noted that gaps Sa are interposed between the iron chips 70*a* to 70*c* and the iron chips 70*d* to 70*f*, so that the direction of the card 12 can be adjusted in the direction of the line of magnetic force generated from the magnetic circuit 26.

Next, the structure of the magnetic circuit 26 will be described.

Figure 6:
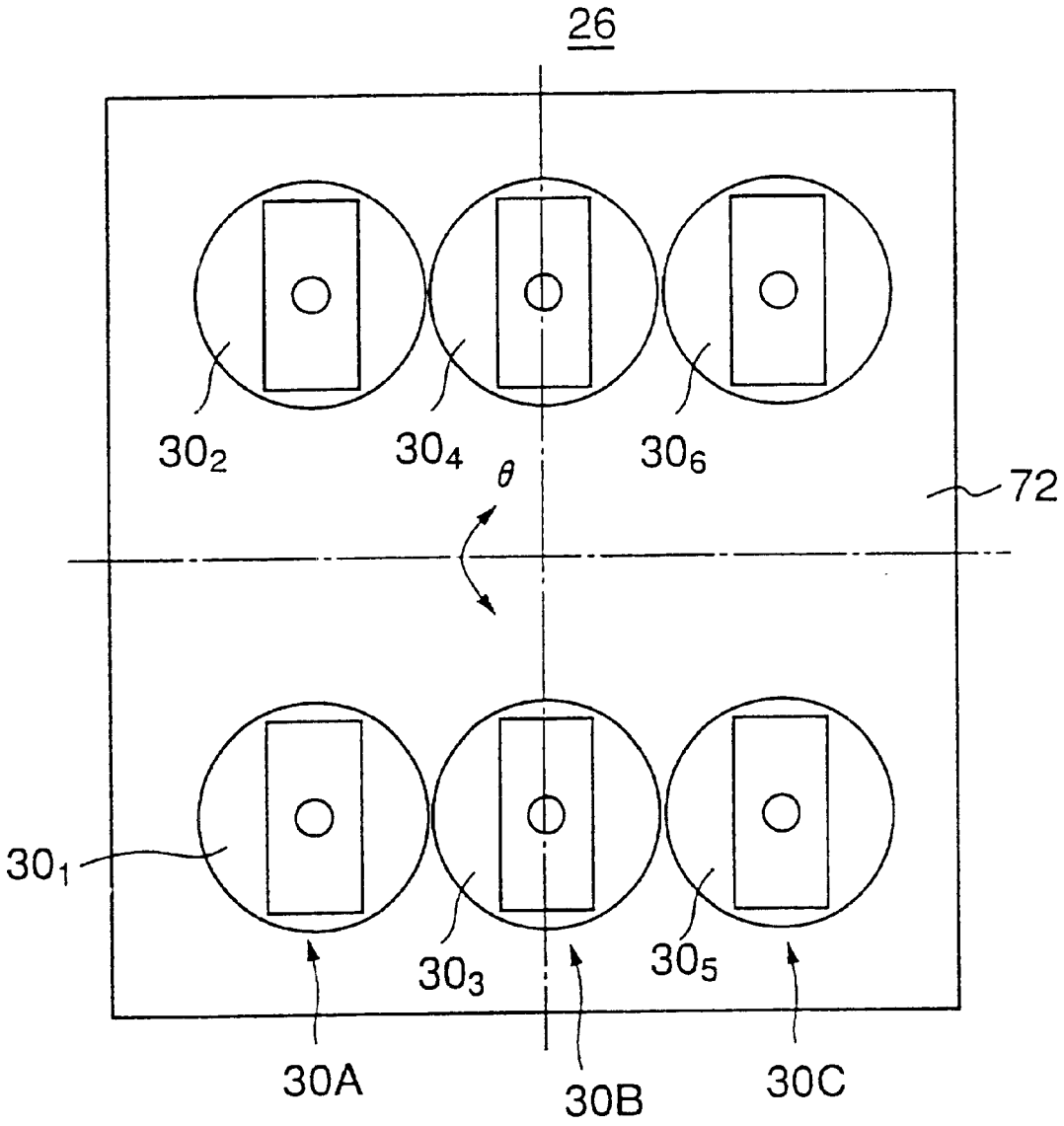
FIG. 6 is a plan view illustrating the structure of a magnetic circuit 26.

FIG. 6 is a plan view showing the structure of the magnetic circuit 26.

As shown in FIG. 6, the six electromagnets 30 ($\mathbf{30}_1$ to $\mathbf{30}_6$) that constitute the magnetic circuit 26 are arranged in three pairs on the rotation base 72, which is rotatably supported in the θ direction by the slider 36. More specifically, the three pairs of electromagnets 30 are arranged as an electromagnet unit 30A (the electromagnets $\mathbf{30}_1$ and $\mathbf{30}_2$), an electromagnet unit 30B (the electromagnets $\mathbf{30}_3$ and $\mathbf{30}_4$), and an electromagnet unit 30C (the electromagnets $\mathbf{30}_5$ and $\mathbf{30}_6$). The electromagnet units 30A to 30C function as first to third magnetic force generating units, respectively, and the control circuit 22 controls the polarity and the magnitude of the magnetic force of each of the electromagnet units 30A to 30C.

Figure 7A:
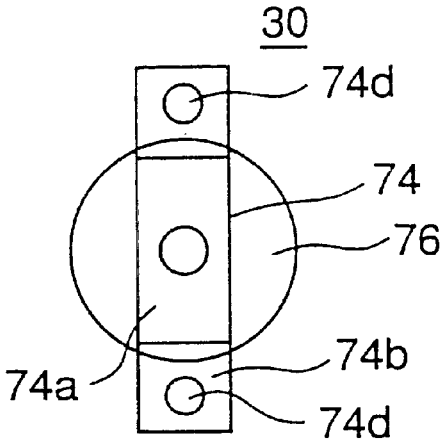
FIG. 7A is a plan view of an electromagnet 30.
Figure 7B:
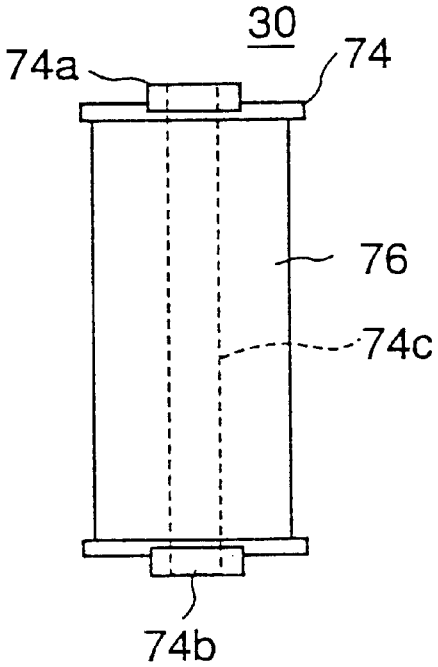
FIG. 7B is a front view of the electromagnet 30.
Figure 7C:
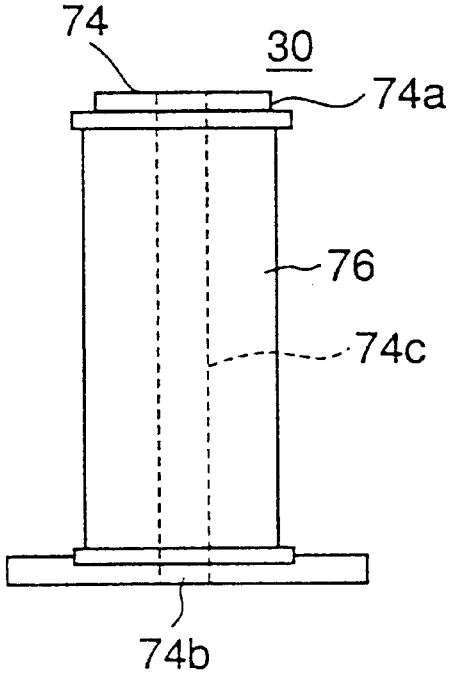
FIG. 7C is a side view of the electromagnet 30.

FIG. 7A is a plan view of the electromagnet 30. FIG. 7B is a front view of the electromagnet 30. FIG. 7C is a side view of the electromagnet 30.

As shown in FIGS. 7A to 7C, the electromagnet 30 includes a coil 76 that is wound around a core 74. The core 74 has an iron core 74*c* that is inserted between an upper pole plate 74*a* and a lower pole plate 74*b* in the axis direction. The lower pole plate 74*b* is provided with a hole 74*d* for inserting a machine screw to be fixed to the rotation base 72.

Accordingly, as electric current flows through the coil 76, a magnetic field that passes through the iron core 74*c* of the core 74 is formed, so that the upper pole plate 74*a* becomes an N (north-seeking) pole while the lower pole plate 74*b* becomes an S (south-seeking) pole, for instance.

Meanwhile, as the reverse-direction electric current flows through the coil 76, the polarities are reversed from the above case, i.e., the upper pole plate 74*a* becomes the S pole while the lower pole plate 74*b* becomes the N pole.

Figure 8:
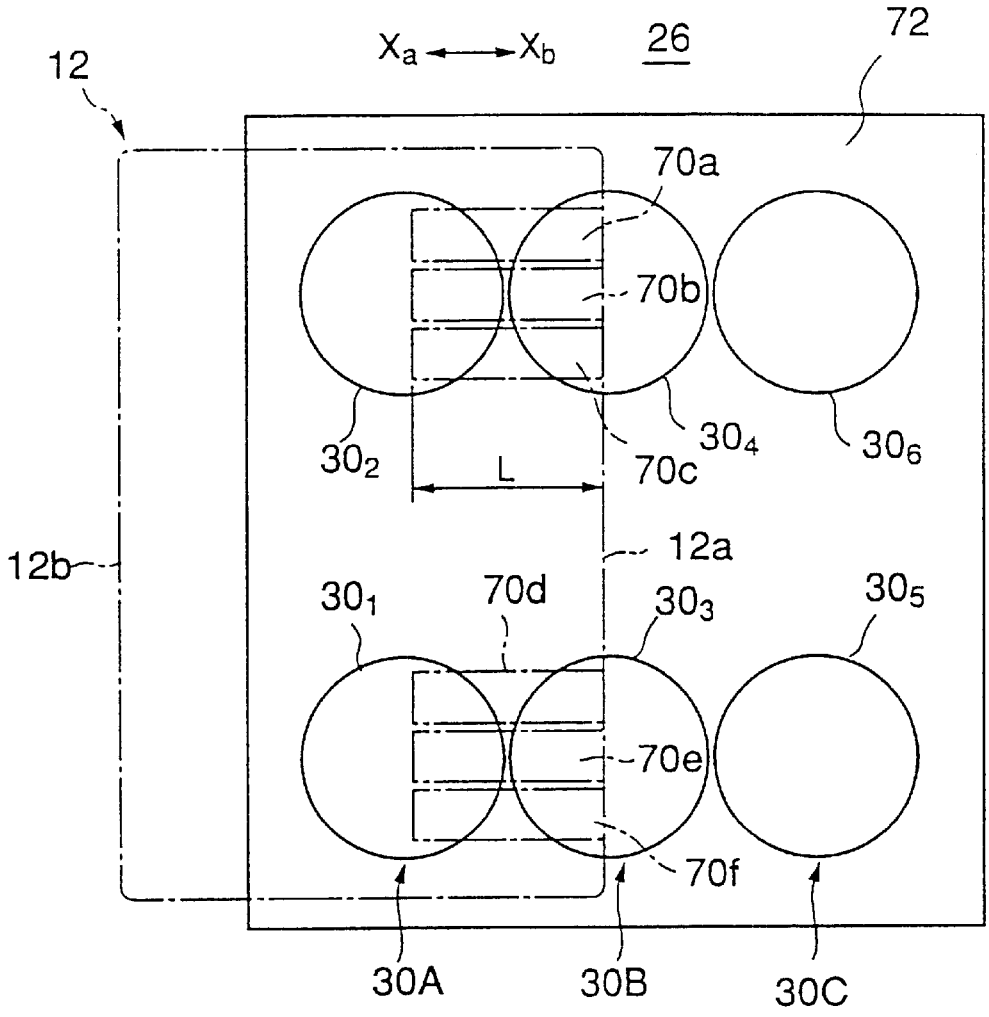
FIG. 8 is a plan view showing the positional relationship between the card 12 prior to the reversal and the magnetic circuit 26.
Figure 9:
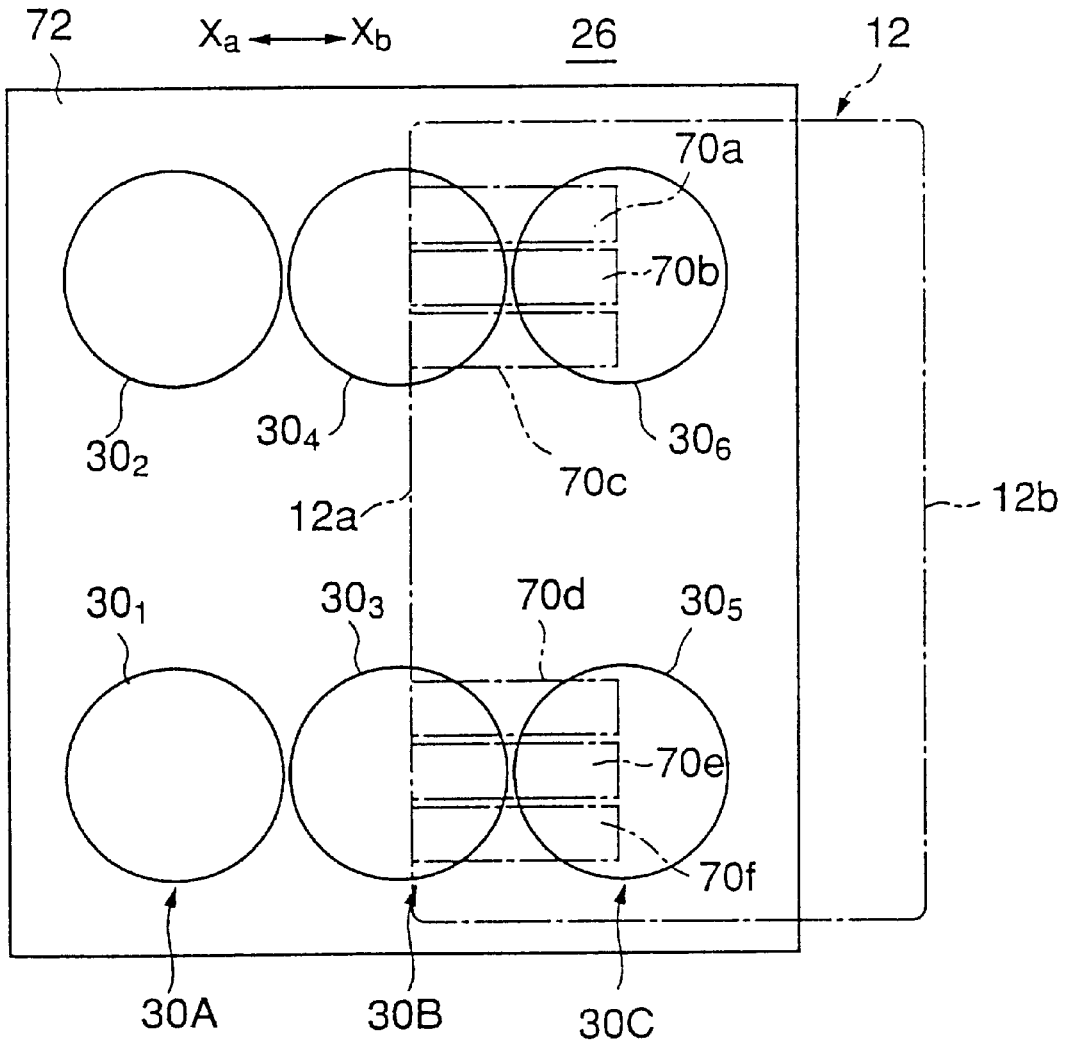
FIG. 9 is a plan view showing the positional relationship between the card 12 after the reversal and the magnetic circuit 26.

FIG. 8 is a plan view showing the positional relationship between the card 12 prior to the reversal and the magnetic circuit 26. FIG. 9 is a plan view showing the positional relationship between the card 12 after the reversal and the magnetic circuit 26.

As shown in FIG. 8, the entire length L of each iron chips 70 (70*a* to 70*f*) in the longitudinal direction is substantially the same as the gap between the electromagnet units A and B or the gap between the electromagnet units B and C.

When the card 12 is placed on the card placement unit 24 of the table 14 prior to the reversal, the relative relationship between the iron chips 70 (70*a* to 70*f*) buried in the card and the electromagnet units 30A to 30C is set so that the iron chips 70 (70*a* to 70*f*) bridges the electromagnet units 30A and 30B. More specifically, the iron chips 70*a* to 70*c* are placed so as to bridge the electromagnets $\mathbf{30}_2$ and $\mathbf{30}_4$, while the iron chips 70*d* to 70*f*are placed so as to bridge the electromagnets $\mathbf{30}_1$ and $\mathbf{30}_3$. As a result, the end portion 12*a* on a long side of the card 12. (i.e., the end portions of the iron chips 70*a* to 70*f*) is located at the center of the electromagnet unit 30B (i.e., the electromagnets $\mathbf{30}_3$ and $\mathbf{30}_4$).

After the card 12 is placed in the predetermined position, a Hall element (not shown) located on the upper pole plate 74*a*, for instance, detects the placement of the card 12. The Hall element detects a change caused in the magnetic field when the card 12 is placed in the predetermined position, and outputs a detection signal to the control circuit 22. The control circuit 22 then recognizes the placement of the card 12 in the predetermined position, and selectively excites the electromagnet units 30A to 30C in accordance with a control program (a magnetic field switching unit) that drives and controls the magnetic circuit 26.

With the card 12 being placed in the predetermined position, the electromagnet unit 30A (the electromagnets $\mathbf{30}_1$ and $\mathbf{30}_2$) and the electromagnet unit 30B (the electromagnets $\mathbf{30}_3$ and $\mathbf{30}_4$) are excited in such a manner that the polarity at the upper end of the electromagnet unit 30A differs from the polarity at the upper end of the electromagnet unit 30B. As a result, the iron chips 70*a* to 70*f* buried in the card 12 serve as magnetic paths for the magnetic field formed between the electromagnet units 30A and 30B. For instance, if the upper end of the electromagnet unit 30A (the electromagnets $\mathbf{30}_1$ and $\mathbf{30}_2$) is an N pole while the upper end of the electromagnet unit 30B (the electromagnets $\mathbf{30}_3$ and $\mathbf{30}_4$) is an S pole, the line of magnetic force generated from the electromagnets $\mathbf{30}_1$ and $\mathbf{30}_2$ toward the electromagnets $\mathbf{30}_3$ and $\mathbf{30}_4$ passes through the iron chips 70*d* to 70*f* in the card 12, thereby attracting the iron chips 70*a* to 70*f*.

Accordingly, the card 12 placed on the card placement unit 24 of the table 14 is pulled in between the electromagnet units 30A and 30B via the iron chips 70*d* to 70*f*. When the slider 36 that supports the magnetic circuit 26 moves in the X direction or the Y direction along the X-direction guide rails 34 or the Y-direction guide rails 38 of the card transportation mechanism 20, the card 12 slides on the upper surface of the card placement unit 24, following the moving direction of the magnetic circuit 26.

If the electromagnet units 30A and 30B are excited in such a manner that the polarities of the electromagnet units 30A and 30B become the same, with the card 12 being placed on the card placement unit 24 of the table 14, the end portion 12*b* on the other side of the card 12 has the same polarity (an S pole or N pole) as the polarity of the electromagnet unit 30A and becomes repulsive to the electromagnet unit 30A. As a result, the end portion 12*b* of the card 12 separates and floats from the card placement unit 24, and rotates around the end portion 12*a* (the end portions of the iron chips 70*a* to 70*f*) in the Xb direction. More specifically, the end proton 12*a* (the end portions of the iron chips 70*a* to 70*f*) of the card 12 is attracted to the center electromagnet unit 30B (the electromagnets $\mathbf{30}_3$ and $\mathbf{30}_4$), while the other end portion 12*b* of the card 12 is repulsive to the magnetic force of the left-side electromagnet unit 30A (the electromagnets $\mathbf{30}_1$ and $\mathbf{30}_2$). As a result, the card 12 rotates through 180 degrees, with its front surface (the face of the card) facing upward.

From a player's point of view, the card 12 appears to be spontaneously moving, which makes the game more enjoyable. When the card 12 comes to a halt in front of the player, the change of the magnetic force of the magnetic circuit 26 rotates the card 12 around the end portions 12*a* (the end portions of the iron chips 70*a* to 70*f*), so that the face of the card 12 is shown to the player. Here, the card 12 appears to reverse spontaneously in front of the player, and the player can enjoy the card game while marveling at the reversal movement of the card 12.

The card game machine 11 and the card transportation mechanism 20 of the present invention transport and reverse the real card 12. Compared with the prior art in which each card is shown on a display device, the credibility of the card game is higher when the card 12 is reversed. This stimulates more people to participate in the game, and leads to a higher operation rate of the card game machine 11.

Also, the card game machine 11 and the card transportation mechanism 20 can automate the transportation and reversal of the card 12. Accordingly, the present invention can be applied not only to a card game machine but also to a place of entertainment such as a casino.

Figure 10:
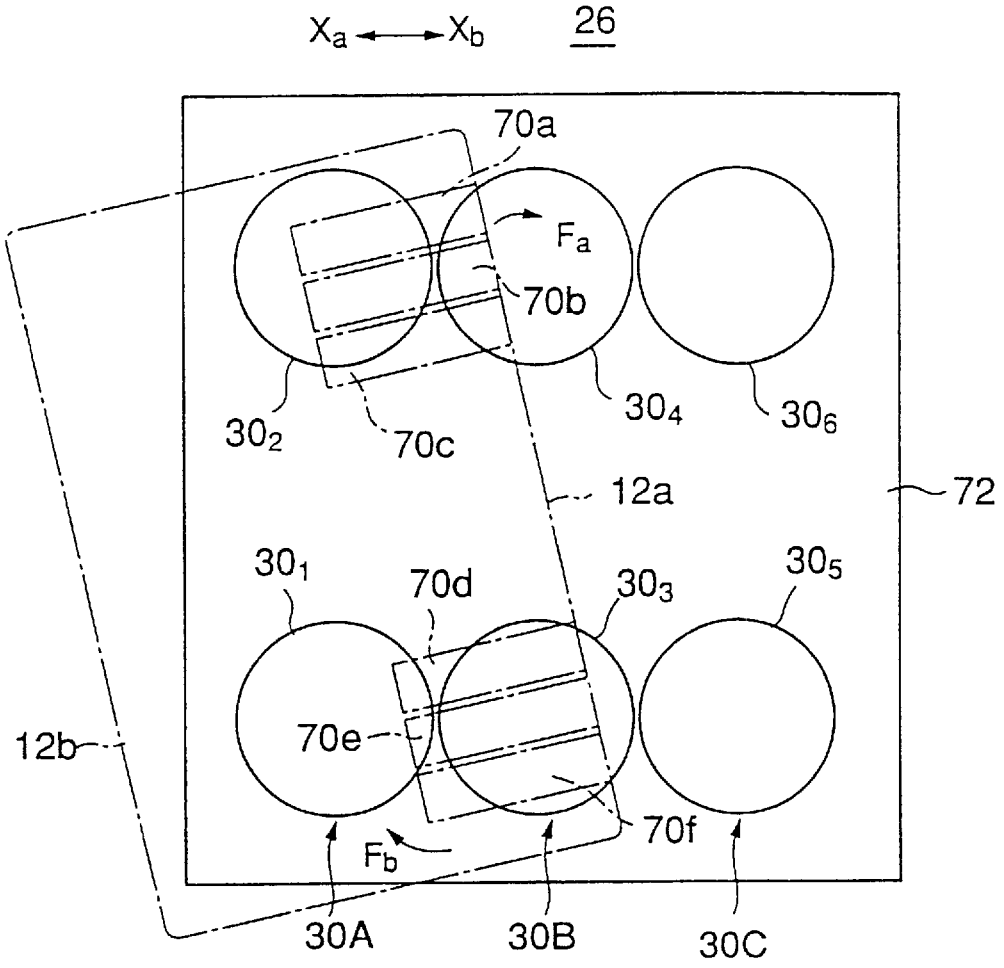
FIG. 10 illustrates an operation when the location of the card 12 deviates with respect to electromagnet units 30A to 30C of the magnetic circuit 26.

FIG. 10 is a plan view illustrating an operation in a case where the location of the card 12 deviates with respect to the electromagnet units 30A to 30C of the magnetic circuit 26.

In FIG. 10, the card 12 is placed in a position that is obliquely displaced with respect to the electromagnet units 30A to 30C. If the electromagnet units 30A and 30B are excited so as to have different polarities (one is an S pole, while the other is an N pole), the magnetic flux between the electromagnet units 30A and 30B connects the iron chips 70*a* to 70*c* at the shortest distance possible. As a result, the iron chips 70*a* to 70*c* are rotatively attracted to a position between the electromagnets $\mathbf{30}_2$ and $\mathbf{30}_4$, and the iron chips 70*d* to 70*f* are rotatively attracted to a position between the electromagnets $\mathbf{30}_1$ and $\mathbf{30}_3$.

For instance, as shown in FIG. 10, the end portion of the iron chip 70*a* largely deviates from the electromagnet $\mathbf{30}_4$, and the end portions of the iron chips 70*b* and 70*c* slightly deviate from the electromagnet $\mathbf{30}_4$. Even in such a case, a force Fa that attracts the iron chips 70*a* to 70*c* toward the electromagnet $\mathbf{30}_4$ and a force Fb that attracts the iron chips 70*d* and 70*e* toward the electromagnet $\mathbf{30}_1$ are generated.

As a result, even if the end portions of the iron chips 70*a* to 70*f* are dislocated from the electromagnets $\mathbf{30}_1$ to $\mathbf{30}_4$, as shown in FIG. 10, the attraction force F of the electromagnets $\mathbf{30}_1$ to $\mathbf{30}_4$ pulls back the iron chips 70*a* to 70*f* to the original locations as shown in FIG. 8.

Figure 11:
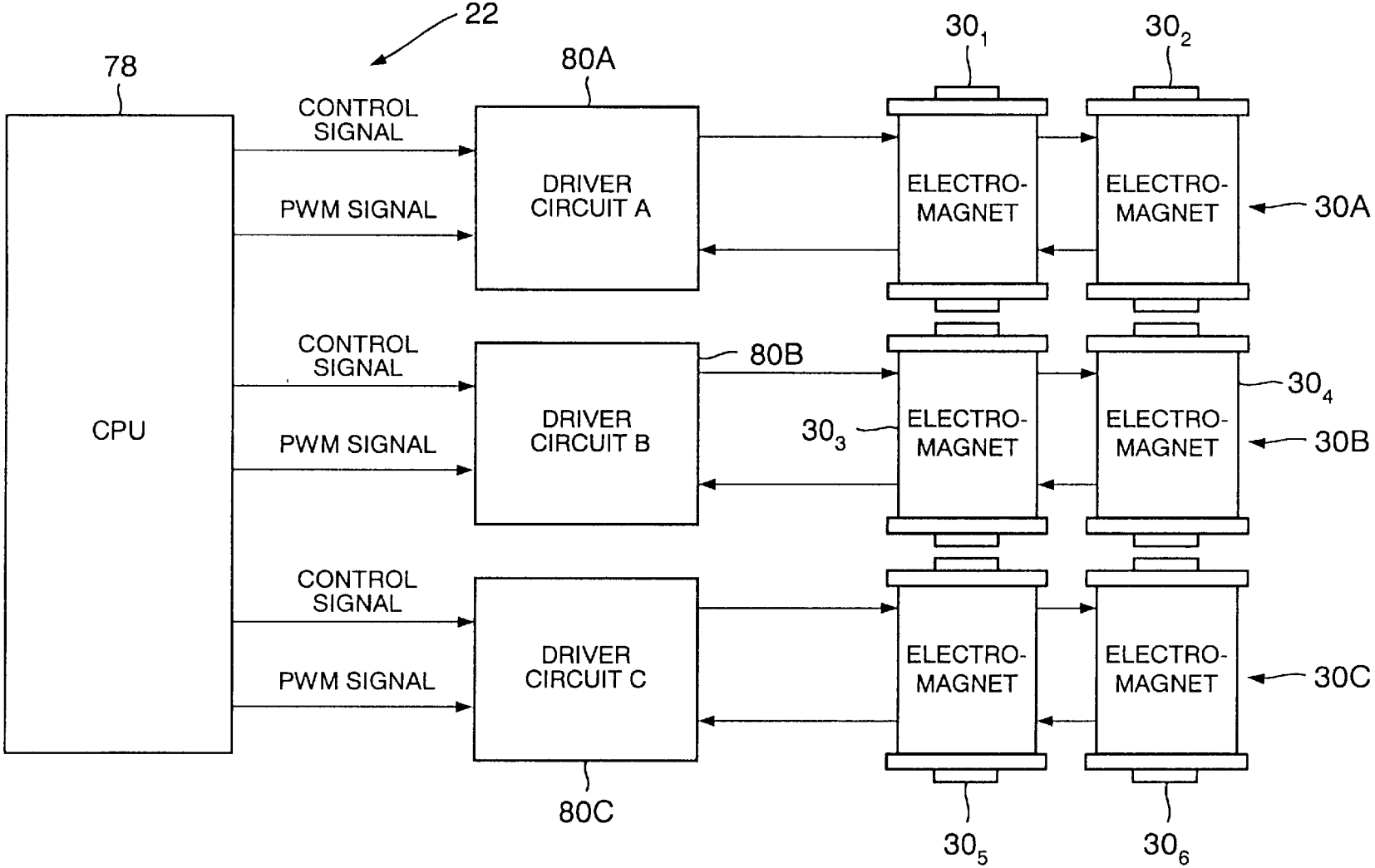
FIG. 11 is a block diagram showing a control circuit 22 that controls electromagnets $\mathbf{30}_1$ to $\mathbf{30}_6$.

FIG. 11 is a block diagram of the control circuit 22 that controls the electromagnets $\mathbf{30}_1$ to $\mathbf{30}_6$.

As shown in FIG. 11, the control circuit 22 comprises a CPU 78 that control the magnetic circuit 26, and driver circuits 80A to 80C that receive control signals and PWM (Pulse Width Modulation) signals supplied from the CPU 78, and control the electromagnets $\mathbf{30}_1$ to $\mathbf{30}_6$ by each of the electromagnet units 30A to 30C.

The control signals outputted from the CPU 78 put the driver circuits 80A to 80C into an operation state, and also switch the polarities of the electromagnets $\mathbf{30}_1$ to $\mathbf{30}_6$. The PWM signals control the strength of the magnetic force of each of the electromagnets $\mathbf{30}_1$ to $\mathbf{30}_6$ by the duty ratio of the signals. This control method using the PWM signals is used for controlling a DC motor or the like, and involves the control of current flowing through the coil 76 by varying the period of on and off times of voltage applied to the coil 76 in accordance with the transient characteristics of the coil 76.

Accordingly, the driver circuits 80A to 80C switches the polarities of the electromagnet units 30A to 30C and controls the strength of the magnetic force, in accordance with the control signals and the PWM signals supplied from the CPU 78. The driver circuit 80A controls the value and the flowing direction of the current to be supplied to the electromagnets $\mathbf{30}_1$ and $\mathbf{30}_2$. The driver circuit 80B controls the value and the flowing direction of the current to be supplied to the electromagnets $\mathbf{30}_3$ and $\mathbf{30}_4$. The driver circuit 80C controls the value and the flowing direction of the current to be supplied to the electromagnets $\mathbf{30}_5$ and $\mathbf{30}_6$.

The control circuit 22 switches the polarities and controls the strength of the magnetic force of each of the electromagnet units 30A to 30C, thereby attracting and reversing the card 12 placed on the card placement unit 24 of the table 14.

Next, a method of controlling the magnetic circuit 26 by the control circuit 22 will be described in the following.

Figure 12:
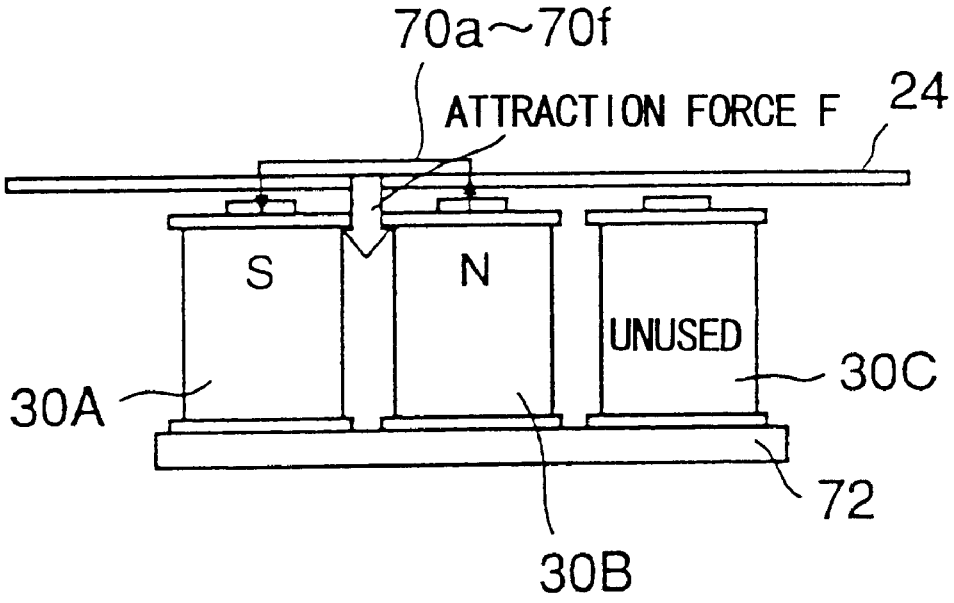
FIG. 12 is a side view illustrating the condition of the magnetic circuit 26 during a card transporting operation.
Figures 13A, 13B, 13C:
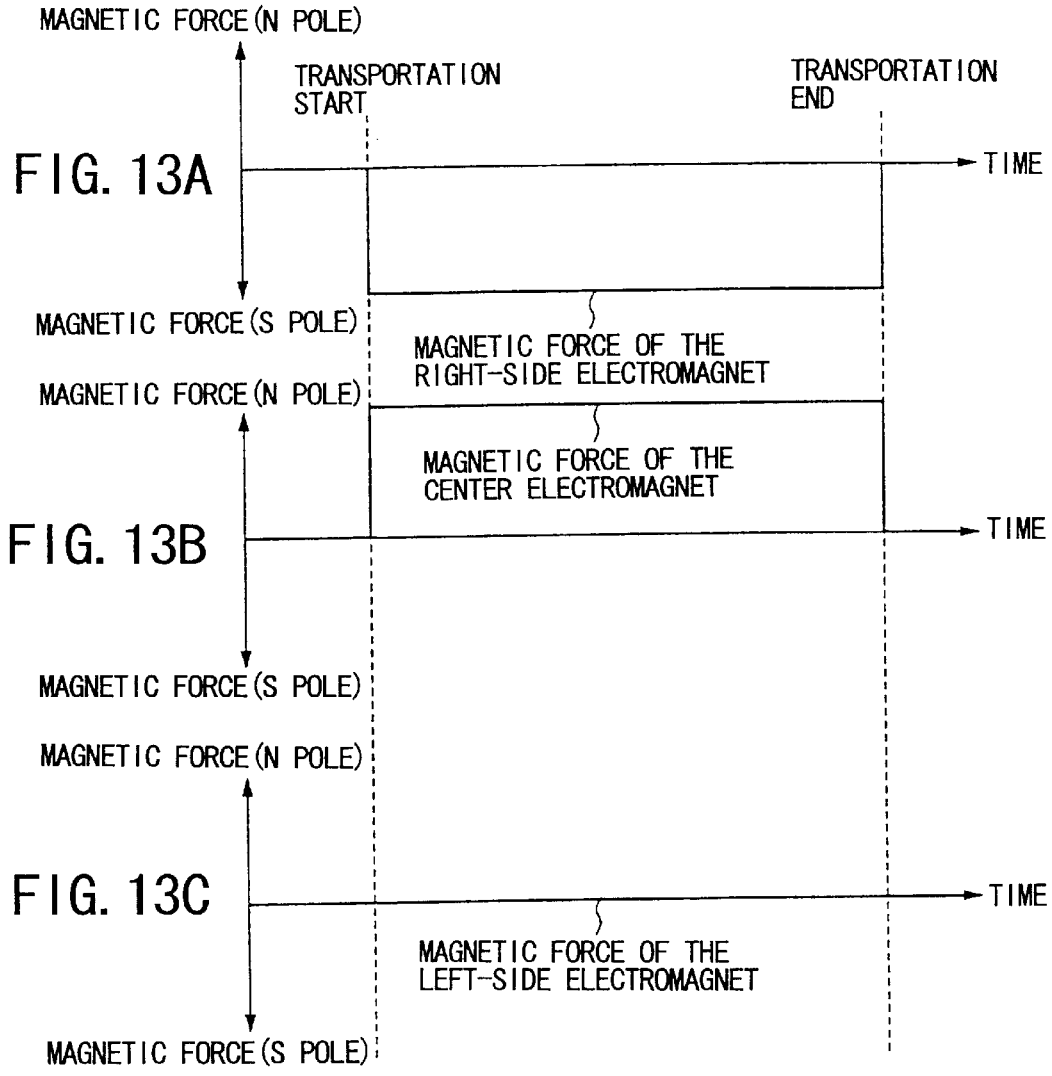
FIG. 13A is a waveform showing a change in the magnetic force of the electromagnet unit 30A during a card transporting operation.
FIG. 13B is a waveform showing a change in the magnetic force of the electromagnet unit 30B during a card transporting operation.
FIG. 13C is a waveform showing a change in the magnetic force of the electromagnet unit 30C during a card transporting operation.

FIG. 12 is a side view of the magnetic circuit during a card transporting operation. FIG. 13A is a waveform showing a change in the magnetic force of the electromagnet unit 30A during a card transporting operation. FIG. 13B is a waveform showing a change in the magnetic force of the electromagnet unit 30B during a card transporting operation. FIG. 13C is a waveform showing a change in the magnetic force of the electromagnet unit 30C during a card transporting operation.

As shown in FIGS. 12 to 13C, when the card 12 placed on the card placement unit 24 of the table 14 is transported, the control circuit 22 controls the electromagnet unit 30A to be an S pole and the electromagnet unit 30B to be an N pole. Here, the electromagnet unit 30C is not energized and remains in a non-used state. The surface of the card placement unit 24 has been polished by a low abrasive material.

In this manner, as the control signals and the PWM signals are outputted to turn the electromagnet unit 30A into an S pole and the electromagnet unit 30B into an N pole, the line of magnetic force generated between the electromagnets $\mathbf{30}_1$ and $\mathbf{30}_2$ and the electromagnets $\mathbf{30}_3$ and $\mathbf{30}_4$ passes through the iron chips 70*a* to 70*f* in the card 12 placed on the card placement unit 24, thereby attracting the iron chips 70*a* to 70*f*.

Accordingly, the iron chips 70*a* to 70*f* in the card 12 placed on the card placement unit 24 of the table 14 are pulled in between the electromagnet units 30A and 30B. As the slider 36 that supports the magnetic circuit 26 moves in the X direction or the Y direction along the X-direction guide rails 34 and the Y-direction guide rails 38 of the card transportation mechanism 20, the card 12 slides on the upper surface of the card placement unit 24, following the movement of the slider 36 and the magnetic circuit 26.

In this manner, the card 12 appears to be spontaneously moving on the card placement unit 24 without external force, and each player can enjoy the card game while marveling at the movement of the card 12.

The attraction force F of the electromagnet units 30A and 30B are determined by the current value controlled by the PWM signals outputted from the CPU 78.

Next, a control operation by the magnetic circuit 26 when the card 12 placed on the card placement unit 24 is reversed to the left side will be described.

Figure 14:
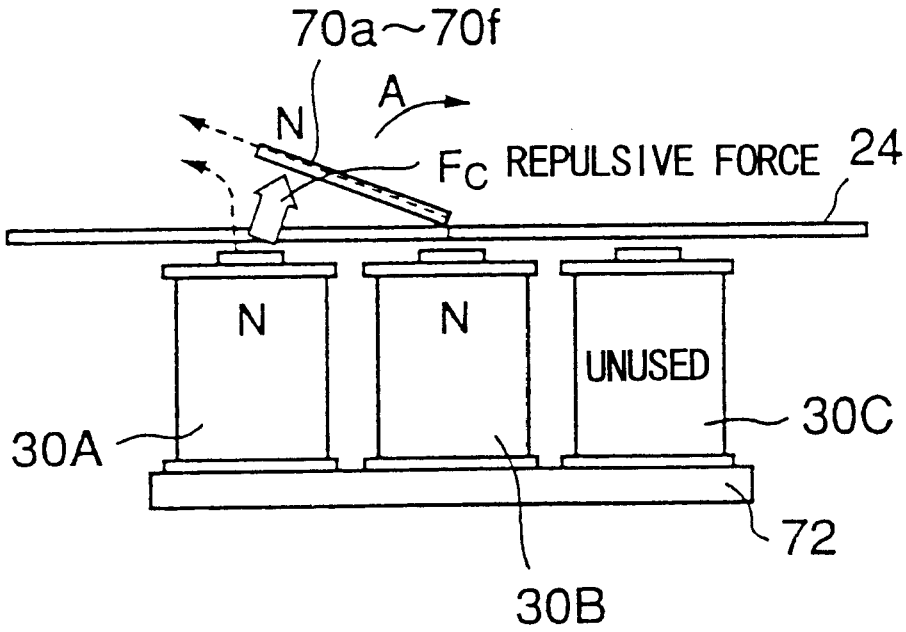
FIG. 14 is a side view illustrating a condition of the magnetic circuit 26 at a time of card reversal.
Figures 15A, 15B, 15C:
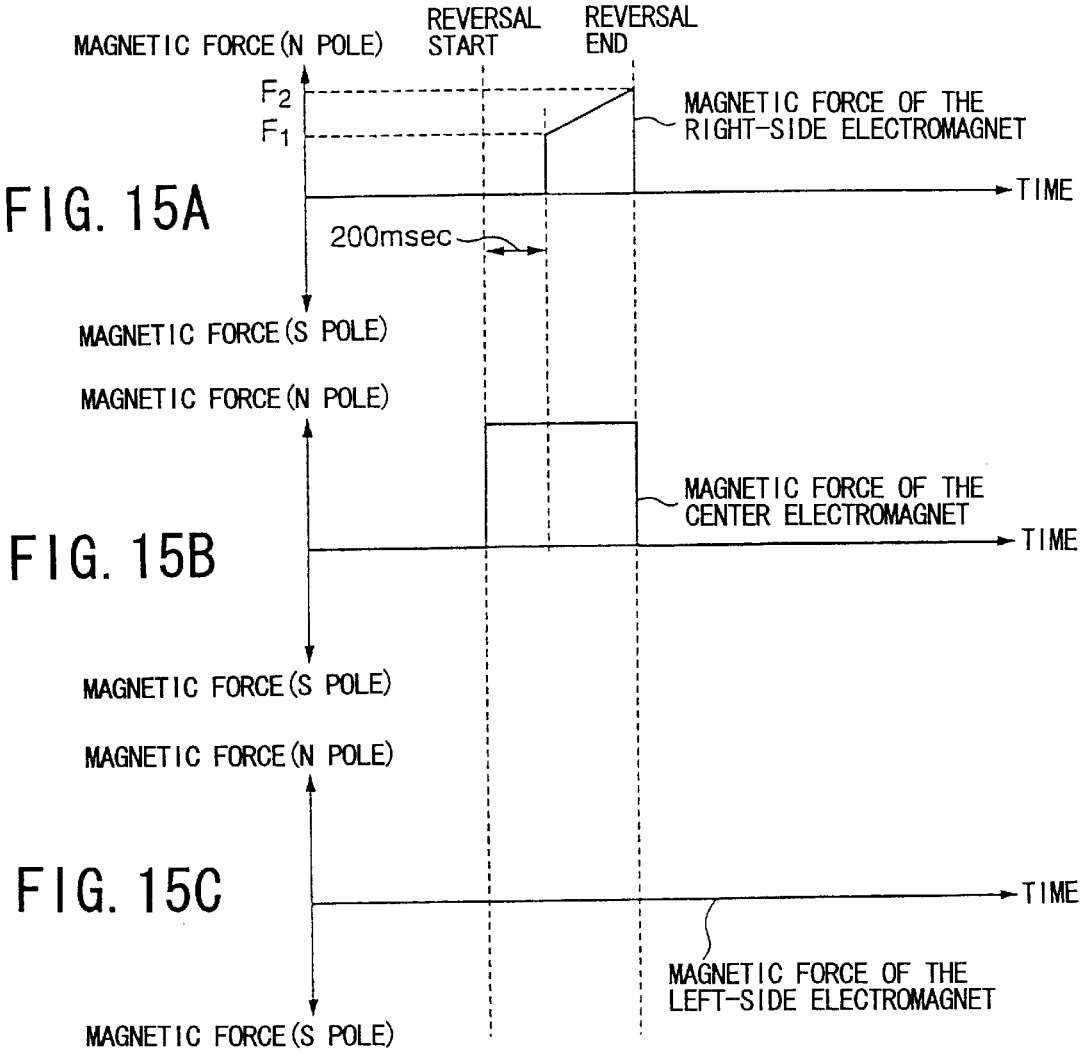
FIG. 15A is a waveform showing a change in the magnetic force of the electromagnet unit 30A at a time of card reversal.
FIG. 15B is a waveform showing a change in the magnetic force of the electromagnet unit 30B at a time of card reversal.
FIG. 15C is a waveform showing a change in the magnetic force of the electromagnet unit 30C at a time of card reversal.

FIG. 14 is a side view of the magnetic circuit 26 during a card reversing operation. FIG. 15A is a waveform showing a change in the magnetic force of the electromagnet unit 30A during a card reversing operation. FIG. 15B is a waveform showing a change in the magnetic force of the electromagnet unit 30B during a card reversing operation. FIG. 15C is a waveform showing a change in the magnetic force of the electromagnet unit 30C during a card reversing operation.

As shown in FIGS. 14 to 15C, when the card 12 placed on the card placement unit 24 of the table 14 is reversed to the left side so as to turn the face of the card upward, the control circuit 22 controls the electromagnet unit 30B to be an N pole at the start of the reversing operation. Here, the electromagnet units 30A and 30C are not energized and remain in non-used state.

The control circuit 22 then outputs a control signal and a PWM signal to make the electromagnet unit 30B become an N pole, and, 200 msec later, outputs a PWM signal to make the electromagnet unit 30A become an N pole. Thus, the card 12 can be prevented from being dragged around at the start of the reversing operation.

Furthermore, the control circuit 22 increases the value of current to be supplied to the electromagnet unit 30A so that the electromagnetic force of the electromagnet unit 30A gradually increases from the force $F_1$ to the force $F_2$.

By energizing the electromagnet unit 30B as an N pole, the end portions of the iron chips 70*d* to 70*f* facing the electromagnet unit 30A become an N pole due to the magnetic field generated from the electromagnet unit 30B. After a short period of time, the electromagnet unit 30A is then excited as an N pole, so that the iron chips 70*a* to 70*f* in the card 12 become repulsive to the magnetic field generated from the electromagnet unit 30A, and separate from the card placement unit 24.

Here, one end portion 12*a* of the card 12 is attracted to the electromagnet unit 30B, and the other end portion 12*b* of the card 12 separates from the card placement unit 24. Accordingly, as the iron chips 70*d* to 70*f* floats from the card placement unit 24, the card 12 placed on the card placement unit 24 of the table 14 rotates in the A direction around the one end portion 12*a*, with the other end 12*b* moving upward.

Furthermore, the card 12 moves beyond the upright-standing position and falls over to the opposite side due to the repulsive force Fc generated from the electromagnet unit 30A. In this manner, the card 12 appears to be reversed automatically, and each player can enjoy the care game while marveling at the reversal movement of the card 12.

Although the card 12 is quickly reversed to the right side in the above description, it is also possible to reverse quickly the card 21 to the left side by simply reversing the order of the above-mentioned control procedures of the electromagnet units 30A and 30C, with the iron chips 70*a* to 70*f* in the card 12 being placed at locations facing the electromagnet units 30A and 30B.

Next, a control method for slowly reversing the card 12 will be described.

Figure 16:
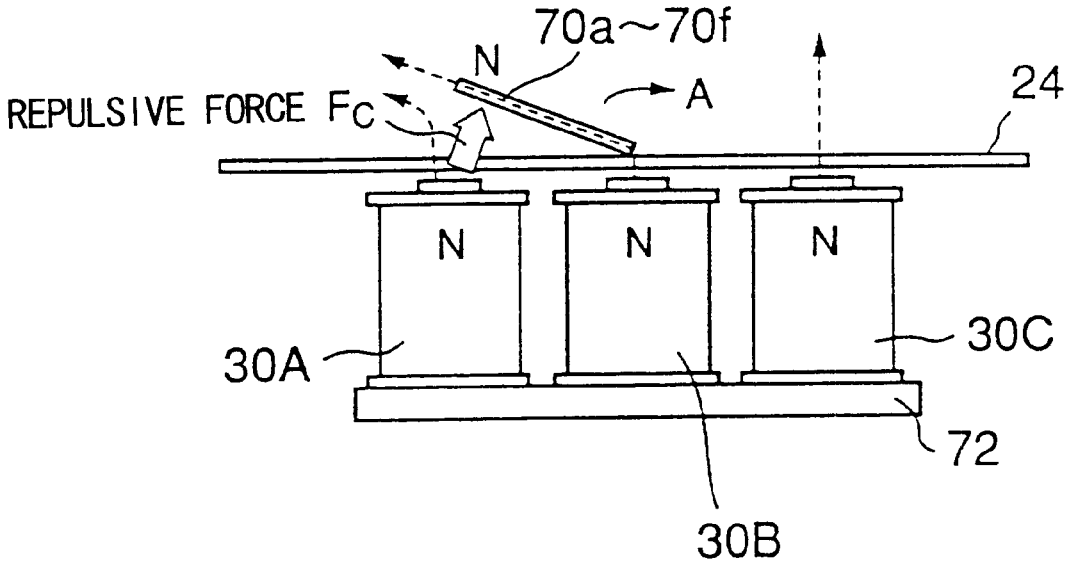
FIG. 16 is a side view showing the condition of the magnetic circuit 26 when the card 12 is slowly reversed.
Figures 17A, 17B, 17C:
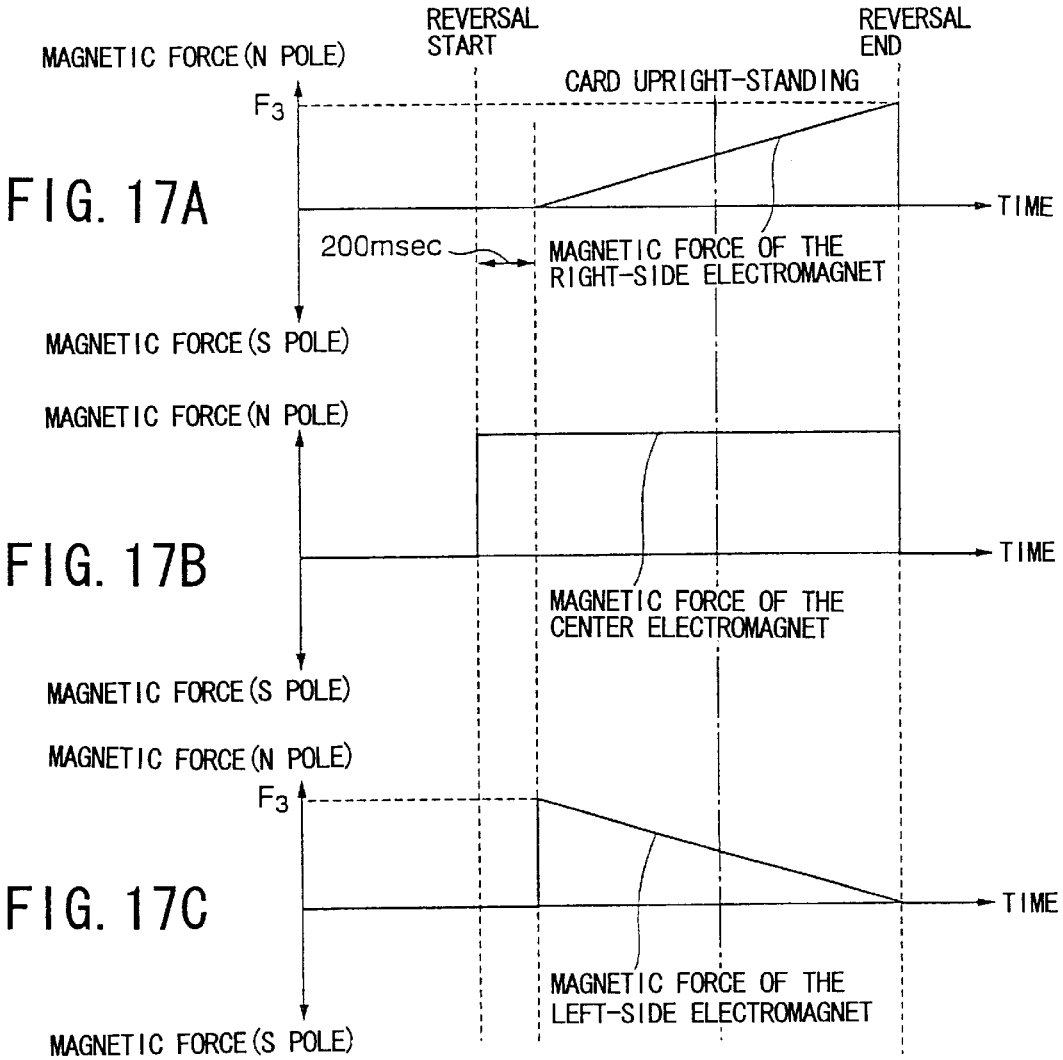
FIG. 17A is a waveform showing a change in the magnetic force of the electromagnet unit 30A when the card 12 is slowly reversed.
FIG. 17B is a waveform showing a change in the magnetic force of the electromagnet unit 30B when the card 12 is slowly reversed.
FIG. 17C is a waveform showing a change in the magnetic force of the electromagnet unit 30C when the card 12 is slowly reversed.

FIG. 16 is a side view of the magnetic circuit 26 in a case where the card 12 is slowly reversed. FIGS. 17A to 17C are waveforms showing changes in the magnetic force of the electromagnet units 30A to 30C in a case where the card 12 is slowly reversed.

As shown in FIGS. 16 to 17C, when the card 12 placed on the card placement unit 24 of the table 14 is slowly reversed, the control circuit 22 controls in such a manner that only the electromagnet unit 30B becomes an N pole at the start of a reversing operation. Here, the electromagnet units 30A and 30C are not energized, and remain in a non-used state.

For instance, 200 msec after outputting a control signal and a PWM signal so as to turn the electromagnet unit 30B into an N pole, the control circuit 22 outputs control signals and PWM signals so as to turn the electromagnet units 30A and 30C into N poles. Here, the electromagnet unit 30A is controlled so that its magnetic force gradually increases from zero to $F_3$, and the electromagnet unit 30C is controlled so that its magnetic force gradually decreases from $F_3$ to zero.

In this manner, the electromagnet unit 30B is excited to be an N pole, so that the end portions of the iron chips 70*d* to 70*f* in the card 12 facing the electromagnet unit 30A becomes an N pole due to the magnetic field generated from the electromagnet unit 30B. After a little while, the electromagnet unit 30A is excited to be an N pole, so that the iron chips 70*a* to 70*f* in the card 12 become repulsive to the magnetic filed generated from the electromagnet unit 30A and floats from the card placement unit 24.

Since the magnetic force of the electromagnet unit 30C is larger than the magnetic force of the electromagnet unit 30A, the iron chips 70*a* to 70*f* slowly separate and floats from the card placement unit 24. The card 12 then inclines to the left side of the balance point between the magnetic force of the electromagnet unit 30C and the magnetic force of the electromagnet unit 30A.

Further, when the electromagnet unit 30A is controlled so that its magnetic force gradually increases while the electromagnet unit 30C is controlled so that its magnetic force gradually decreases, the card 12 slowly rotates in the A direction and reaches the upright standing position. At this point, the magnetic force of the electromagnet unit 30A is equal to the magnetic force of the electromagnet unit 30C.

Subsequently, when the electromagnet unit 30A is controlled so that its magnetic force gradually increases while the electromagnet unit 30C is controlled so that its magnetic force gradually decreases, the card 12 slowly rotates in the A direction and inclines toward the right side. When the magnetic force of the electromagnet unit 30A reaches $F_3$ and the magnetic force of the electromagnet unit 30C reaches zero, the reversed card 12 is placed on the card placement unit 24.

In this manner, the card 12 slowly reverses itself without any external force, and each player can enjoy the card game as if to see a magic trick.

Although the card 12 is slowly reversed to the right side in the above description, it is also possible to reverse slowly the card 21 to the left side by simply reversing the order of the above-mentioned control procedures of the electromagnet units 30A and 30C, with the iron chips 70*a* to 70*f* in the card 12 being placed at locations facing the electromagnet units 30A and 30B.

Next, a first modification of the present invention will be described.

Figure 18A:
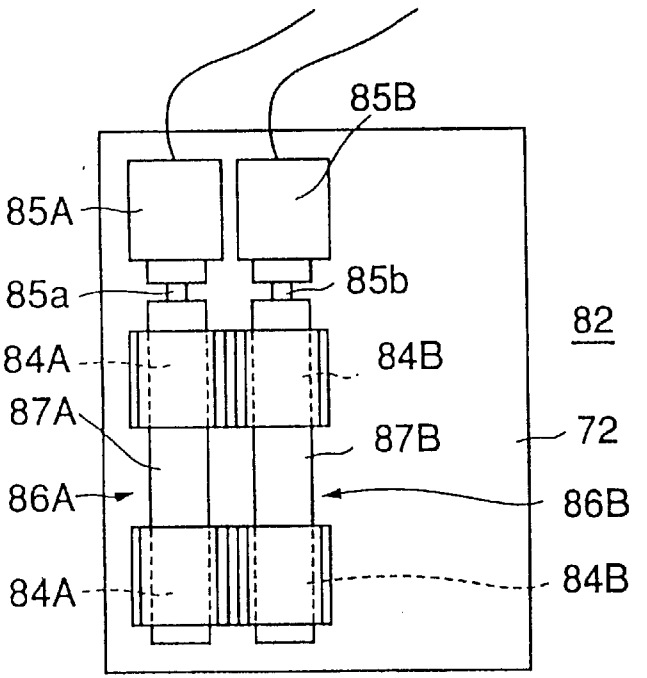
FIG. 18A is a plan view of a first modification of the magnetic circuit.
Figure 18B:
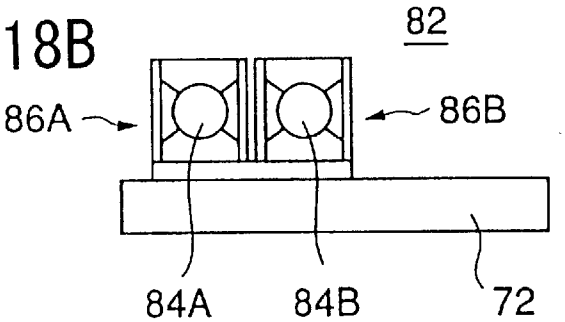
FIG. 18B is a front view of the first modification of the magnetic circuit.
Figure 18C:
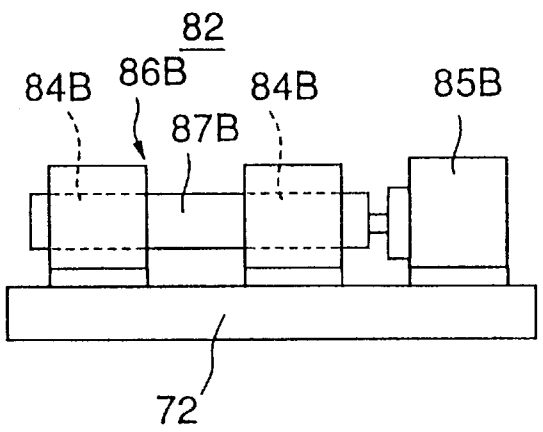
FIG. 18C is a side view of the first modification of the magnetic circuit.

FIG. 18A is a plan view showing a magnetic circuit of the first modification. FIG. 18B is a front view showing the magnetic circuit of the first modification. FIG. 18C is a side view showing the magnetic circuit of the first modification.

As shown in FIGS. 18A to 18C, the magnetic circuit 82 of the first modification comprises a pair of magnet units 86A and 86B that hold permanent magnets 84A and 84B supported on the base 72. Each of the magnet units 86A and 86B is provided with a pair of permanent magnets 84A and 84B facing the iron chips 70*a* to 70*c* and the iron chips 70*d* to 70*f*, respectively.

The magnetic units 86A and 86B are joined to driving axes 85*a* and 85*b* of stepping motors 85A and 85B that rotate the permanent magnets 84A and 84B around the axis. The permanent magnets 84A and 84B are inserted into the pair of magnet units 86A and 86B, which are connected by coupling rods 87A and 87B that are made of non-magnetic material.

The stepping motors 85A and 85B are connected to the control circuit 22. The stepping motors 85A and 85B rotate the permanent magnets 84A and 84B in accordance with control signals supplied from the control circuit 22, thereby switching on and off the magnetic force of the magnet units 86A and 86B.

Figure 19:
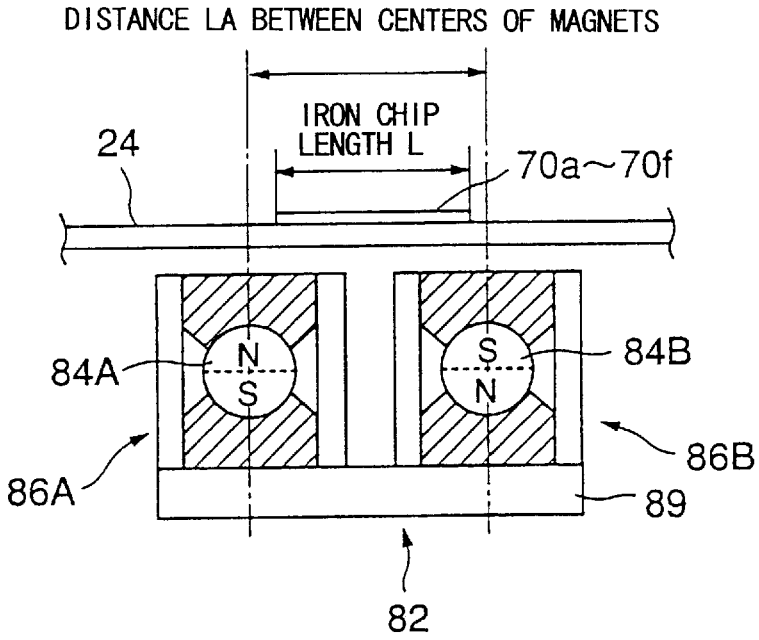
FIG. 19 is a front view showing the structure of a magnetic circuit 82 of the first modification.

FIG. 19 is a front view showing the structure of the magnetic circuit 82 of the first modification.

As shown in FIG. 19, in the magnetic circuit 82, the distance La between the permanent magnets 84A and 84B is longer than the entire length L of the iron chips 70 (70*a* to 70*f*). Both ends of each of the iron chips 70 (70*a* to 70*f*) are located in such a position as to face a pair of yokes 88 that rotatably supports the permanent magnets 84A and 84B in the vertical direction via the card placement unit 24. Accordingly, the card 12 can be attracted to magnetic force and reverse itself, even if the iron chips 70 (70*a* to 70*f*) slightly deviate with respect to the permanent magnets 84A and 84B.l.

Figure 20:
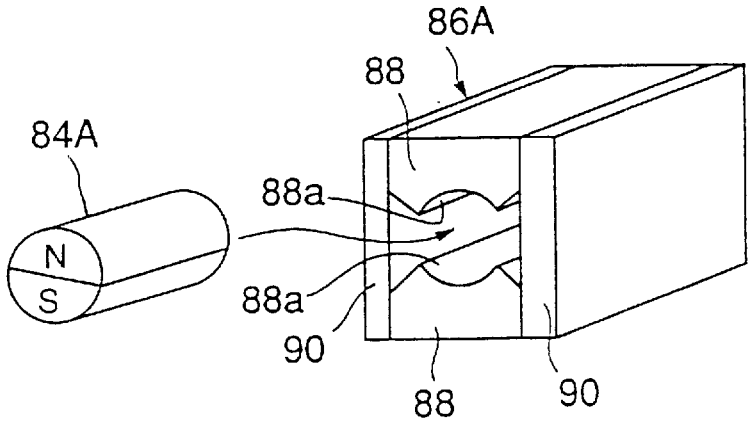
FIG. 20 is an exploded perspective view showing the structure of a magnetic unit 86A.

FIG. 20 is an exploded perspective view showing the structure of the magnet unit 86A.

As shown in FIG. 20, the permanent magnet 84A is in the form of a round bar. One semicircular half serves as an N pole, while the other semicircular half serves as an S pole. In other words, the permanent magnet 84A is a cylindrical magnet made up of the semicircular N-pole rod and the semicircular S-pole rod, which are attached to each other.

The magnetic unit 86A comprises the permanent magnet 84A, the pair of yokes 88, a pair of non-magnetic members 90, and a yoke 89 on which the lower end portions of the non-magnetic members 90 and the lower yoke 88 are placed. The pair of yokes 88 rotatably support the cylindrical permanent magnet 84A, and therefore have a bearing 88*a* in an arcuate shape corresponding to the outer diameter of the permanent magnet 84A.

Since the magnet unit 86B has the same structure as the magnet unit 86A, the explanation for the magnet unit 86B is omitted in this specification.

Figure 21A:
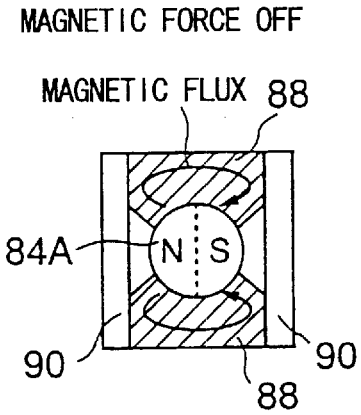
FIG. 21A shows the magnetic flux when the magnetic force of a permanent magnet 84A is off.
Figure 21B:
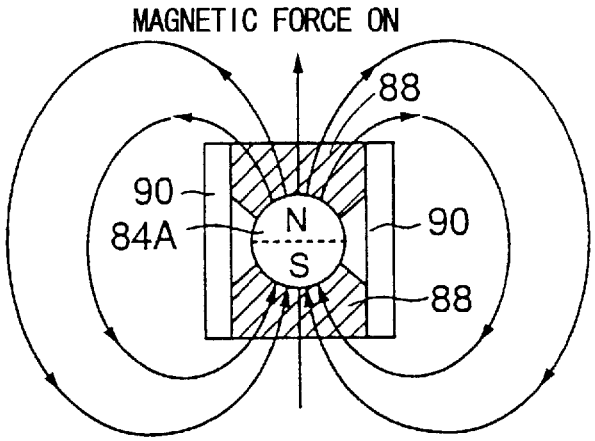

FIG. 21A is a front view showing a situation in which the magnetic force of the permanent magnet 84A is off. FIG. 21B is a front view showing a situation in which the magnetic force of the permanent magnet 84A is on.

As shown in FIG. 21A, if the boundary between the N pole and the S pole is located at the center of the bearing 88*a* of the pair of yokes 88 in the permanent magnet 84A of the magnet unit 86A, the magnetic flux generated from the N pole passes through the yokes 88 and enters the S pole. As a result, no magnetic force appears outside the yokes 88. Accordingly, in the magnet unit 86A, the magnetic force of the permanent magnet 84A is off.

As shown in FIG. 21B, if the permanent magnet 84A of the magnet unit 86A rotates through 90 degrees in the axis direction in the condition shown in FIG. 21A, the N pole is brought into contact only with the upper yoke 88, and the S pole is brought into contact only with the lower yoke 88. As a result, the magnetic flux generated from the N pole of the permanent magnet 84A passes through the upper yoke 88 and then enters the S pole via the lower yoke 88. Thus, the magnetic force appears outside the yokes 88.

In the above manner, the magnetic force of the permanent magnet 84A is on in the magnet unit 86A.

Figure 22:
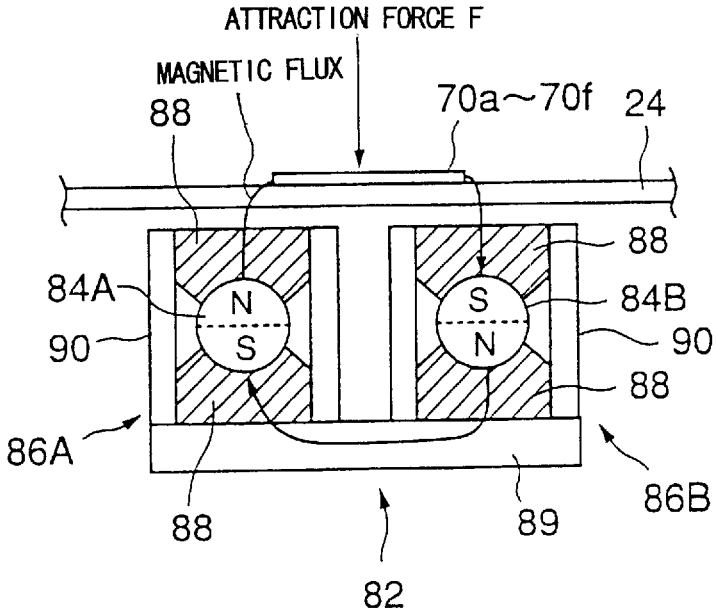
FIG. 22 is a front view showing an operation condition of the magnetic circuit 82 when the card 12 is transported.

FIG. 22 is a front view of the magnetic circuit 22 in an operation of transporting the card 12.

As shown in FIG. 22, when the card 12 is transported, the permanent magnets 84A and 84B of the magnetic units 86A and 86B are both on and rotated, and each N pole is located at 180 degrees with respect to each corresponding S pole. Accordingly, the magnetic flux generated from the N pole of the permanent magnet 84A of the magnet unit 86A passes through the upper yoke 88 and the iron chips 70 (70*a* to 70*f*) in the card 12 placed on the card placement unit 24, and then enters the S pole of the permanent magnet 84B via the upper yoke 88 of the adjacent magnet unit 86B.

Meanwhile, the magnetic flux generated from the N pole of the permanent magnet 84B of the magnet unit 86B passes through the lower yoke 88 and the yoke 89, which serves as a base. The magnetic flux then enters the S pole of the permanent magnet 84A via the lower yoke 88 of the adjacent magnet unit 86A.

Accordingly, the iron chips 70 (70*a* to 70*f*) in the card 12 are pulled downward by the magnetic forces of the permanent magnets 84A and 84B. With the card 12 being pulled downward, the slider 36 that supports the magnetic circuit 82 moves in the X direction or the Y direction along the X-direction guide rails 34 or the Y-direction guide rails 38 of the card transportation mechanism 20 (shown in FIGS. 2 to 4), so that the card 12 slides on the upper surface of the card placement unit 24, following the movement of the slider 36 and the magnetic circuit 82.

Next, the card reversing operation of the first modification will be described.

Figure 23A:
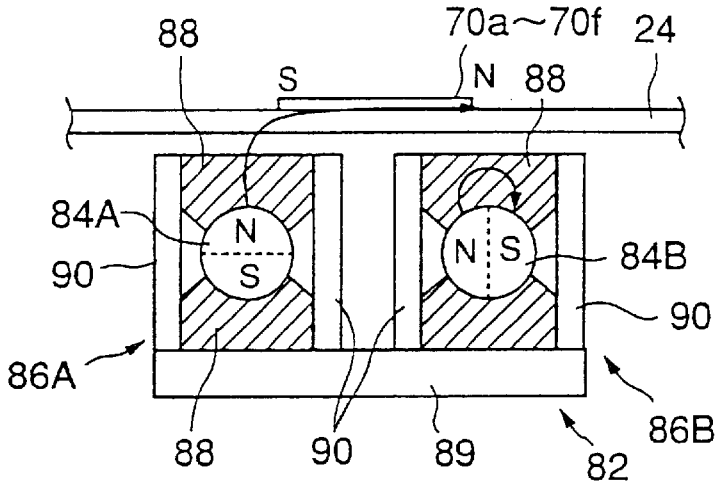
FIG. 23A is a front view showing a situation in which the magnetic force of a right-side permanent magnet 84B of the first modification is off.
Figure 23B:
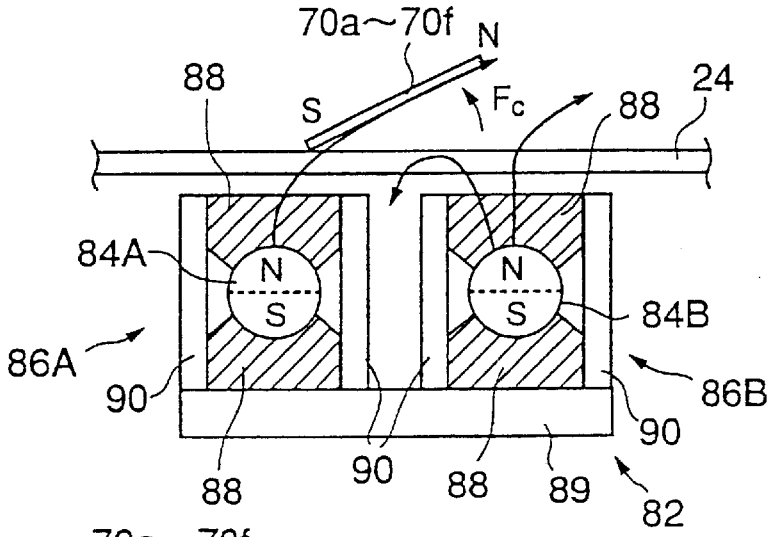
Figure 23C:
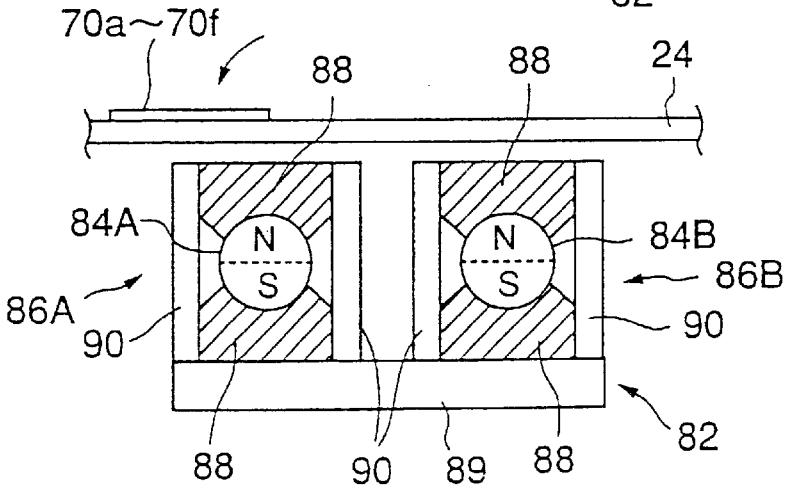
FIG. 23C is a front view showing a situation in which the card reversed by a change in the magnetic force of the permanent magnets 84A and 84B of the first modification.

FIG. 23A is a front view of the structure prior to the card reversing operation. FIG. 23B is a front view of the structure during the card reversing operation. FIG. 23C is a front view of the structure after the card reversing operation.

When the card 12 placed on the card placement unit 24 is reversed, the control circuit 22 drives and controls the steeping motors 85A and 85B, as shown in FIG. 23A, so as to rotate the permanent magnets 84A and 84B independently of each other and to switch on and off the magnetic forces of the permanent magnets 84A and 84B.

As shown in FIG. 23A, when the card 12 placed on the card placement unit 24 is reversed to the left side, the permanent magnet 84B located on the side in the above transportation state is rotated through 90 degrees. By doing so, the magnetic force of the permanent magnet 84B is switched off while the magnetic force of the left-side permanent magnet 84A remains on.

Accordingly, the magnetic flux generated from the permanent magnet 84A passes through the iron chips 70 (70*a* to 70*f*) in the card 12 placed on the card placement unit 24. Thus, the left-side end portions of the iron chips 70 (70*a* to 70*f*) become an S pole, while the right-side end portions become an N pole.

As shown in FIG. 23B, the right-side permanent magnet 84B is further rotated through 90 degrees. By doing so, the magnetic force of the right-side permanent magnet 84B is switched on, while the magnetic force of the left-side permanent magnet 84A remains on. In this case, the permanent magnets 84A and 84B have the same polarity. More specifically, the upper half of each of the permanent magnets 84A and 84B serves as an N pole, while the lower half serves as an S pole.

As a result, due to the magnetic flux generated from the right-side permanent magnet 84B, the right-side end portions of the iron chips 70 (70*a* to 70*f*) that serve as the N pole receive the repulsive force Fc and floats away from the card placement unit 24. At this point, the card 12 rotates in the counterclockwise about the left-side end portions of the iron chips 70 (70*a* to 70*f*).

As shown in FIG. 23C, the card 12 reverses with the iron chips 70 (70*a* to 70*f*) due to the repulsive force Fc. Accordingly, when the right-side permanent magnet 84B is quickly rotated, the card 12 receives a larger repulsive force Fc and quickly reverses itself.

If the right-side permanent magnet 84B is slowly rotated, the repulsive force Fc becomes gradually larger, so that the and 12 can be slowly reversed. If the permanent magnet 84B is stopped in the middle of the rotating operation, the card 12 can be inclined and held in a balanced state with the repulsive force Fc.

In this manner, the rotational positions of the permanent magnets 84A and 84B are controlled so that the card 12 appears as if to reverse itself. Thus, each player can enjoy the card game while marveling at the reversing operation of the card 12.

Although the card 12 is reversed to the left side in the above description, it is also possible to reverse the card 12 to the right side by simply performing the rotating operation of the permanent magnets 84A and 84B in the reversed order.

Next, a second modification of the present invention will be described.

Figure 24:
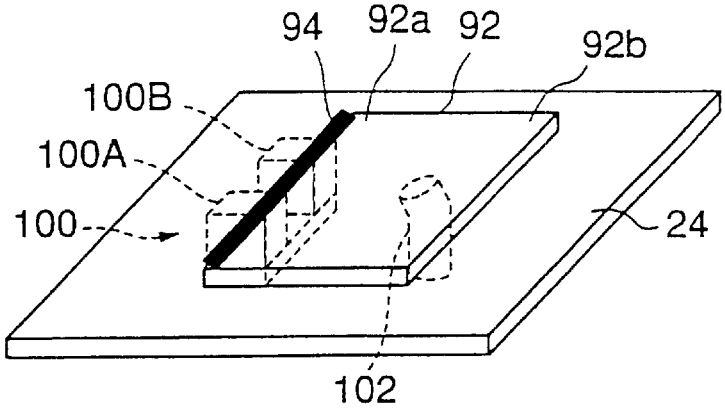
FIG. 24 is a perspective view illustrating the structure of a second modification.
Figure 25:
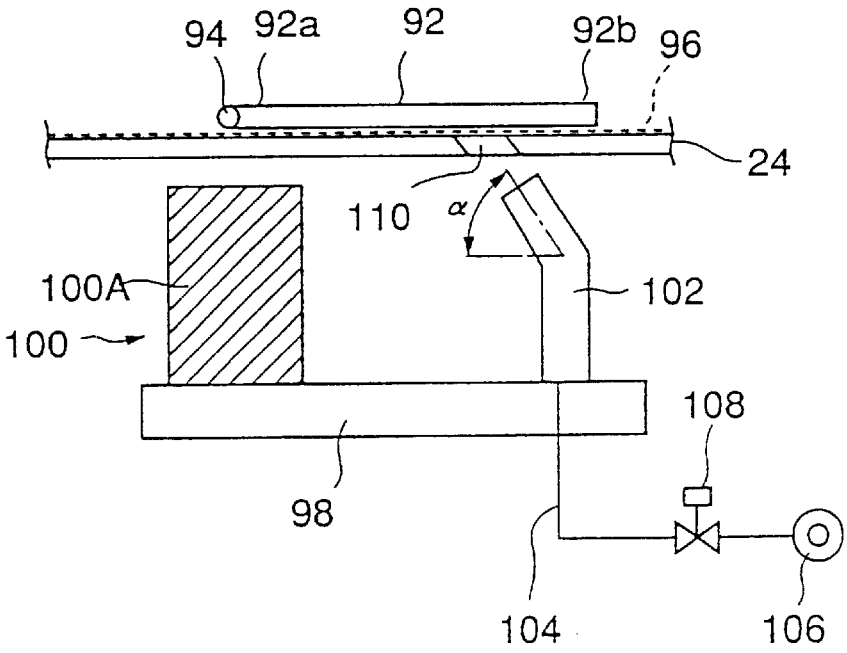
FIG. 25 is a front view of the second modification.

FIG. 24 is a perspective view of the structure of the second modification. FIG. 25 is a front view of the second modification.

As shown in FIGS. 24 and 25, a card 92 placed on the upper surface of the card placement unit 24 is formed from a synthetic resin material, and a wire-like magnetic member 94 is incorporated into a long-side end portion 92*a* of the card 92. The upper surface of the card placement unit 24 is covered with a cloth 96. The cloth 96 is formed like a net through which the air discharged from an air discharging outlet 110 pass, and hides the air discharging outlet 110 formed in the card placement unit 24 from each player.

Below the card placement unit 24, a base 98 supported by the slider 36, a magnet unit 100 placed on the base 98, and an air nozzle 102 that reverses the card are arranged. While supported by the base 98, the magnet unit 100 and the air nozzle 102 can move in the horizontal direction (the X and Y directions), and also rotate on in the θ direction on the slider 36.

The magnet unit 100 comprises a pair of magnets 100A and 100B. The pair of magnets 100A and 100B are arranged, with a distance corresponding to the length of the magnetic member 94 buried in the card 92 being maintained between the magnets 100A and 100B. The pair of magnets 100A and 100B are electromagnets or permanent magnets. If the magnet 100A is an N pole, the magnet 100B is an S pole.

Accordingly, the magnetic member 94 at the long-side end portion 92 of the card 92 placed on the card placement unit 24 is as drawn to the magnets 100A and 100B.

The air nozzle 102 vertically stands from the base 98, and the top end portion inclines at a predetermined angle θ, which corresponds to the air discharging outlet 110 formed in the card placement unit 24. In this structure, the air can be blown at such an angle as to facilitate the reversal of the card 92. The top end opening of the air nozzle 102 is located in such a position that the air can be blown to the vicinity of a long-side end portion 92*b* that is located at the opposite side from the long-side end portion 92*a* containing the magnetic member 94 of the card 92.

The lower end of the air nozzle 102 is connected to an air supplier 106 via a flexible tube 104. The flexible tube 104 is provided with an electromagnetic valve 108. When the electromagnetic valve 108 is opened in compliance with an instruction from the control circuit 2, the air supplier 106 supplies compressed air to the air nozzle 102.

The air supplier 106 is a compressor or an air bomb or the like, which can steadily supply air at a predetermined pressure.

Next, a card reversing operation of the second modification will be described.

Figure 26:
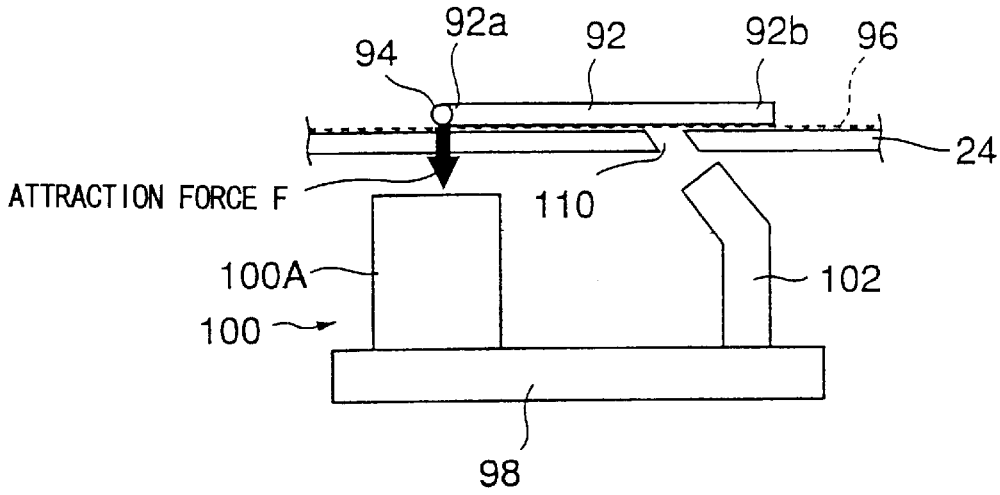
FIG. 26 is a front view showing a situation prior to card reversal in the second modification.
Figure 27:
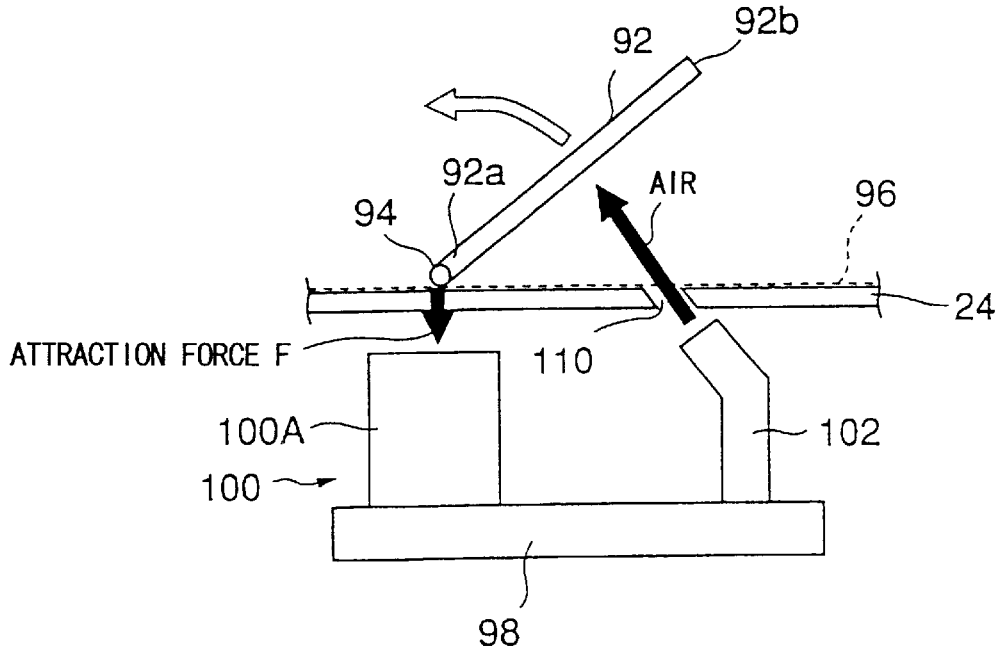
FIG. 27 is a front view showing a situation at the start of card reversal in the second modification.

FIG. 26 is a front view of the structure of the second modification prior to the card reversing operation. FIG. 27 is a front view of the structure of the second modification at the start of the card reversing operation.

As shown in FIG. 26, the card 92 is placed at such a location that the magnetic member 94 is attracted to the magnets 100A and 100B, and that the card 92 faces the air discharging outlet 110. The top end opening of the air nozzle 102 faces the air discharging outlet 110 formed in the card placement unit 24, and the air discharging outlet 110 is inclined at substantially the same angle as the inclination angle a of the top end opening of the air nozzle 102.

As shown in FIG. 27, when the electromagnetic valve 108 is opened, the compressed air jetted through the top end opening of the air nozzle 102 passes through the air discharging outlet 110 and is blown to the vicinity of the other end portion 92*b* of the card 92. As a result, the compressed air that has passed through the air discharging outlet 110 and the cloth 96 is supplied to the gap between the lower surface of the card 92 and the card placement unit 24, thereby lifting up the long-side end portion 92*b* of the card 92.

At this point, the long-side end portion 92*a* containing the magnetic member 94 is drawn to the magnets 100A and 100B, and remains in contact with the card placement unit 24. Accordingly, the other long-side end portion 92*b* of the card 92 rotates counterclockwise about the long-side end portion 92*a*. Thus, the card 92 is reversed. In this manner, in accordance with the second modification, the air jetted through the air nozzle 102 reverses the card 92, with no actual contact being made with the card 92.

As in the foregoing embodiment, the card 92 appears as if it spontaneously reversed itself. Accordingly, each player can enjoy the card game while marveling at the reverse operation of the card 92.

Next, a modification of the card will be described.

Figure 28A:
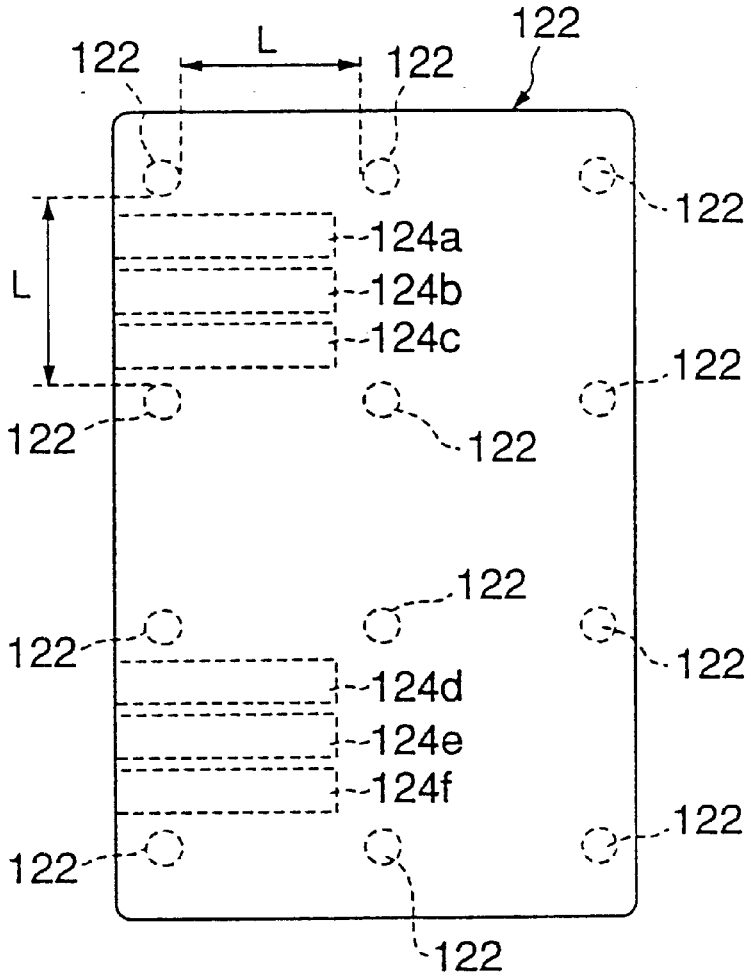
FIG. 28A illustrates a modification of the card.
Figure 28B:
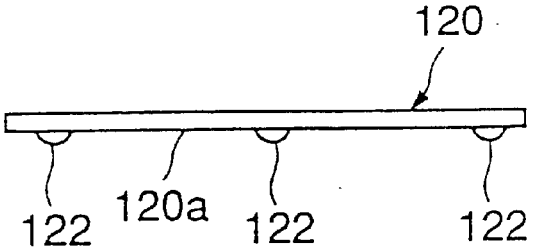
FIG. 28B is a front view of the modification of the card.

FIG. 28A is a plan view of the modification of the card. FIG. 28B is a side view of the modification of the card.

As shown in FIGS. 28A and 28B, a card 120 has a plurality of protrusions 122 that protrude by a very small height (0.1 mm, for instance) from a lower surface 120*a*, which is the face of the card 120. Each of the protrusions 122 is formed in a semi-spherical shape by embossing finish, and the protrusions 122 are arranged at predetermined intervals L in a matrix state.

Since the lower surface 120*a* of the card 120 is provided with the protrusions 122, only the top end portions of the protrusions 122 are slidably in contact with the card placement unit 24. Thus, the friction between the card 120 and the card placement unit 24 of the table 14 is reduced, and the card placement unit 24 can be more smoothly moved.

Also, like the card 12 described in the foregoing embodiment, the card 120 is made of a nonmagnetic synthetic resin material, and contains six iron chips 124 (124*a* to 124*f*) on a long side. Each of the iron chips 124 (124*a* to 124*f*) is a magnetic material, such as soft iron, which is difficult to magnetize, in the form of a plate that is thinner than the card 120. The iron chips 124 (124*a* to 124*f*) are arranged in parallel with each other, and extend in the short-side direction (the X direction) perpendicular to the longitudinal direction of the card 120. Each of the iron chips 124 (124*a* to 124*f*) is insert-molded so as to extend from one long side of the card 120 in the short-side direction (the X direction), and buried in the card 120 so as to be hidden from the outside.

The three iron chips 124*a* to 124*c* are arranged in parallel with each other at predetermined intervals at the left-side upper portion of the card 120, while the other three iron chips 124*d* to 124*f* are arranged in parallel with each other at predetermined intervals at the left-side lower portion of the card 120.

Accordingly, since each of the iron chips 124 (124*a* to 124*f*) is drawn by the magnetic force generated from the magnetic circuit 26, when the magnetic circuit 26 is moved in the X or Y direction by the card transportation mechanism 20, the card 120 moves with the protrusions 122 sliding on the card placement unit 24. In this manner, the friction between the card placement unit 24 and the card 120 is reduced, and the load on the card transportation mechanism 20 and the magnetic circuit 26 is reduced, accordingly.

Since the iron chips 124 (124*a* to 124*f*) are buried in the card 120, a change in the magnetic force of the electromagnet units 30A to 30C provided for the magnetic circuit 26 reverses the card 120.

The card 120 may have concavities and convexities on the entire surface, instead of the protrusions 122 formed on the lower surface 120*a*, so as to reduce the friction with the card placement unit 24.

Next, a modification of the magnetic circuit 26 will be described.

Figure 29:
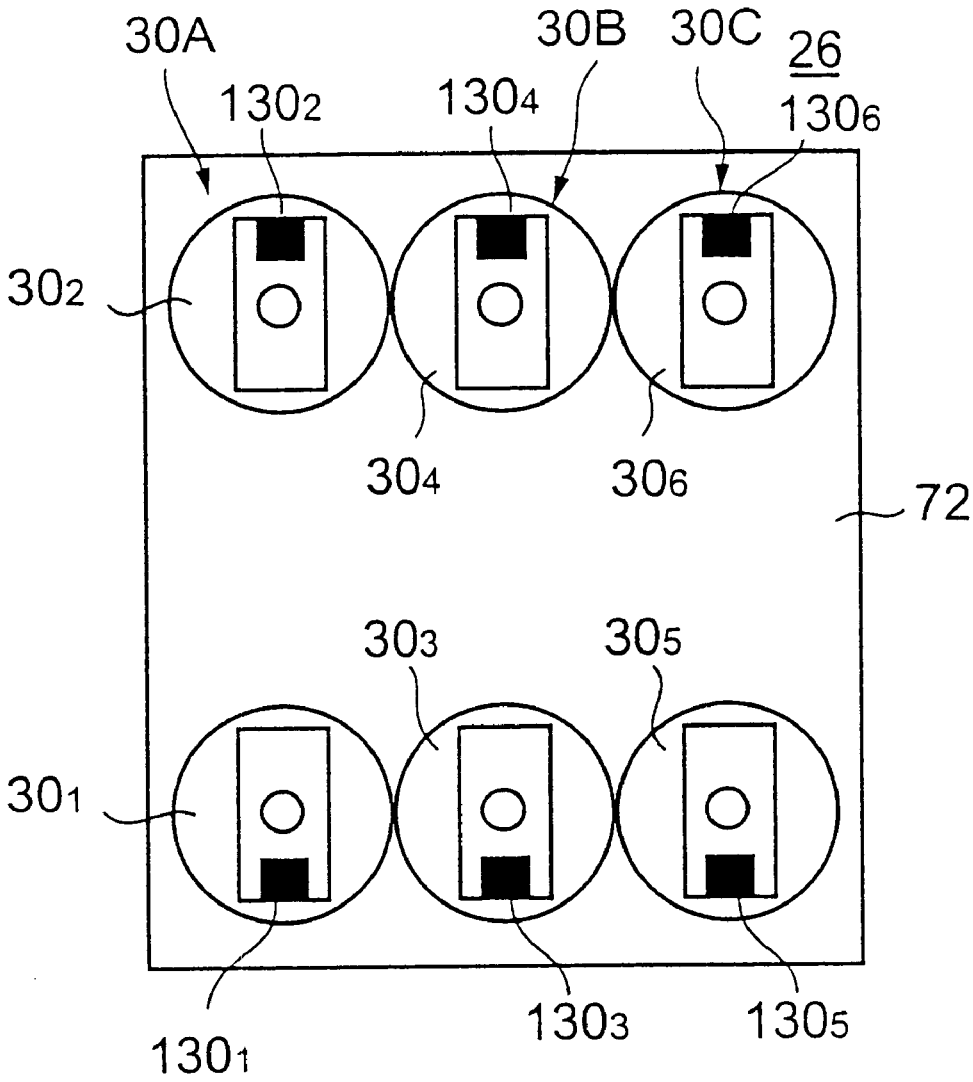
FIG. 29 is a plan view of a modification of the magnetic circuit 26.

FIG. 29 is a plan view of the modification of the magnetic circuit 26.

As shown in FIG. 29, magnetic sensors $\mathbf{130}_1$ to $\mathbf{130}_6$ for detecting magnetic field intensities are arranged at the upper end portions of the electromagnets $\mathbf{30}_1$ to $\mathbf{30}_6$, respectively, of the magnetic circuit 26. Each of the magnetic sensors $\mathbf{130}_1$ to $\mathbf{130}_6$ is formed by a Hall element that outputs a signal in accordance with the intensity of each magnetic field, or a magnetoresistance effect device, for instance. Since the magnetic sensors $\mathbf{130}_1$ to $\mathbf{130}_6$ are placed at the upper end portions of the electromagnets $\mathbf{30}_1$ to $\mathbf{30}_6$ so as to be near the lower surface of the table 14, when the card 12 is located above the electromagnets $\mathbf{30}_1$ to $\mathbf{30}_6$, the magnetic flux generated from the electromagnets $\mathbf{30}_1$ to $\mathbf{30}_6$ passes through the iron chips 70 (70*a* to 70*f*) buried in the card 12. Accordingly, the magnetic flux passing through the magnetic sensors $\mathbf{130}_1$ to $\mathbf{130}_6$ is reduced, and each detection signal (voltage) outputted from the magnetic sensors $\mathbf{130}_1$ to $\mathbf{130}_6$ changes. Thus, the condition of the card 12, such as the existence of the card 12 or the orientation of the card 12, can be judged from a change of each detection signal outputted from the magnetic sensors $\mathbf{130}_1$ to $\mathbf{130}_6$.

Figure 30:
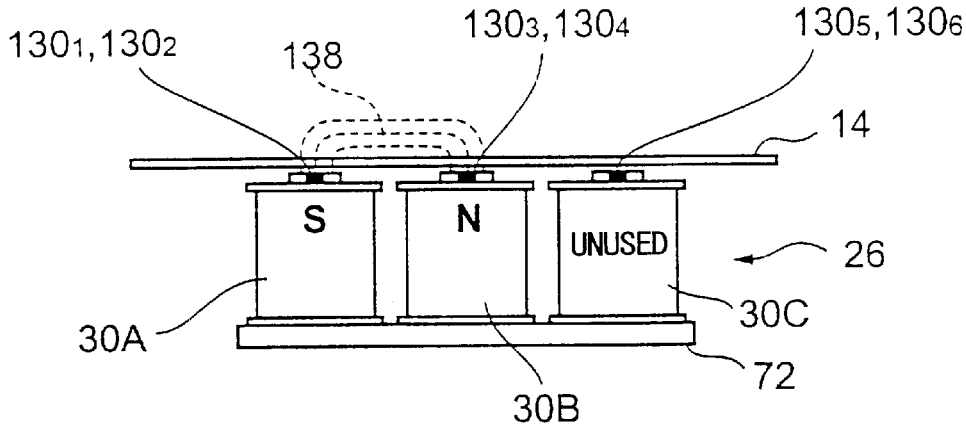
FIG. 30 is a side view illustrating the functions of magnetic sensors $\mathbf{130}_1$ to $\mathbf{130}_6$ in a case where no card 12 is placed above the magnetic circuit 26.

FIG. 30 is a side view of the structure showing the functions of the magnetic sensors $\mathbf{130}_1$ to $\mathbf{130}_6$ when the card 12 does not exist above the magnetic circuit 26.

As shown in FIG. 30, when the card 12 placed on the table 14 is transported, the electromagnet units 30A and 30B in the magnetic circuit 26 are excited. In such a case, the upper end of the electromagnet unit 30B becomes an N pole, while the upper end of the electromagnet unit 30A becomes an S pole. As a result, the magnetic flux 138 (indicated by the broken line in FIG. 30) between the electromagnet units 30A and 30B is formed on the table 14.

Accordingly, when the card 12 does not exist, the magnetic sensors $\mathbf{130}_1$ to $\mathbf{130}_6$ located at the upper end portions of the electromagnets $\mathbf{30}_1$ to $\mathbf{30}_6$ detect the magnetic flux 138 generated from the electromagnets $\mathbf{30}_1$ to $\mathbf{30}_6$. When the card 12 is not located on the table 14, the magnetic flux 138 between the electromagnet units 30A and 30B is dispersed in the air. As a result, the amount of magnetic flux detected by the magnetic sensors $\mathbf{130}_1$ to $\mathbf{130}_6$ is reduced.

Here, the output level of each detection signal outputted from the magnetic sensors $\mathbf{130}_1$ to $\mathbf{130}_6$ serves as the reference value for judging the condition of the card 12.

Figure 31:
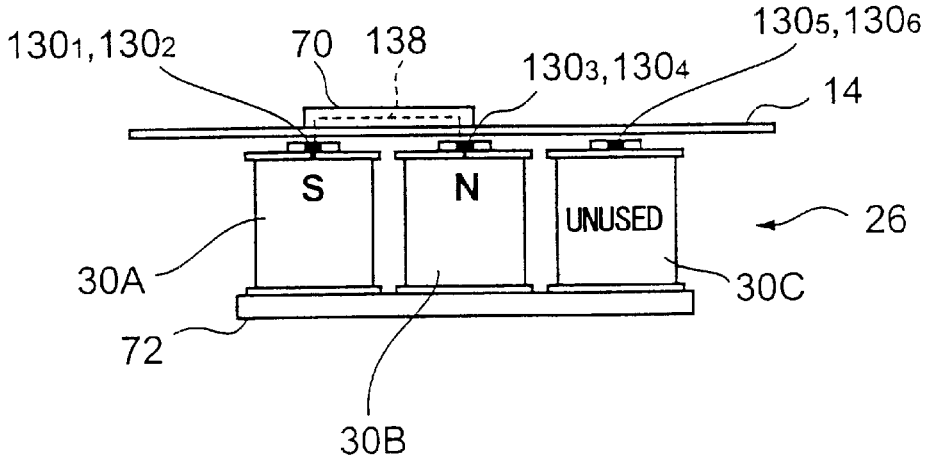
FIG. 31 is a side view illustrating the functions of the magnetic sensors $\mathbf{130}_1$ to $\mathbf{130}_6$ in a case where the card 12 is placed above the magnetic circuit 26.

FIG. 31 is a side view of the structure illustrating the functions of the magnetic sensors $\mathbf{130}_1$ to $\mathbf{130}_6$ when the card 12 is located above the magnetic circuit 26.

As shown in FIG. 31, when the card 12 is placed on the table 14, the iron chips 70 (70*a* to 70*f*) buried in the card 12 are located above the electromagnet units 30A and 30B of the magnetic circuit 26. In this case, the magnetic flux 138 of the electromagnet units 30A and 30B passes through the iron chips 70 (70*a* to 70*f*), and concentrates onto the region in which the magnetic sensors $\mathbf{130}_1$ to $\mathbf{130}_4$ are located. Because of this, the amount of magnetic flux detected by the magnetic sensors $\mathbf{130}_1$ to $\mathbf{130}_4$ is larger than the magnetic flux detected when the card 12 does not exist.

Accordingly, even when the card 12 is not placed on the table 14, as long as the values read from the magnetic sensors $\mathbf{130}_1$ to $\mathbf{130}_4$ are larger than each reference value that is the output level of each detection signal outputted from the magnetic sensors $\mathbf{130}_1$ to $\mathbf{130}_4$, it can be determined that the card 12 is located on the table 14.

In practice, the values read from the magnetic sensors $\mathbf{130}_1$ to $\mathbf{130}_4$ vary with noise, and the card 12 is determined to be located on the table 14 when the variation is larger than the reference value by a predetermined amount.

The electromagnets $\mathbf{30}_1$ to $\mathbf{30}_6$ are excited for a while so as to reduce the current by heat generation and also reduce the amount of magnetic flux generated accordingly. Therefore, it is necessary to adjust each reference value at suitable time intervals, and it is desirable to set each reference value every time immediately before the existence of the card 12 is checked.

Figure 32:
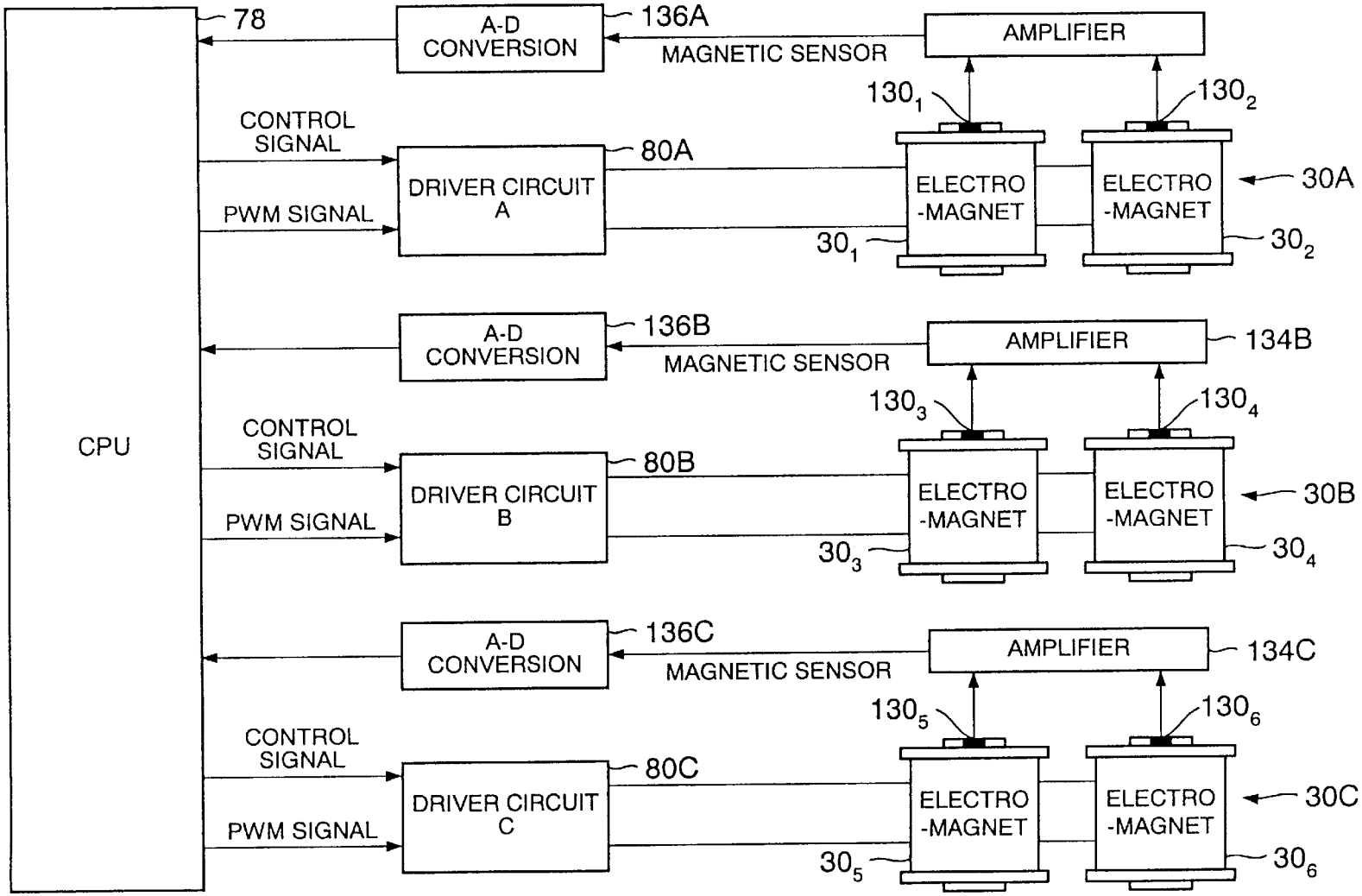
FIG. 32 is a block diagram illustrating a control circuit 122 that controls the electromagnets $\mathbf{30}_1$to $\mathbf{30}_6$ and the magnetic sensors $\mathbf{130}_1$ to $\mathbf{130}_6$.

FIG. 32 is a block diagram showing a control circuit 132 that controls the electromagnets $\mathbf{30}_1$ to $\mathbf{30}_6$ and the magnetic sensors $\mathbf{130}_1$ to $\mathbf{130}_6$.

As shown in FIG. 32, the control circuit 132 comprises the CPU 78 that controls the magnetic circuit 26, the driver circuits 80A to 80C that receive control signals and PWM (Pulse Width Modulation) signals to control the electromagnets $\mathbf{30}_1$ to $\mathbf{30}_6$ by the electromagnet units 30A to 30C, amplifiers 134A to 134C that amplify detection signals outputted from the magnetic sensors $\mathbf{130}_1$ to $\mathbf{130}_6$ by the electromagnet units 30A to 30C, and A/D (analog-digital) converters 136A to 136C that convert the detection signals amplified by the amplifiers 134A to 134C into digital signals.

The CPU 78 controls the intensities of the magnetic forces of the electromagnets $\mathbf{30}_1$ to $\mathbf{30}_6$ based on the detection signals outputted form the magnetic sensors $\mathbf{130}_1$ to $\mathbf{130}_6$, thereby adjusting the orientation of the card 12 in a transported state. The CPU 78 also controls the moving speed of the slider 36 on which the magnetic circuit 26 is mounted so as not to leave the card 12, which is drawn to the magnetic circuit 26, on the table 14 due to the friction with the table 14.

In the following, a method of judging the condition of the card 12 to be transported on the table based on the detection signals outputted from the magnetic sensors $\mathbf{130}_1$ to $\mathbf{130}_6$ will be described.

Figure 33:
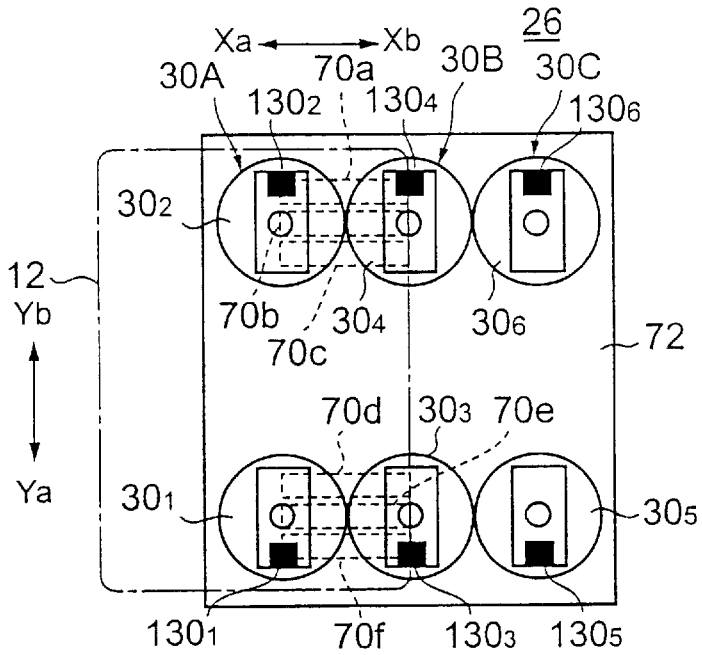
FIG. 33 is a plan view showing a situation in which the card 12 is placed above the magnetic circuit 26.

FIG. 33 is a plan view showing the condition of the card 12 located above the magnetic circuit 26.

First, before the card 12 is placed on the table 14, the electromagnets $\mathbf{30}_1$ to $\mathbf{30}_6$ are excited, with the magnetic circuit 26 having not moved yet and the card 12 not being located above the magnetic circuit. The level of each detection signal outputted from the magnetic sensors $\mathbf{130}_1$ to $\mathbf{130}_6$ is detected. Here, the detected value of each of the magnetic sensors $130_1$ to $130_6$ is used as the reference value when the card 12 does not exist.

Meanwhile, as shown in FIG. 33, the card 12 (indicated by the dot-and-dash line in FIG. 33) is located on the table 14, and the iron chip 70*a* (indicated by a broken line in FIG. 33) in the card 12 is placed as if to bridge the electromagnets $30_2$ and $30_4$ while iron chip 70*f* (indicated by a broken line in FIG. 33) in the card 12 is placed as if to bridge the electromagnets $30_1$ and $30_3$, the detected value of each of the magnetic sensors $130_1$ to $130_4$, which face the iron chips 70*a* and 70*f* in the card 12, is larger than each reference value. Accordingly, in the CPU 78, if the detected value of each of the magnetic sensors $130_1$ to $130_4$ is larger than the reference value, the card 12 is judged to be drawn to the magnetic circuit 26.

Figure 34:
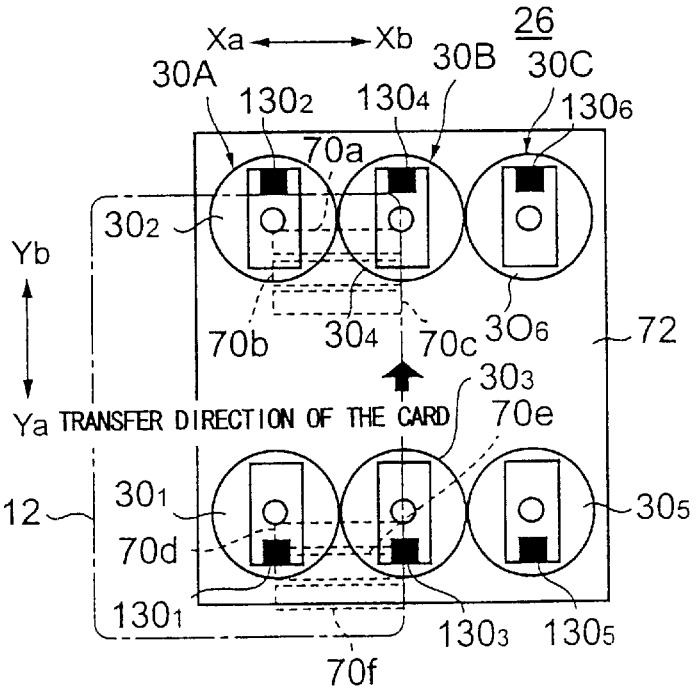
FIG. 34 is a plan view showing a situation in which the magnetic circuit 26 moves.

FIG. 34 is a plan view showing the condition of the card 12 when the magnetic circuit 26 is moving.

As shown in FIG. 34, when the magnetic circuit 26 mounted on the slider 36 moves in the transportation direction (the Yb direction) indicated by the arrow, the card 12 is drawn to the magnetic circuit 26 and moves in the transportation direction (the Yb direction). The movement of the card 12 lags slightly behind the movement of the magnetic circuit 26, due to the friction between the card 12 and the table 14. The iron chips 70*a* to 70*c* arranged on the side of the transportation direction (the Yb direction) separate from the magnetic sensors $130_2$ and $130_4$, and the iron chip 70*d* or 70*e* located on the opposite side of the transportation direction (the Ya direction) comes to face the magnetic sensors $130_1$ and $130_3$.

When the magnetic circuit 26 and the card 12 deviate relatively from each other as described above, the level of each detection signal from the magnetic sensors $130_2$ and $130_4$ becomes equal to the reference value, and the level of each detection signal from the magnetic sensors $130_1$ and $130_3$ becomes larger than the reference value. In such a case, the CPU 78 determines that the card 12 is located within the attraction range of the magnetic circuit 26, or that the card 12 slightly deviates from the magnetic circuit 26 in the opposite direction (the Ya direction) from the transportation direction (the Yb direction). Even if the card 12 deviates in some other direction, the deviation of the card 12 can be detected from a difference between the outputs of the magnetic sensors arranged on one side of the card 12 and the magnetic sensors arranged on the other side of the card 12.

Accordingly, by comparing the levels of the detection signals outputted from the magnetic sensors $130_1$ to $130_6$, the CPU 78 can detect the orientation of the deviation of the card 12 with respect to the magnetic circuit 26.

Figure 35:
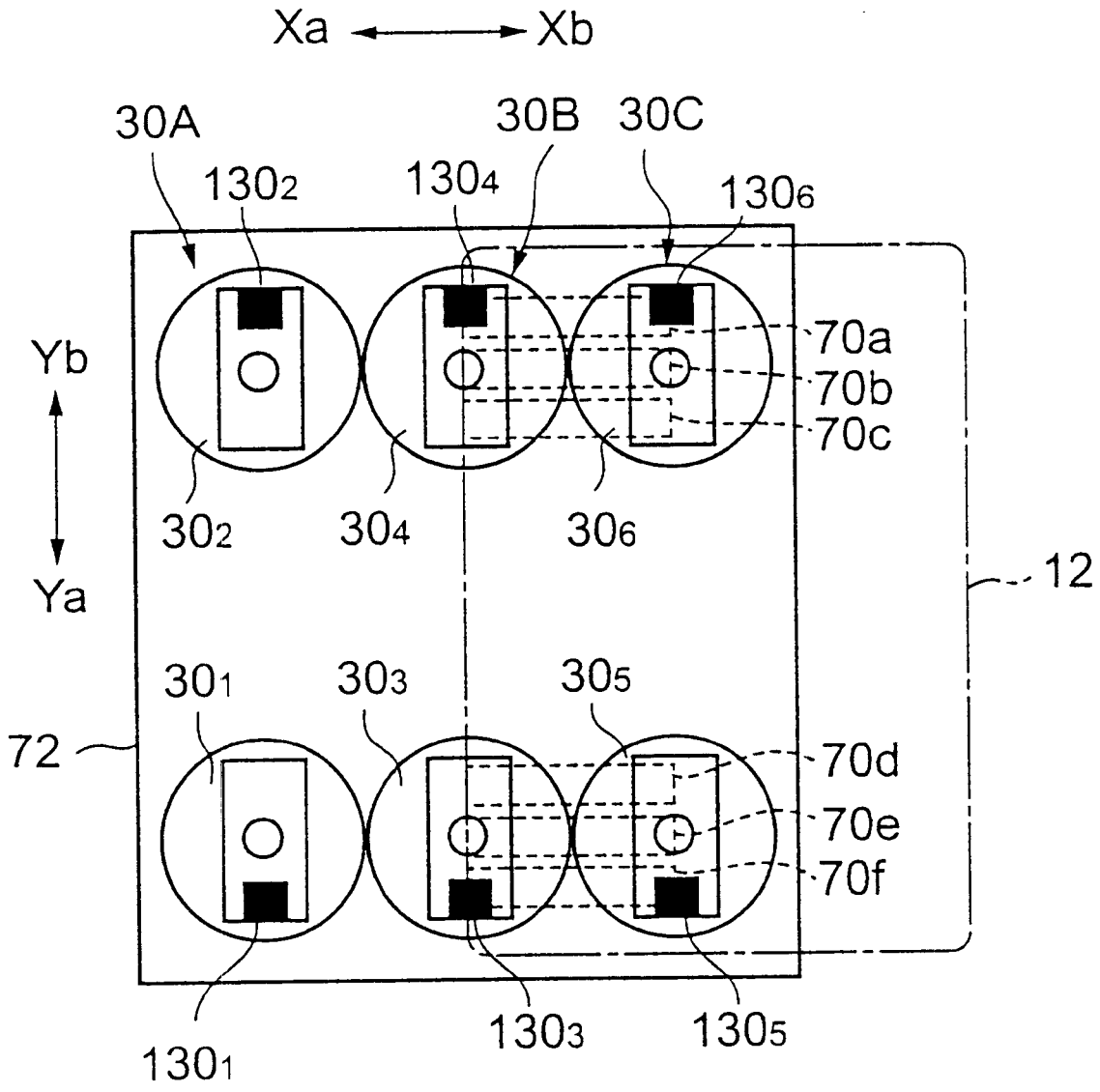
FIG. 35 is a plan view showing a situation in which the card 12 is reversed.

FIG. 35 is a plan view of the structure when the card 12 is reversed.

As shown in FIG. 35, in the magnetic circuit 26, each of the electromagnet units 30A to 30C is excited or demagnetized so as to reverse the card 12, as described above. In such a case, when the reverse surface of the card is turned upward after the card 12 is transported to a player, the card 12 (indicated by the dot-and-dash line in FIG. 35) is reversed in the Xb direction on the table 14. As a result, the iron chip 70*a* (indicated by the broken line in FIG. 35) in the card 12 is placed as if to bridge the electromagnets $30_4$ and $30_6$, while the iron chip 70*f* (indicated by the broken line in FIG. 35) in the card 12 is placed as if to bridge the electromagnets $30_3$ and $30_5$.

Accordingly, the detected value of each of the magnetic sensors $130_3$ to $130_6$ facing the iron chips 70*a* and 70*f* in the card 12 is larger than the reference value. Because of this, the detected value of each of the magnetic sensors $130_1$ and $130_2$ becomes equal to the reference value in the CPU 78. When the detected value of each of the magnetic sensors $130_3$ to $130_6$ is larger than the reference value, it can be determined that the card 12 has been reversed in the Xb direction.

By comparing the levels of the detection signals outputted from the magnetic sensors $130_1$ to $130_6$, the CPU 78 can check in which direction the card 12 has been reversed with respect to the magnetic circuit 26. Also, the CPU 78 can check whether or not the reversing operation of the card 12 has been properly performed.

Next, a control operation performed by the CPU 78 in accordance with the detection signals outputted from the magnetic sensors $130_3$ to $130_6$ will be described.

Figure 36:
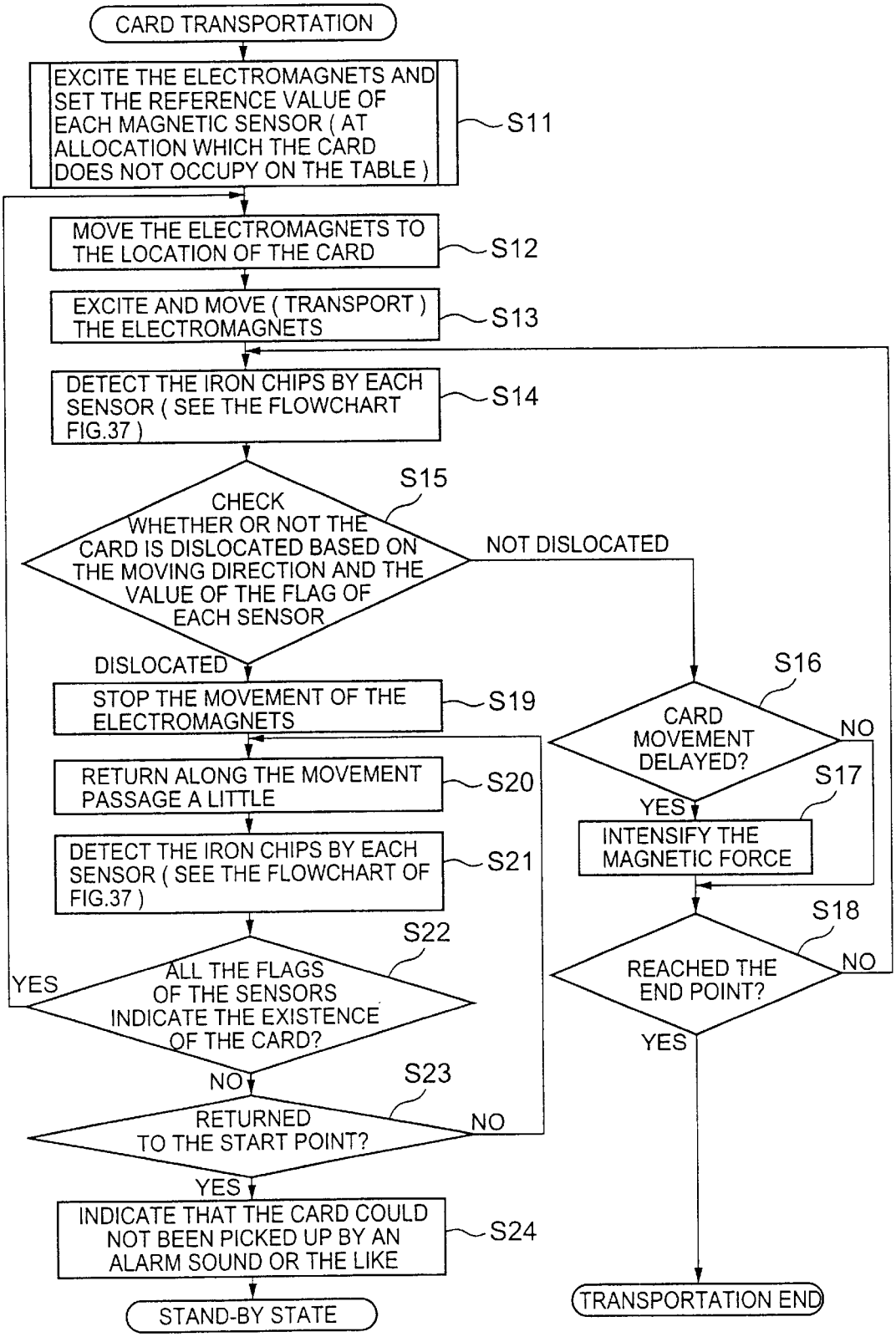
FIG. 36 is a flowchart of a control operation performed by a CPU 78 during a card transporting operation.

FIG. 36 is a flowchart of the control operation performed by the CPU 78 during a card transporting operation.

As shown in FIG. 36, in step S11 (hereinafter, the term "steps" will be omitted), the CPU 78 excites the electromagnets $30_1$ to $30_6$ where the card 12 is not located on the table 14, and reads the detected values of the magnetic sensors $130_1$ to $130_6$. The CPU 78 then stores the reference value of each of the magnetic sensors $130_1$ to $130_6$ in the memory.

In S12, the card transportation mechanism 20 (shown in FIG. 2) is driven to move the slider 36 placed below the table 14, thereby locating the magnetic circuit 26 below the position in which the card 12 is placed.

In S13, the electromagnets facing the iron chips 70*a* to 70*f* in the card 12 among the electromagnets $30_1$ to $30_6$ in the magnetic circuit 26 are excited. By doing so, when the magnetic circuit 26 mounted on the slider 36 passes beneath the card 12, the magnetic circuit 26 attracts the iron chips 70*a* to 70*f* buried in the card 12, and transports the card 12 (see FIG. 33). Accordingly, the card 12 placed on the table 14 is moved in the moving direction of the slider 36, while being attracted to the magnetic circuit 26 (see FIG. 34).

In S14, the detected values of the magnetic sensors $130_1$ to $130_6$ located at the upper end portions of the electromagnets $30_1$ to $30_6$ are read in and compared with the respective reference values of the magnetic sensors $130_1$ to $130_6$, so as to determine whether or not the card 12 (including the iron chips 70*a* to 70*f*) exists. This determination process will be later described, with reference to the flowchart of FIG. 37.

In S15, the moving direction and the existence of a magnetic sensor flag are checked, i.e., the detected values of the magnetic sensors $130_1$ to $130_6$ are compared with the predetermined reference values, thereby checking the transportation condition of the card 12. If the card 12 is properly transported in the moving direction of the slider 36 (see FIG. 33) in S15, the operation moves on to S16. In S16, it is checked whether or not the card 12 is moving in the opposite direction from the moving direction of the slider 36, lagging behind the movement of the slider 36 due to the friction between the card 12 and the table 14.

If it is determined in S16 that the card 12 is moving in the opposite direction from the moving direction of the slider 36, lagging behind the movement of the slider 36 (see FIG. 34), the operation moves on to S17. In S17, the electromagnetic forces of the electromagnets $30_1$ to $30_4$ facing the iron chips 70*a* to 70*f* in the card 12 are intensified. More specifically, in step S17, the driver circuits 80A to 80C perform control operations so as to intensify the magnetic forces of the electromagnet units 30A and 30B in accordance with the control signals and the PWM signals supplied from the CPU 78.

In S18, it is checked whether or not the slider 36 and the card 12 have reached a target point (the end point). If it is determined in S18 that the slider 36 and the card 12 have not reached the target point (the end point), the operation returns to S14, where the detected values of the magnetic sensors $\mathbf{130}_1$ to $\mathbf{130}_6$ are read in again, and the transportation condition of the card 12 is checked.

If it is determined in S16 that the card 12 does not lag behind the movement of the slider 36 (see FIG. 33), the process of S17 is skipped, and the operation moves on to S18 so as to check whether or not the slider 36 and the card 12 have reached the target point (the end point). If it is determined in S18 that the slider 36 and the card 12 have reached the target point (the end point), the movement of the slider 36 is stopped, and the transportation of the card 12 is ended.

However, if it is determined in S15 that the card 12 is left on the table 14 and the slider 36 and the magnetic circuit 26 move ahead, the card existing state shown in FIG. 31 changes to the card non-existing state shown in FIG. 30. Accordingly, it can be determined that the card 12 has moved out of the attracting range of the magnetic circuit 26. If it is determined in S15 that the card 12 has moved out, the operation advances to S19 in which the movement of the slider 36 is stopped.

In S20, the stopped slider 36 is returned along the same moving path to the location at which the card 12 is left. In S21, when the slider 36 returns along the same moving path and reaches a point immediately below the card 12, the existence of the iron chips 70*a* to 70*f* buried in the card 12 (i.e., the existence of the magnetic sensor flag) is checked from a change of the detected value of each of the magnetic sensors $\mathbf{130}_1$ to $\mathbf{130}_6$. In other words, the detected values of the magnetic sensors $\mathbf{130}_1$ to $\mathbf{130}_6$ are compared with the respective reference values, thereby checking the attracting state of the card 12. This check process will be later described, with reference to the flowchart of FIG. 37.

If it is determined from the detected values of the magnetic sensors $\mathbf{130}_1$ to $\mathbf{130}_6$ that the card 12 (including the iron chips 70*a* to 70*f*) exists, the operation moves on to S22 in which the detected value of each of the magnetic sensors indicates the existence of the card 12 (the existence of the magnetic sensor flag). If it is determined in S22 that the detected value of each of the magnetic sensors $\mathbf{130}_1$ to $\mathbf{130}_6$ indicates the existence of the card 12 (the existence of the magnetic sensor flag), the magnetic circuit 26 reaches a point immediately below the card 12 and determines that the card 12 can be attracted. Accordingly, after the card 12 is attracted in S22, the operation returns to S13, and the processes following the process of S13 are repeated.

However, if it is determined in S22 that the detected value of each of the magnetic sensors $\mathbf{130}_1$ to $\mathbf{130}_6$ indicates the non-existence of the card 12 (the magnetic sensor flag does not exist), the operation moves on to S23. In S23, it is determined whether or not the slider 36 and the magnetic circuit 26 have returned to the starting point of the transportation of the card 12. If it is determined in S23 that the slider 36 and the magnetic circuit 26 have not returned to the starting point of the transportation of the card 12, the operation returns to S20, and the processes following the process of S20 are repeated.

If it is determined in S23 that the slider 36 and the magnetic circuit 26 have returned to the starting point of the transportation of the card 12, the magnetic circuit 26 returning along the same moving path is considered to have been unable to pick up the card 12 that moved out during the transportation, and the operation moves on to S24. In S24, a warning sound (alarm) or an abnormal state massage is outputted through a speaker or a display device. The card transportation is then stopped and set in a stand-by state.

Next, the processes of S14 and S19 for judging the card transportation conditions (subroutines) will be described.

Figure 37:
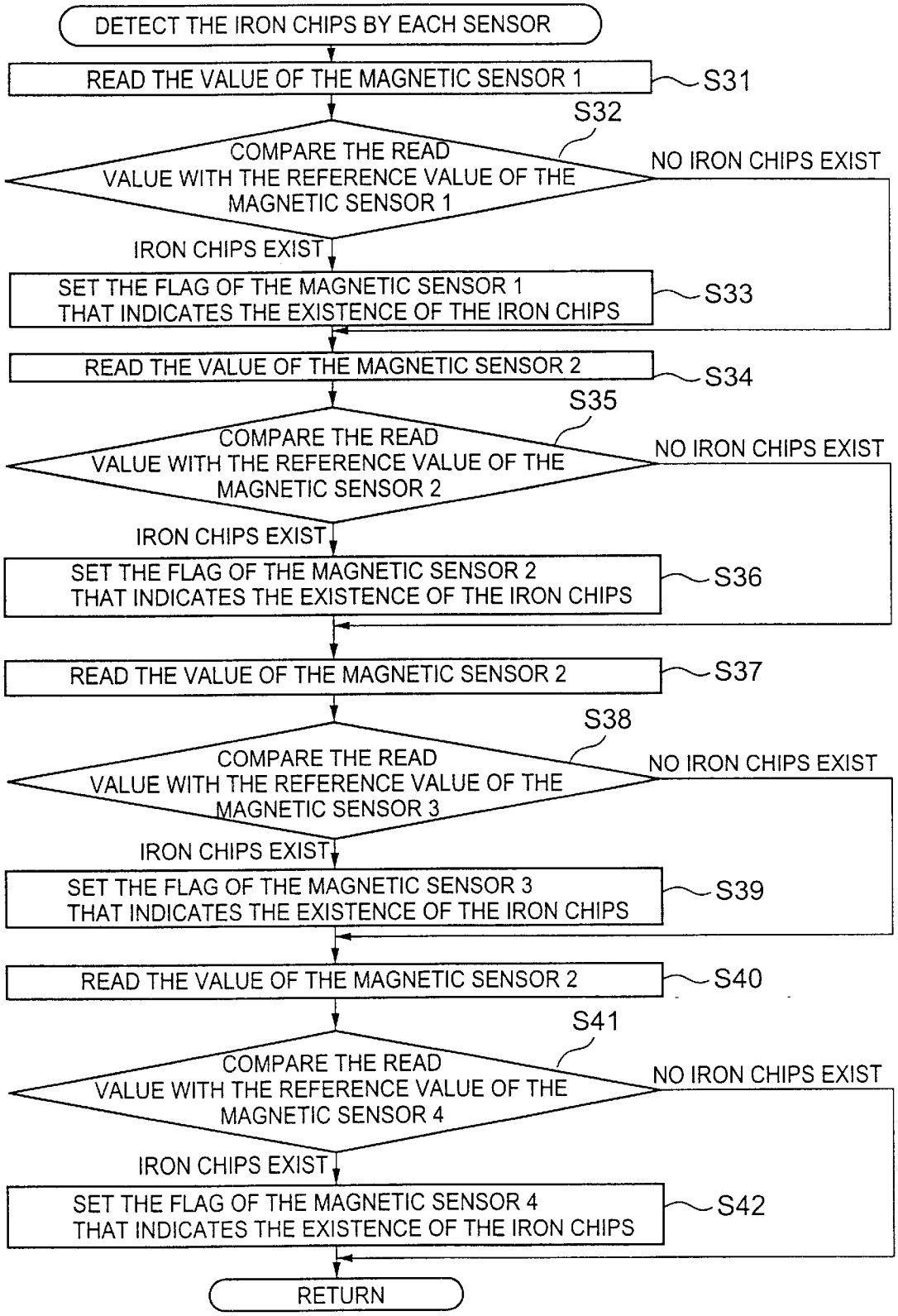
FIG. 37 is a flowchart of an operation of checking the transportation condition of the card 12 based on the detection values of the magnetic sensors $\mathbf{130}_1$ to $\mathbf{130}_6$.

FIG. 37 is a flowchart for judging the transportation condition of the card 12 based on the detection values of the magnetic sensors $\mathbf{130}_1$ to $\mathbf{130}_6$. The card 12 during the transporting operation is attracted at such a location that the iron chips 70*a* to 70*f* face the electromagnets $\mathbf{30}_1$ to $\mathbf{30}_4$ of the magnetic circuit 26, as shown in FIGS. 33 and 34.

As shown in FIG. 37, in S31, the detected value of the magnetic sensor $\mathbf{130}_1$ is read in. In S32, the detected value of the magnetic sensor $\mathbf{130}_1$ is compared with the predetermined reference value. If the detected value of the magnetic sensor $\mathbf{130}_1$ is larger than the reference value in S32, it is determined that the card 12 exists, and the operation moves on to S33. In S33, a flag indicating the existence of the card is set. If the detected value of the magnetic sensor $\mathbf{130}_1$ is equal to the reference value in S32, it is determined that the card 12 does not exists, and the process of S33 is skipped.

In S34, the detected value of the magnetic sensor $\mathbf{130}_2$ is read in. In S35, the detected value of the magnetic sensor $\mathbf{130}_2$ is compared with the predetermined reference value. If the detected value of the magnetic sensor $\mathbf{130}_2$ is larger than the reference value in S35, it is determined that the card 12 exists, and the operation moves on to S36. In S36, the flag indicating the existence of the card is set. If the detected value of the magnetic sensor $\mathbf{130}_2$ is equal to the reference value, it is determined that the card 12 does not exist, and the process of S36 is skipped.

In S37, the detected value of the magnetic sensor $\mathbf{130}_3$ is read in. In S38, the detected value of the magnetic sensor $\mathbf{130}_3$ is compared with the predetermined reference value. If the detected value of the magnetic sensor $\mathbf{130}_3$ is larger than the reference value in S38, it is determined that the card 12 exists, and the operation moves on to S39. In S39, the flag indicating the existence of the card is set. If the detected value of the magnetic sensor $\mathbf{130}_3$ is equal to the reference value in S38, it is determined that the card 12 does not exist, and the process of S39 is skipped.

In S40, the detected value of the magnetic sensor $\mathbf{130}_4$ is read in. In S41, the detected value of the magnetic sensor $\mathbf{130}_4$ is compared with the predetermined reference value. If the detected value of the magnetic sensor $\mathbf{130}_4$ is larger than the reference value, it is determined that the card 12 exists, and the operation moves on to S42. In S42, the flag indicating the existence of the card is set. If the detected value of the magnetic sensor $\mathbf{130}_4$ is equal to the reference value in S41, it is determined that the card 12 does not exist, and the process of S41 is skipped.

After that, the operation returns to the card transporting operation shown in FIG. 36. In this manner, the flag indicating the existence of the card is set in accordance with the detected values of the magnetic sensors $\mathbf{130}_1$ to $\mathbf{130}_4$ provided for the electromagnets $\mathbf{30}_1$ to $\mathbf{30}_4$ magnetized during the card transportation, so that the existence of the card 12 can be checked with the flag. For instance, when the flags of all the magnetic sensors $\mathbf{130}_1$ to $\mathbf{130}_4$ indicate the existence of a card, it is confirmed that the card 12 is properly drawn onto the table, as shown in FIG. 33.

If the flags for the magnetic sensors $\mathbf{130}_1$ and $\mathbf{130}_3$ indicate the existence of a card, the card 12 is located in a slightly displaced position.

If no flags indicate the existence of a card, it can be found that the card 12 has moved out of the attracting range of the magnetic circuit 26.

Next, the entire structure of a full-automatic card game machine having the card transportation mechanism having the above structure will be described.

Figure 38:
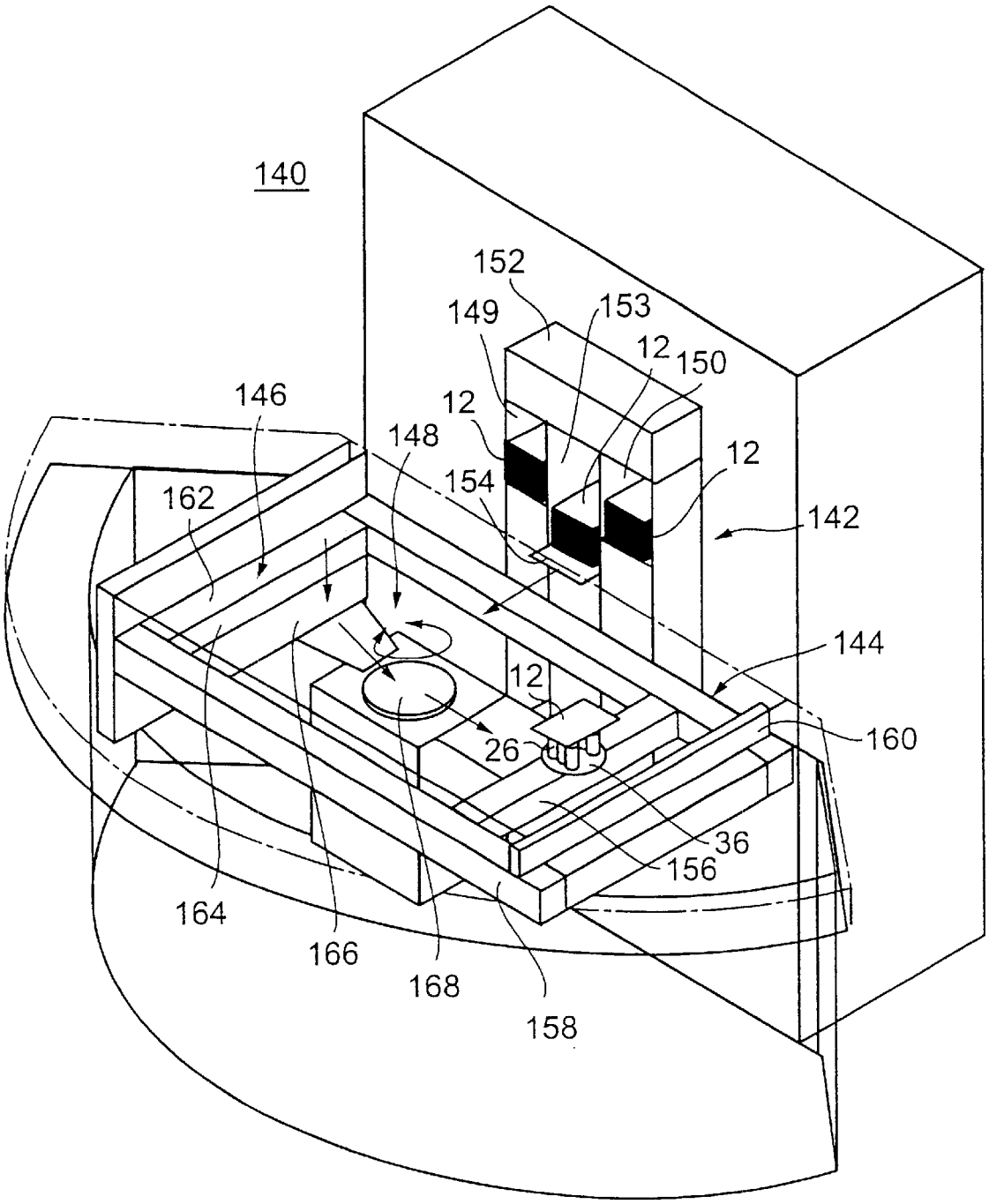
FIG. 38 is a perspective view of a first embodiment of a full-automatic card game machine.
Figure 39:
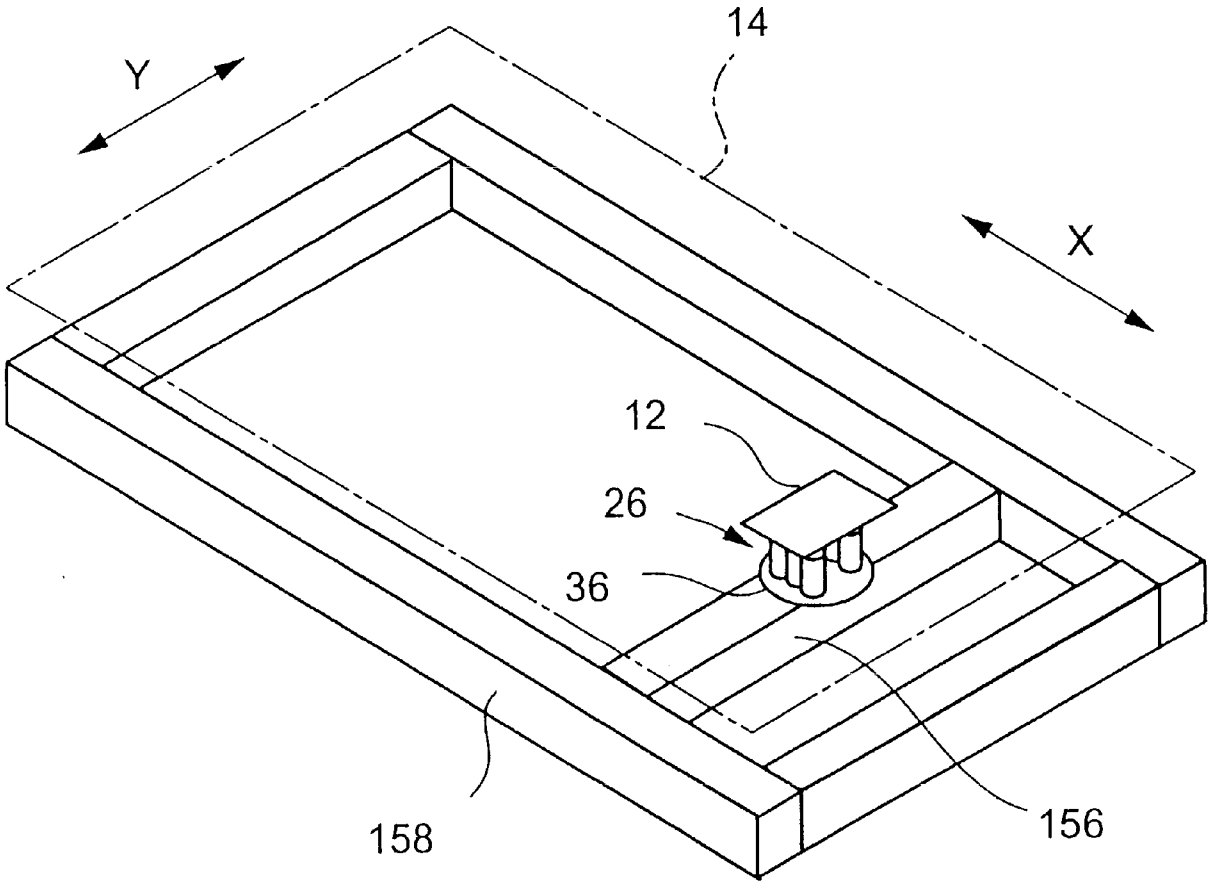
FIG. 39 is a perspective view showing the structure of a card transportation mechanism 144.

FIG. 38 is a perspective view of a first embodiment of the full-automatic card game machine in accordance with the present invention. FIG. 39 is a perspective view of the structure of a card transportation mechanism 144 of this embodiment.

As shown in FIGS. 38 and 39, the full-automatic card game machine 140 comprises: a card discharging mechanism 142 that discharges one of the cards 12; a fan-shaped table 14 on which the card 12 supplied from the card discharging mechanism 142 is placed, the magnetic circuit 26 that attracts the card 12 discharged onto the table 14 from below the table 14 by magnetic force; a card transportation mechanism 144 that transports the card 12 placed on the table 14 by moving the magnetic circuit 26; the control circuit (a magnetic force control unit) 22 that switches the magnetic force of the magnetic circuit 26 so as to reverse each card 12 transported to each player with the movement of the magnetic circuit 26; a card collecting mechanism 146 that collects the card 12 from the table 14 after the end of a game; and a card supply mechanism 148 that stacks and supplies the collected cards 12 to the card discharging mechanism 142.

The card discharging mechanism 142 comprises: first and second card stock units 149 and 150 in which the collected cards 12 are stocked; a card shuffling unit 152 that pulls out the cards 12 alternately from the first and second card stock units 149 and 150, and shuffles the cards; a third card stock unit 153 in which the cards 12 pulled out from the left and right card stock units 149 and 150 by the shuffling operation of the card shuffling unit 152 are sequentially stacked; and a card discharging unit 154 that discharges the card 12 from the third card stocking unit 153 one by one.

The card stock units 149 and 150 has an elevating mechanism (not shown) that pushes upward the cards 12 supplied from the card supply mechanism 148, and the height of each of the card stock units 149 and 150 is automatically controlled so that each uppermost card is always located in the same position. With this structure, the card shuffling unit 152 pulls out only the uppermost cards 12 from the left and right card stock units 149 and 150, and then drops the pulled-out cards 12 into the third card stock unit 153.

When the card stock units 149 and 150 are emptied, the card supply unit 148 supplies the cards 12 into the card stock units 149 and 150.

The card transportation mechanism 144 is located below the table 14, and comprises a Y-direction driving mechanism 156 that moves the slider 36 on which the magnetic circuit 26 is mounted in the Y direction, and a frame-like X-direction driving mechanism 158 that moves the slider 36 and the Y-direction driving mechanism 156 in the X direction (see FIG. 39).

The card collecting mechanism 146 comprises a collecting brush 160 that slides on the table 14 from right to left so as to pushes the card 12 to the left side, and a card collecting box 162 attached to the left side surface of the table 14. The collecting brush 160 extends in the Y direction, and has a brush that slides on the table 14 at its lower end portion. When a card 12 is collected from the table 14 into the card collecting box 162, the collecting brush 160 slides on the table 14 back to the right side, and returns to the original position.

The cards 12 collected in the card collecting box 162 are aligned by the card supply mechanism 148 and then supplied to the card discharging mechanism 142. The card supply mechanism 148 comprises: a first card orientation adjusting mechanism 164 that is located in the card collecting box 162 and adjusts the cards in the longitudinal and transverse directions; a second card orientation adjusting mechanism 166 that controls the cards 12 so that the faces of all the cards 12 face in the same direction; and a third card orientation adjusting mechanism 168 that controls the cards 12 so that all the cards 12 are directed in the same direction. With this structure, after the cards 12 supplied to the card discharging mechanism 142 pass through the card orientation adjusting mechanisms 164, 166, and 168, all the cards 12 are completely aligned. With the iron chips 70*a* to 70*f* buried in the cards 12 being aligned accordingly, the cards 12 are supplied into the card stock units 149 and 150. The card orientation adjusting mechanisms 164, 166, and 168 will be described later in detail.

In the above full-automatic card game machine 140, the card discharging mechanism 142, the card transportation mechanism 144 containing the magnetic circuit 26, the card collecting mechanism 146, and the card supply mechanism 148 are combined, so as to automatically and continuously perform the processes including the card transporting process, the card reversing process, the card collecting process, the card orientation adjusting process, the card shuffling process, and the card discharging process. Thus, no human hands are required for distributing the cards and for the entire card game machine.

Figure 40:
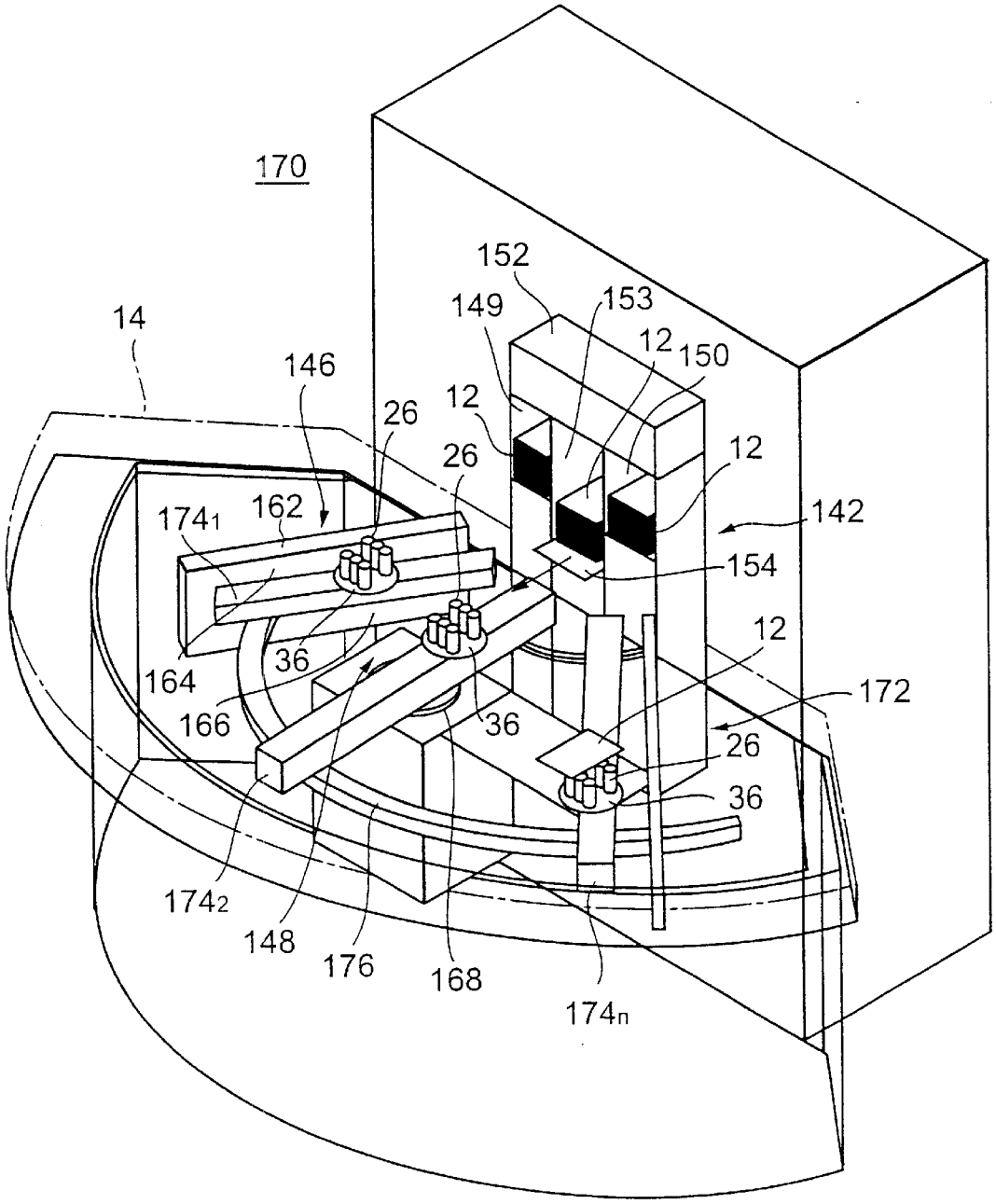
FIG. 40 is a perspective view of a second embodiment of the full-automatic card game-machine.
Figure 41:
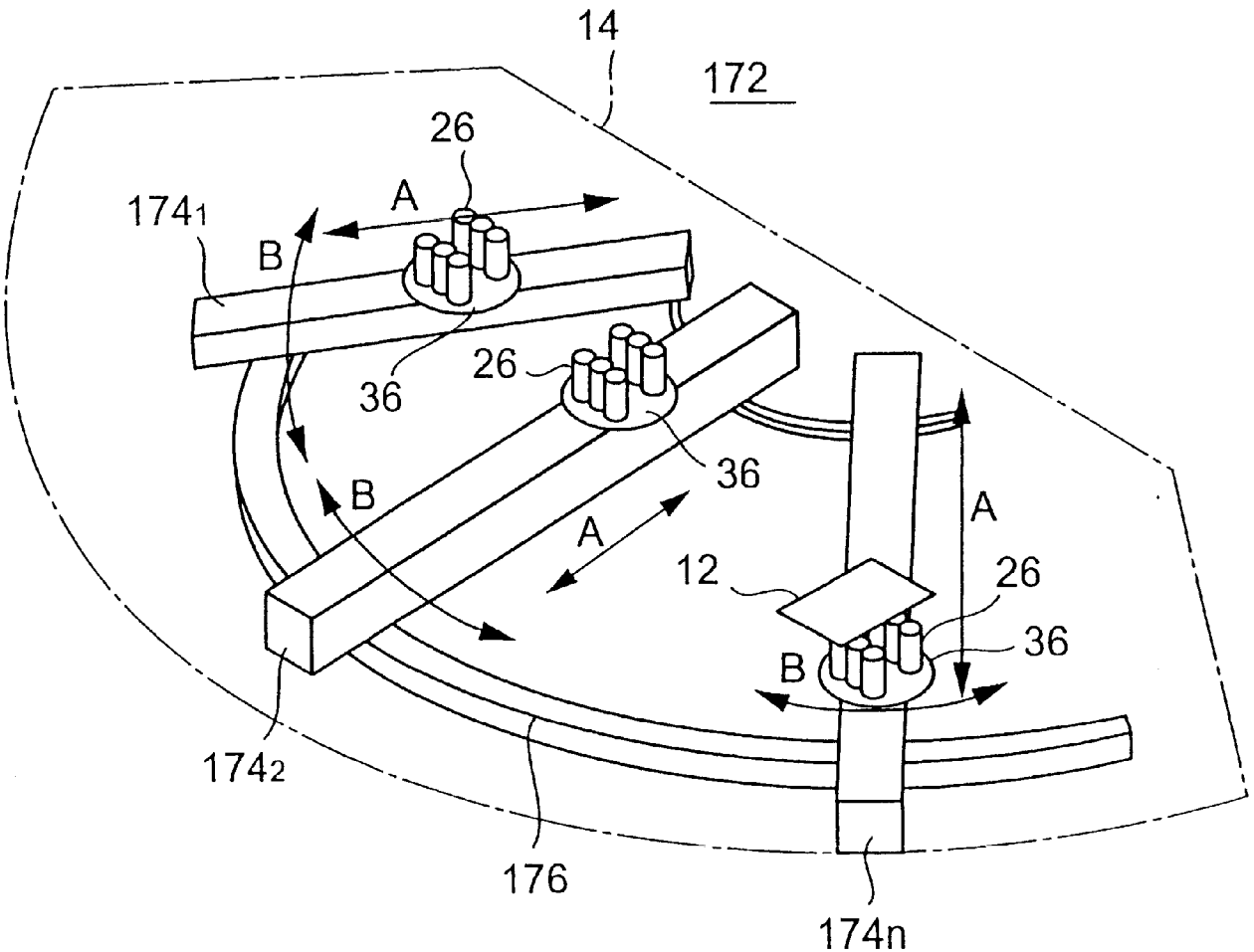
FIG. 41 is a perspective view showing the structure of a card transportation mechanism 172.

FIG. 40 is a perspective view of a second embodiment of the full-automatic card game machine. FIG. 41 is a perspective view of a card transportation mechanism 172.

As shown in FIGS. 40 and 41, the full-automatic card game machine 170 has substantially the same structure as the full-automatic card game machine 140, except for the structure of the card transportation mechanism 172. The card transportation mechanism 172 of this embodiment is located below the fan-like table 14, and comprises a plurality of transportation guide units 174 ($\mathbf{174}_1$ to $\mathbf{174}_n$) extending in the radial direction about the card discharging mechanism 142, and a circling driving mechanism 176 that drives the transportation guide units 174 ($\mathbf{174}_1$ to $\mathbf{174}_n$) in the circumferential direction.

The transportation guide units 174 ($\mathbf{174}_1$ to $\mathbf{174}_n$) move the slider 36 on which the magnetic circuit 26 is mounted in the radial direction (the A direction), thereby transporting the card 12 in the radial direction. The circling driving mechanism 176 drives each of the transportation guide units 174 ($\mathbf{174}_1$ to $\mathbf{174}_n$) in the radial direction (the B direction), so as to direct the card 12 in the direction of the seat of the player who has made a request for the card 12. If a plurality of players are seated and make requests for cards, the transportation guide unit 174 that is the closest to each player among the transportation guide units $\mathbf{174}_1$ to $\mathbf{174}_n$ circles and transports the card 12.

In the full-automatic card game machine 170, a plurality of transportation guide units 174 ($\mathbf{174}_1$ to $\mathbf{174}_n$) circle in the radial direction (the B direction), thereby distributing the cards promptly to a number of players.

The collecting brush can also circle. After the end of a game, the collecting brush 160 circles from the right side to the left side of the table 14, and drops the card 12 from the table 14 into the card collecting box 162 located on the left-side surface of the table 14.

Next, the structure of the first card orientation adjusting mechanism 164 will be described.

Figure 42:
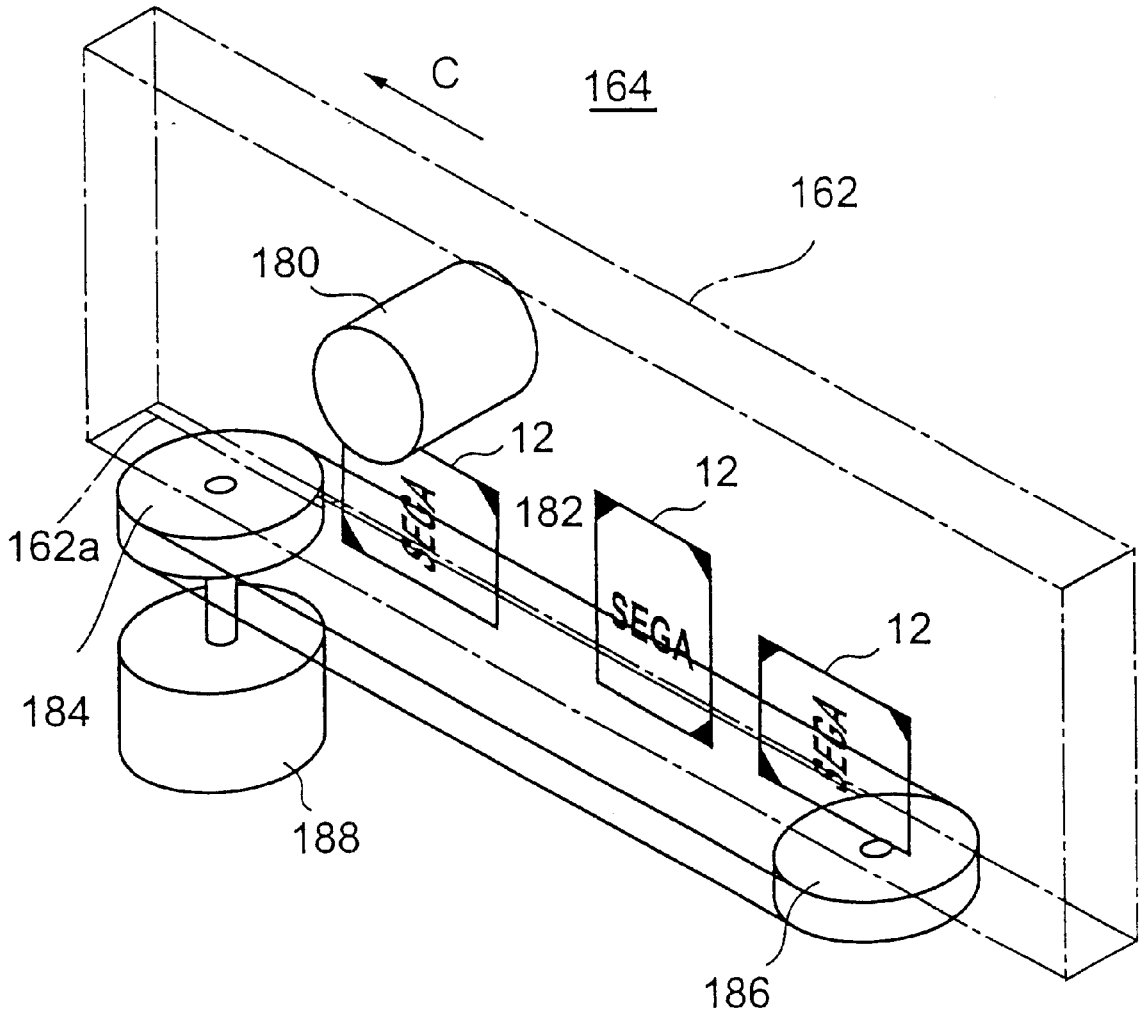
FIG. 42 is a perspective view showing the structure of a first card orientation adjusting mechanism 164.

FIG. 42 is a perspective view of the first card orientation adjusting mechanism 164.

As shown in FIG. 42, the first card orientation adjusting mechanism 164 comprises: a pin 180 that is transversely located in the card collecting box 162; a belt 182 that presses the collected cards 12 against the inner wall of the card collecting box 162; a pair of rollers 184 and 186 around which the belt 182 is wound; and a driving motor 188 that rotates the roller 184. The pin 180 is located at the height of the horizontal-aligning direction of the cards 12 collected in the card collecting box 162, and the driving motor 188 rotates the roller 184 so as to move the cards 12 pressed by the belt 182 in the C direction.

Figure 43A:
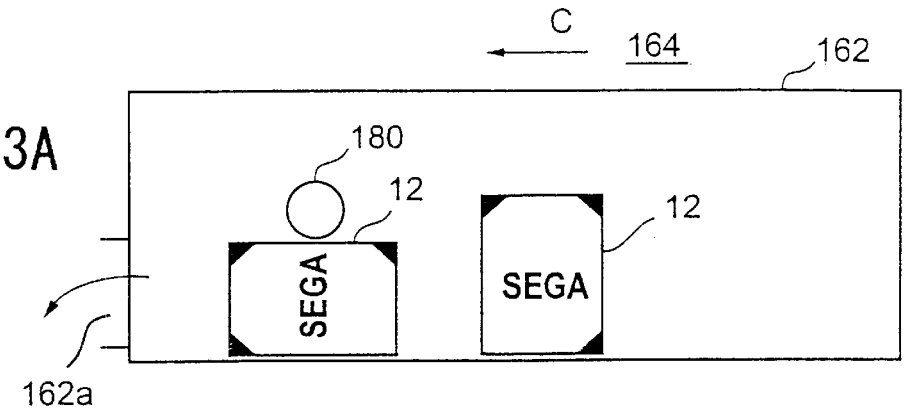
FIG. 43A is a longitudinal section illustrating the operation of the first card orientation adjusting mechanism 164.

If the card 12 pressed by the belt 182 and moving in the C direction is positioned in the horizontal direction, as shown in FIG. 43A, the card 12 can pass through under the pin 180 and be discharged through an discharging outlet 162 formed on the left-side surface of the card collecting box 162.

Figure 43B:
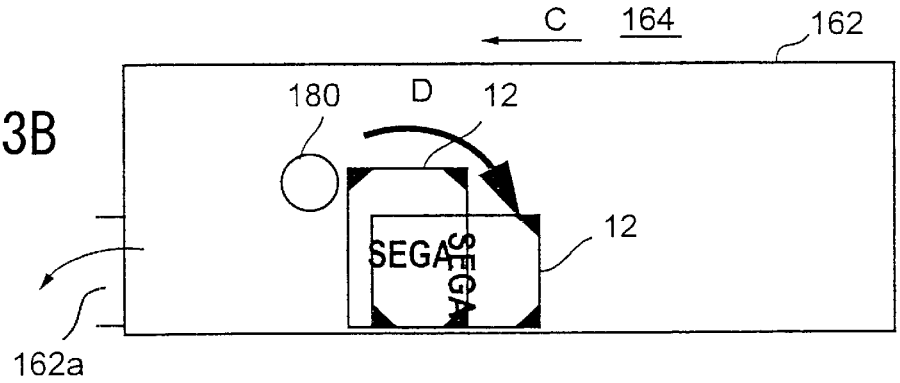
FIG. 43B is a longitudinal section illustrating an operation of a card passing through the first card orientation adjusting mechanism 164.

If the card 12 pressed by the belt 182 and moving in the C direction is positioned in the vertical direction, the upper end of the card 12 is brought into contact with the pin 180 and then rotated in the D direction. As a result, the card 12 falls on to its side, as shown in FIG. 43B. The card 12 then passes through under the pin 180, and is discharged through the discharging outlet 162*a* of the card collecting box 162.

In this manner, the cards collected in the card collecting box 162 are directed in the horizontal direction when passing through under the pin 180, and then discharged through the discharging outlet 162*a*.

Next, the structure of the second card orientation adjusting mechanism 166 will be described.

Figure 44:
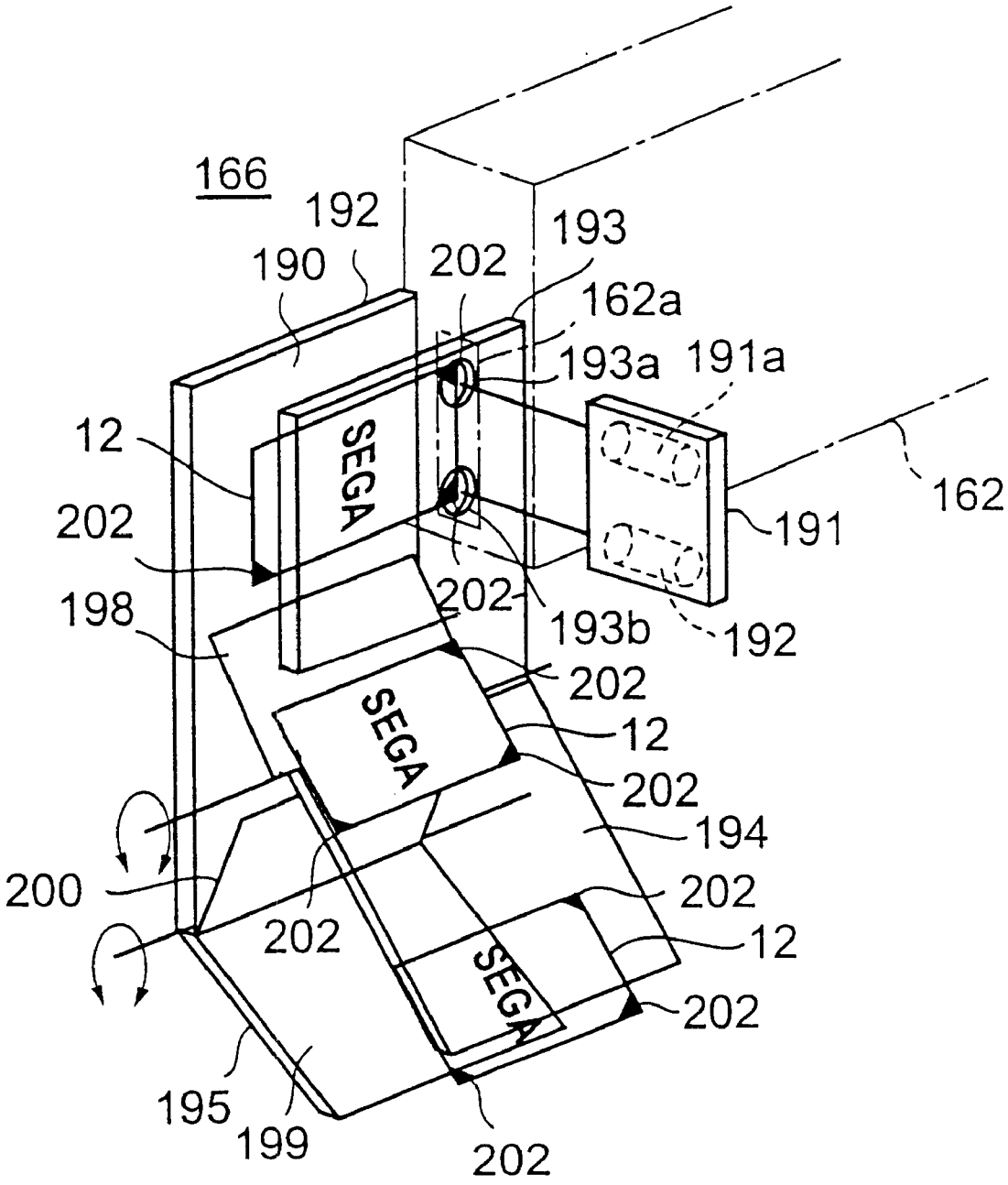
FIG. 44 is a perspective view showing the structure of a second card orientation adjusting mechanism 166.
Figure 45:
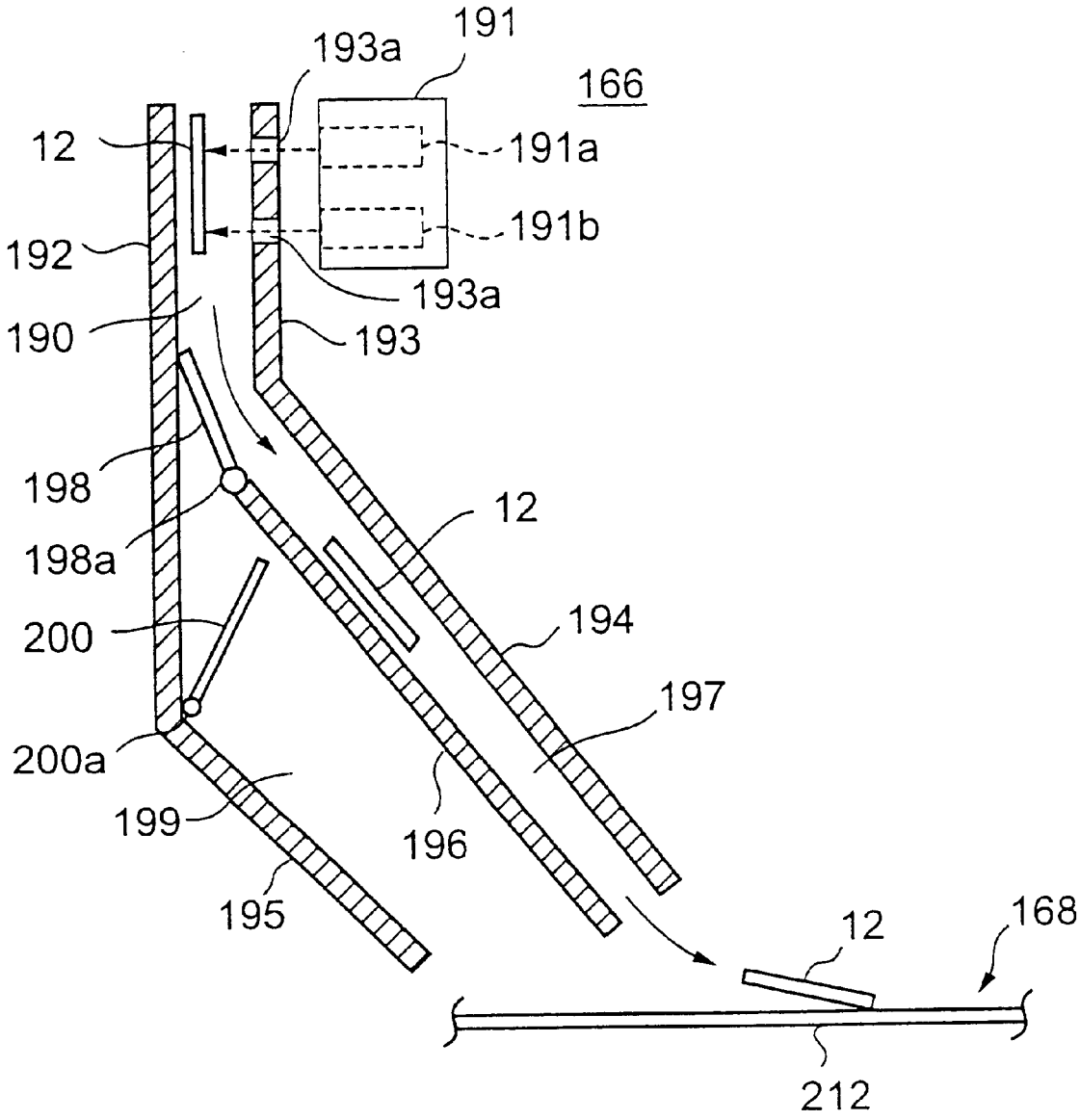
FIG. 45 is a longitudinal section showing the structure of the second card orientation adjusting mechanism 166.

FIG. 44 is a perspective view of the second card orientation adjusting mechanism 166. FIG. 45 is a longitudinal section of the second card orientation adjusting mechanism 166.

As shown in FIGS. 44 and 45, the second card orientation adjusting mechanism 166 is located below the first card orientation adjusting mechanism 164, and turns the faces of all the cards 12 to the same side.

The second card orientation adjusting mechanism 166 comprises: an optical sensor unit 191 that optically detects the side of each card 12 discharged through the discharging outlet 162 of the card collecting box 162; a pair of vertical walls 192 and 193 that constitute a vertical passage 190 through which the cards 12 pass; inclined plates 194 and 195 that are located below the vertical walls 192 and 193; a partition plate 196 that is located between the inclined plates 194 and 195; a first guide plate 198 that directs each card 12 from the vertical passage 190 to a first inclined passage 197 formed between the inclined plate 194 and the partition plate 196; and a second guide plate 200 that directs each card 12 to a second inclined passage 199 formed between the inclined plate 195 and the partition plate 196. The first guide plate 198 and the second guide plate 200 include axes 198*a* and 200*a* around which the first guide plate 198 and the second guide plate 200 revolve, and are driven by a motor (not shown) in accordance with the detection result supplied from the optical sensor unit 191.

Each card 12 has a pattern, such as a diamond, a spade, a heart, or a club, printed on the face side. On the back side of each card 12, a pattern, such as the trade name "SEGA", is printed. Furthermore, black triangular marks 202 are printed at three corners of the four corners of the back side of each card 12. The black triangular marks 202 are used to determine the orientation of each card 12.

The optical sensor unit 191 comprises a pair of optical sensors 191*a* and 191*b* each having a light emitter and a light receiver, as indicated by the broken line in FIG. 45. The gap between the optical sensors 191*a* and 191*b* corresponds to the width of each card 12. The vertical wall 193 is provided with through holes 193*a* and 193*b* through which light passes at the locations corresponding to the optical sensors 191*a* and 191*b*. Accordingly, the light emitted from the optical sensors 191*a* and 191*b* passes through the through holes 193*a* and 193*b*, and reaches each card 12. When the light is emitted on the back side (white) of the card 12, the reflection light is received by the optical sensors 191*a* and 191*b*. When the light is emitted on the black triangular marks 202 of each card 12, no reflection light is generated and received by the optical sensors 191*a* and 191*b*.

Accordingly, when the optical sensor unit 191 detects the black triangular marks 202, it is determined that the back side of the card 12 faces the optical sensor unit 191. On the other hand, when the optical sensor unit 191 does not detect the black triangular marks 202, it is determined that the face of the card 12 faces the optical sensor unit 191. Furthermore, the orientation of the card 12 can be determined from the number (1 or 2) of detected black triangular marks 202.

As shown in FIG. 45, when the card 12 passes through the passage 190, with the back side of the card 12 facing the optical sensor unit 191, the first guide plate 198 is inclined to the left and blocks the vertical passage 190. Accordingly, the card 12 is directed to the first inclined passage 197 by the first guide plate 198, and then supplied to the third card orientation adjusting mechanism 168.

Figure 46B:
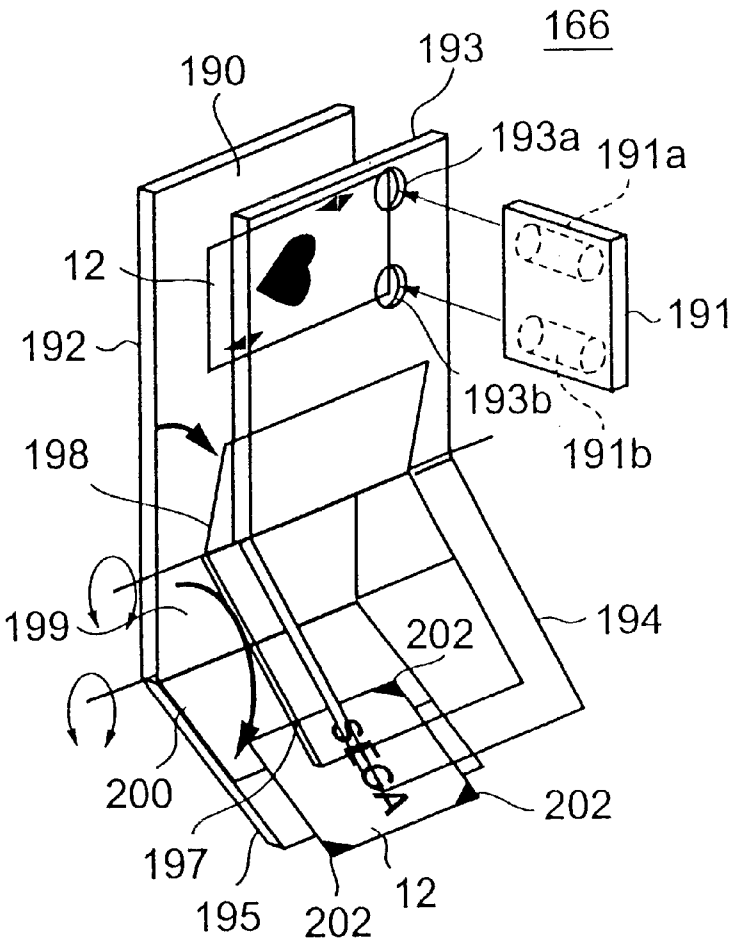
FIG. 46B is a perspective view illustrating an operation performed after the second card orientation adjusting mechanism 166 reverses the card.
Figure 46A:
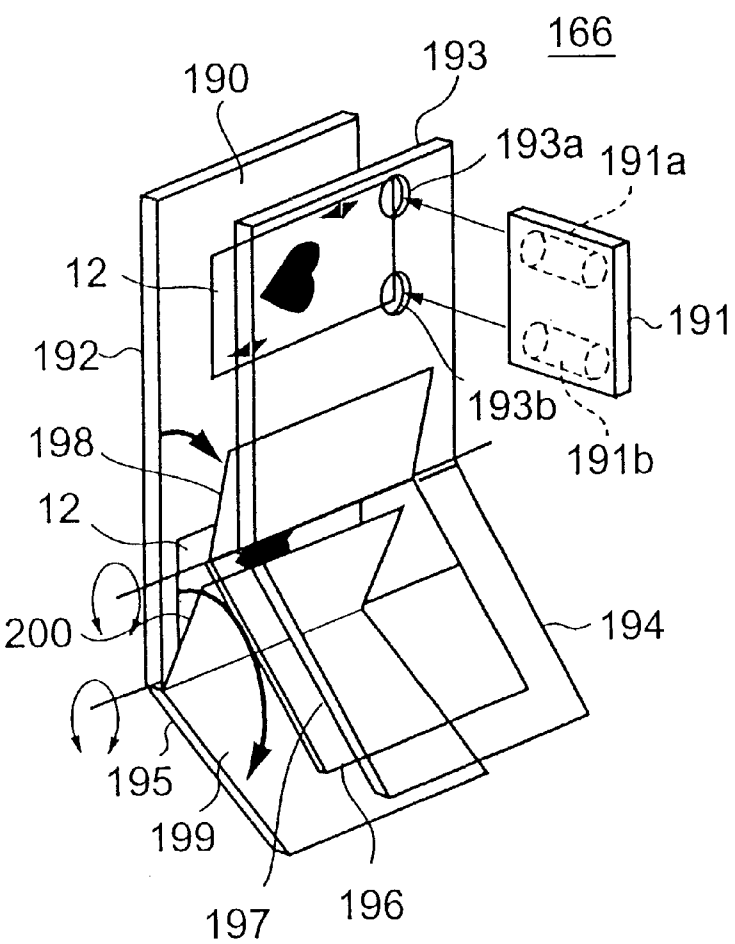
FIG. 46A is a perspective view illustrating an operation performed before the second card orientation adjusting mechanism 166 reverses a card.
Figure 47:
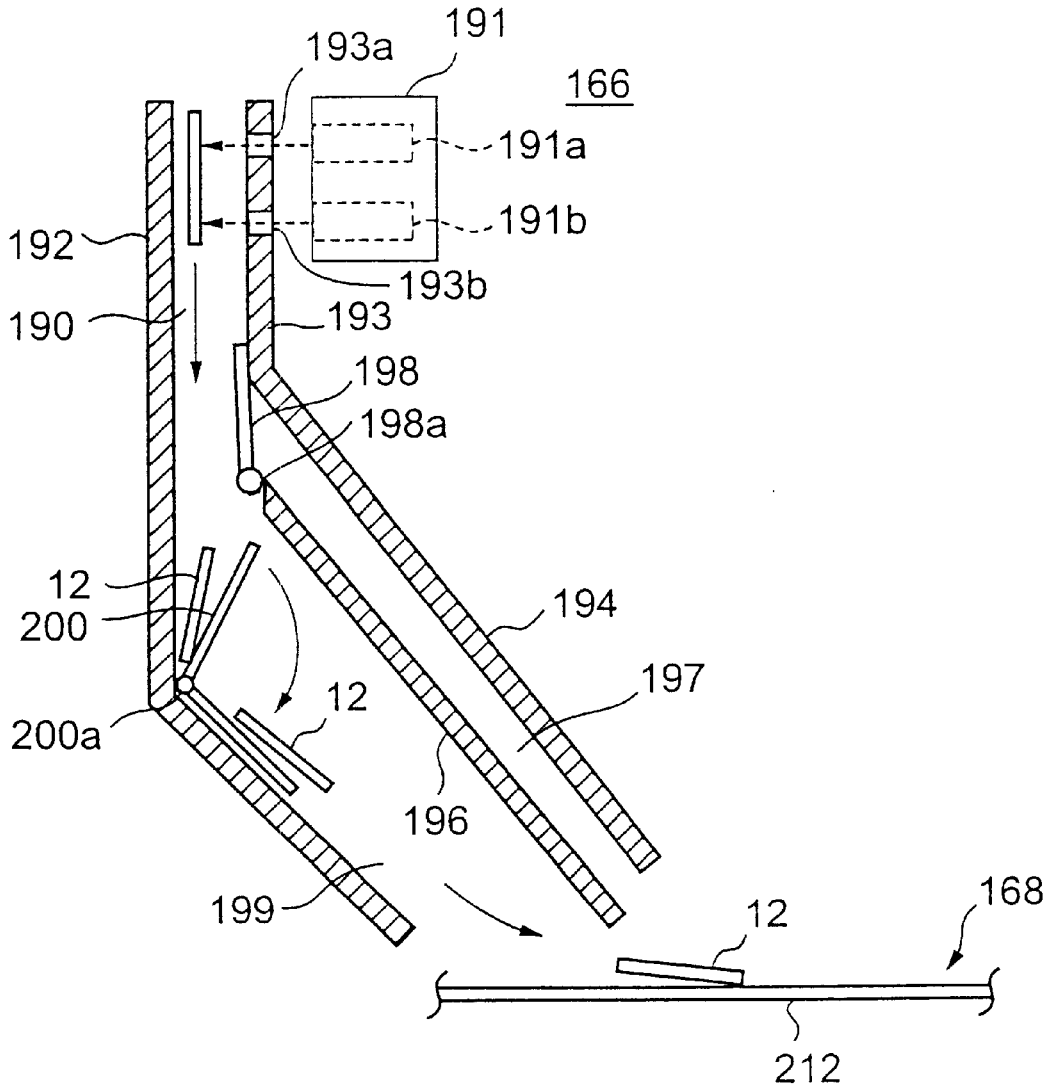
FIG. 47 is a longitudinal section illustrating an operation when the second card orientation adjusting mechanism 166 reverses a card.

When the card passes through the vertical passage 190, with the face of the card 12 facing the optical sensor unit 191, the first guide plate 198 rotates to the vertical position, and the second guide plate 200 rotates clockwise so as to reverse the dropped card 12, as shown in FIGS. 46A to 47. Thus, the card 12 is reversed and directed from the vertical passage 190 to the second inclined passage 199.

Next, the control operation of the second card orientation adjusting mechanism 166 will be described.

Figure 48:
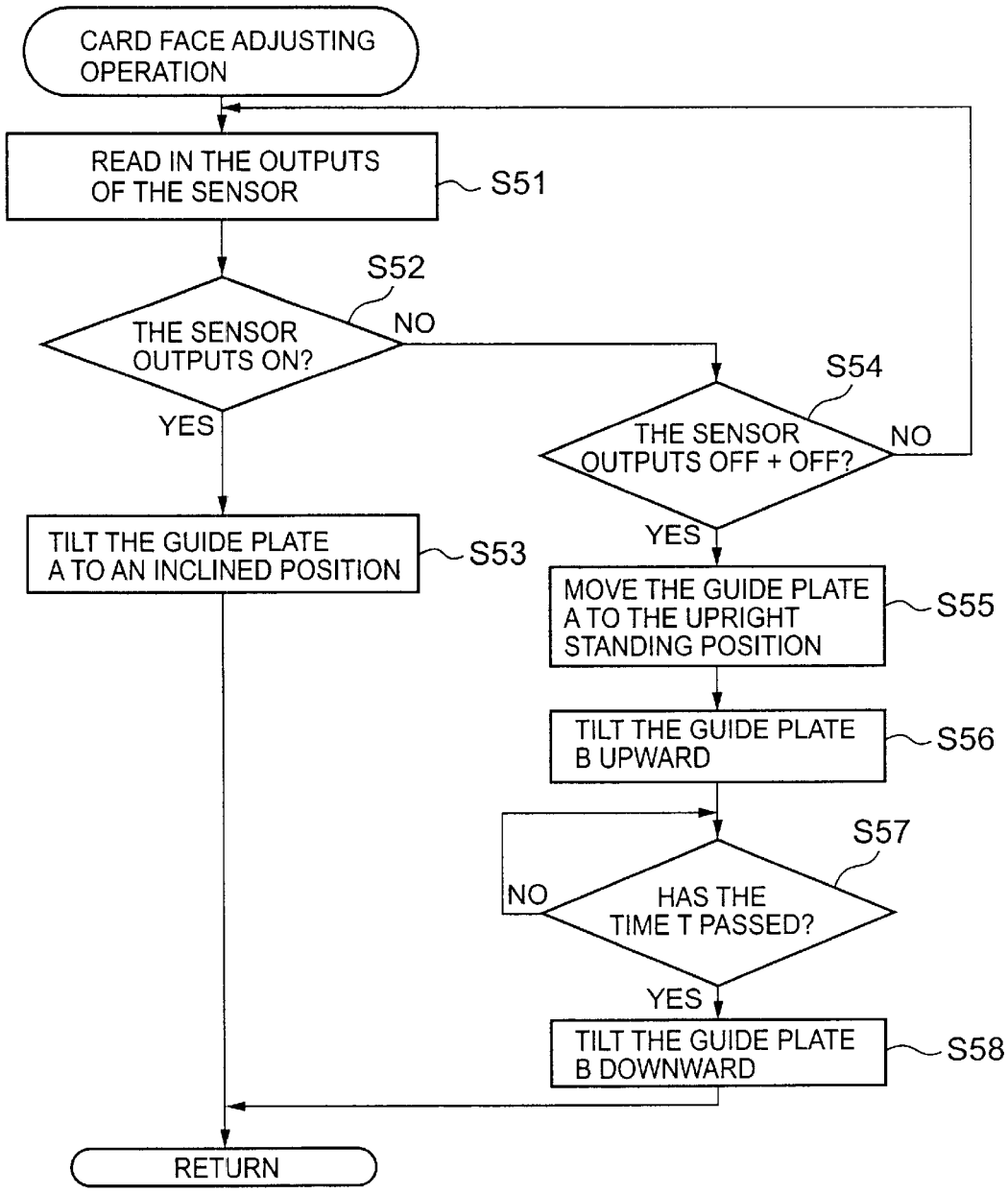
FIG. 48 is a flowchart of a card side adjusting operation.

FIG. 48 is a flowchart of the card side control operation.

As shown in FIG. 48, in S51, the outputs of the optical sensors 191*a* and 191*b* included in the optical sensor unit 191 are read in. In S52, it is checked whether or not at least one of the outputs of the optical sensors 191*a* and 191*b* is on.

If at least one of the outputs of the optical sensors 191*a* and 191*b* is on in S52, it is determined that the back side of the card 12 faces the optical sensor unit 191, and the operation moves on to S53. In S53, the first guide plate 198 is rotated to the inclined position, thereby blocking the passage 190. If the card 12 passes through the passage 190, with the back side facing the optical sensor unit 191, the card 12 is directed to the passage 197 by the first guide plate 198, and then supplied to the third card orientation adjusting mechanism 168 (see FIG. 45).

If the outputs of the optical sensors 191*a* and 191*b* are not on in S52, the operation moves on to S54. In S54, it is checked whether or not both of the outputs of the optical sensors 191*a* and 191*b* are off. If both of the outputs of the optical sensors 191*a* and 191*b* are off in S54, it is determined that the card 12 passes through the passage 190, with the face side of the card 12 facing the optical sensor unit 191, and the operation moves on to S55.

In S55, the first guide plate 198 is rotated to the vertical position, thereby opening the passage 190.

In S56, the second guide plate 200 is rotated upward.

After a predetermined period of time t (0.5 second, for instance) has passed, the operation moves on to S58. In S58, the second guide plate 200 is rotated downward. By doing so, when the card 12 passes through the passage 190, with the face side of the card 12 facing the optical sensor unit 191, the first guide plate 198 rotates to the vertical position, and the second guide plate 200 rotates clockwise so as to reverse the card 12, as shown in FIGS. 46A to 47. The card 12 is then supplied to the inclined passage 199.

Next, the structure of the third card orientation adjusting mechanism 168 will be described.

Figure 49A:
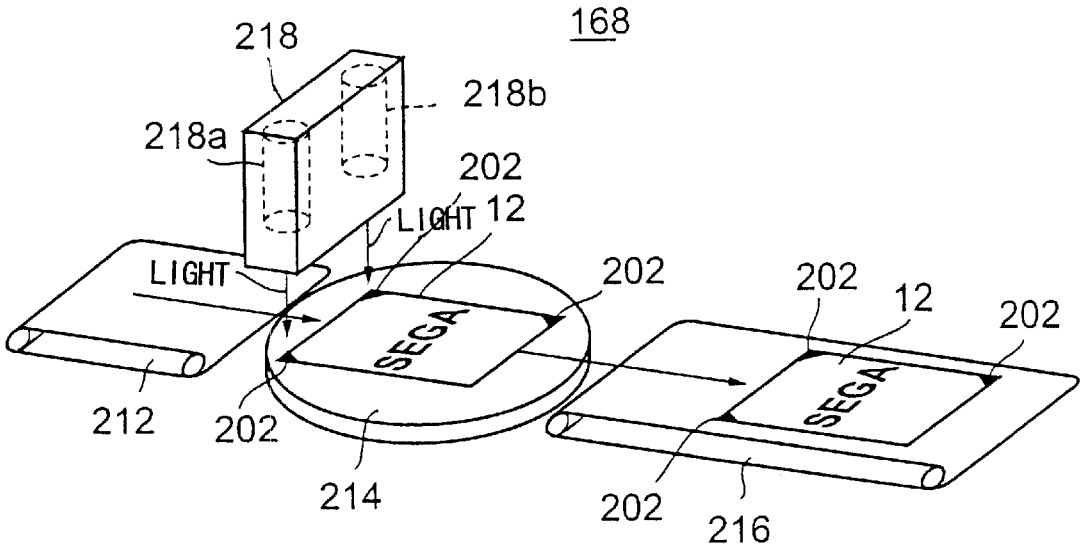
FIG. 49A is a perspective view showing the structure of a third card orientation adjusting mechanism 168.
Figure 49B:
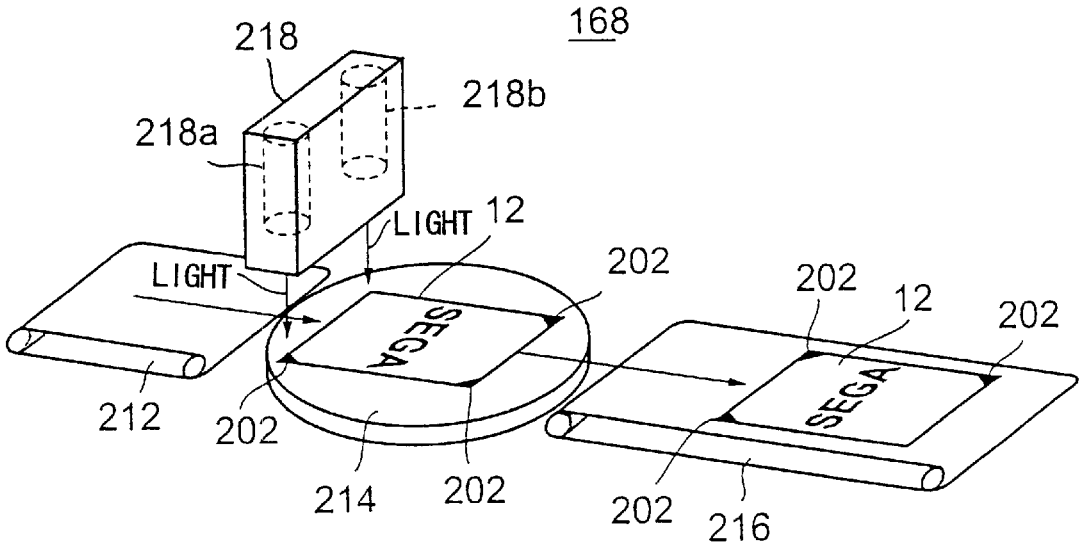
FIG. 49B is a perspective view illustrating an operation of adjusting the orientation of a card by the third card orientation adjusting mechanism 168 that rotates the card through 180 degrees.

FIG. 49A is a perspective view showing the structure of the third card orientation adjusting mechanism 168. FIG. 49B is a perspective view of the third card orientation adjusting mechanism 168 when performing an operation in which the cards are rotated through 180 degrees and aligned.

As shown in FIG. 49A, the third card orientation adjusting mechanism 168 comprises: a first conveyer 212 that transports the card 12 supplied from the second card orientation adjusting mechanism 166; a turntable 214 that turns the card 12 by 180 degrees; a second conveyer that transports the card 12 passed through the turntable 214; and an optical sensor unit 218 that is located above the turntable 214.

The optical sensor unit 218 includes optical sensors 218*a* and 218*b* that optically detect the black triangular marks 202 formed at the corners of the card 12. The optical sensor unit 218 is located in a position perpendicular to the card transporting direction, so that the black triangular marks 202 formed at the corners of the card 12 in the width direction can be detected.

When the card 12 transported on the first conveyer 212 has the black triangular marks 202 at both corners on the opposite side of the transporting direction, as shown in FIG. 49A, the orientation of the card 12 is unchanged, and the card 12 is transported to the second conveyer 216.

However, when the card 12 has one black triangular mark 202 at one corner on the opposite side of the transporting direction, as shown in FIG. 49B, the orientation of the card 12 is wrong by 180 degrees. Therefore, the turntable 214 is rotated through 180 degrees so as to turn the card 12. The card 12 is then transported to the second conveyer 216.

In the above manner, all the cards 12 are aligned in the same direction and supplied to the card discharging mechanism 142.

Next, the control operation of the third card orientation adjusting mechanism 168 will be described.

Figure 50:
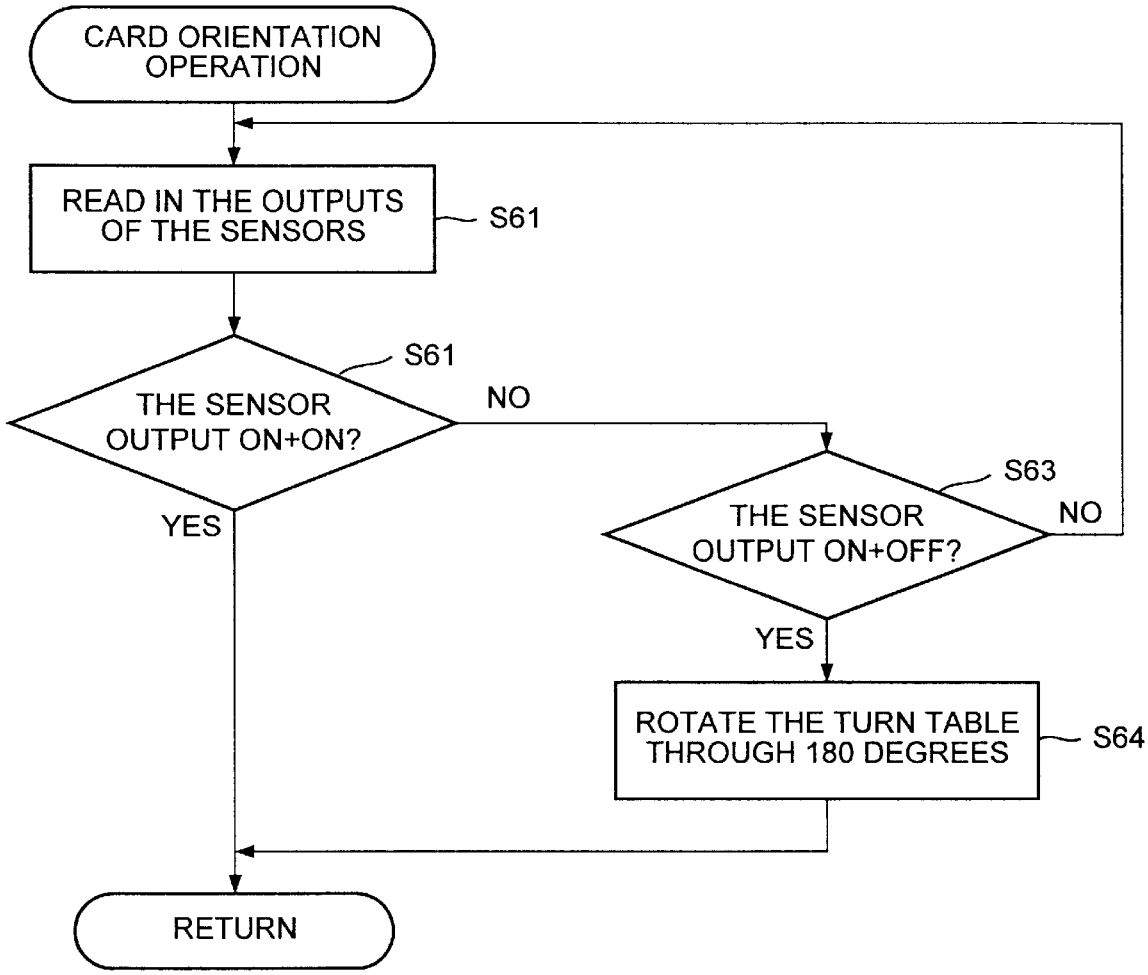
FIG. 50 is a flowchart of a card orientation adjusting operation.

FIG. 50 is a flowchart of the card orientation adjusting operation.

As shown in FIG. 50, in S61, the outputs of the optical sensors 191*a* and 191*b* included in the optical sensor unit 191 are read in. In S62, it is checked whether or not both the outputs of the optical sensors 191*a* and 191*b* are on. If both of the outputs of the optical sensors 191*a* and 191*b* are on in S62, it is determined that the card 12 transported from the first conveyer 212 is oriented in the predetermined direction. Accordingly, the orientation of the card 12 is unchanged, and the card 12 is transported to the second conveyer 216 (see FIG. 49A).

If both of the outputs of the optical sensors 191*a* and 191*b* are not on in S62, the operation moves on to S63. If one of the outputs of the optical sensors 191*a* and 191*b* is on while the other one is off, the operation moves on to S64. In this case, it is determined that the orientation of the card 12 transported from the first conveyer 212 is wrong by 180 degrees. Accordingly, the turntable 214 is rotated through 180 degrees, and the card 12 is then transported to the second conveyer 216 (see FIG. 49B).

Next, a modification of the third card orientation adjusting mechanism 168 will be described.

Figure 51A:
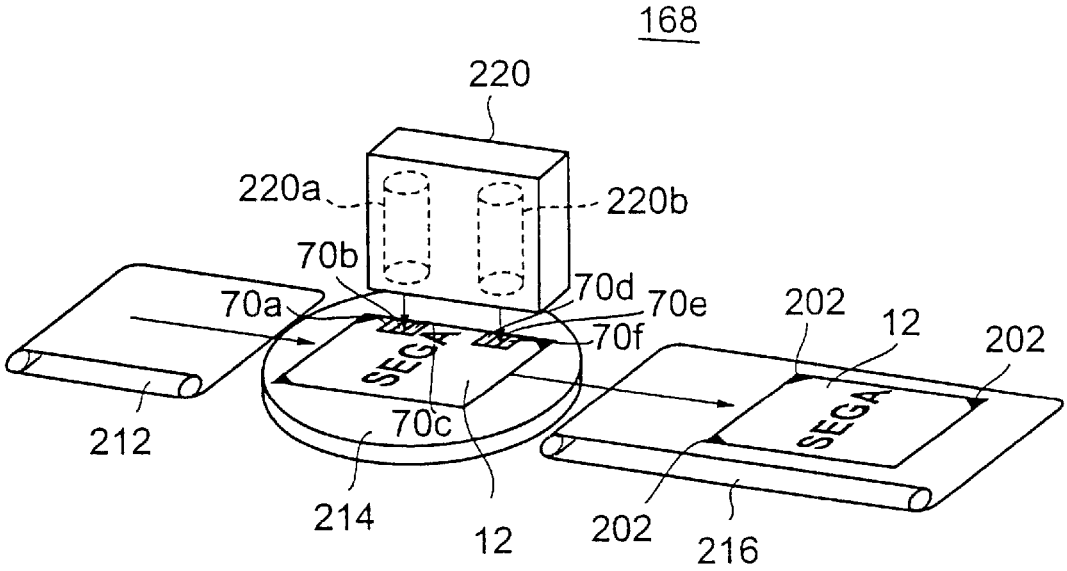
FIG. 51A is a perspective view showing the structure of a modification of the third card orientation adjusting mechanism 168.
Figure 51B:
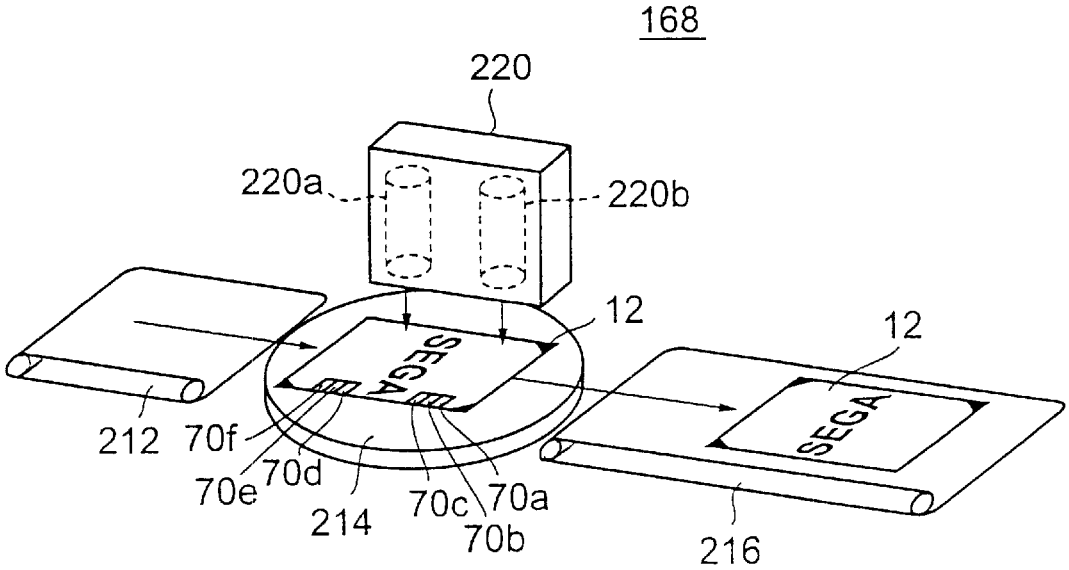
FIG. 51B is a perspective view illustrating an operation of adjusting the orientation of a card by the modification of the third card orientation adjusting mechanism 168 that rotates the card through 180 degrees.

FIGS. 51A and 51B are perspective views of the modification of the third card orientation adjusting mechanism 168.

As shown in FIG. 51A, the third card orientation adjusting mechanism 168 includes a magnetic sensor unit 220, instead of the optical sensor unit 191. The magnetic sensor unit 220 comprises a pair of magnetic sensors 220*a* and 220*b* that detect the positions of the iron chips 70 (70*a* to 70*f*) buried in the card 12.

When the iron chips 70 (70*a* to 70*f*) in the card 12 transported from the first conveyer 212 are detected by the magnetic sensors 220*a* and 220*b*, as shown in FIG. 51A, it is determined that the card 12 is oriented in the predetermined direction. Accordingly, the orientation of the card 12 is unchanged, and the card 12 is transported to the second conveyer 216.

However, when the iron chips 70 (70*a* to 70*f*) in the card 12 transported from the first conveyer 212 are not detected by the magnetic sensors 220*a* and 220*b*, as shown in FIG. 51B, it is determined that the orientation of the card 12 is wrong by 180 degrees. Accordingly, the turntable 214 is rotated through 180 degrees so as to turn the card 12. The card 12 is then transported to the second conveyer 216.

In the above manner, all the cards 12 are aligned in the same direction, and then supplied to the card discharging mechanism 142.

Although a card transportation mechanism incorporated in a card game machine has been described, the present invention is not limited to the above embodiments. The card transportation mechanism of the present invention may be used in a place of entertainment, such as a casino.

Also, the card transportation mechanism can be driven and controlled in compliance with an instruction issued from the control circuit 22, or can transport and reverse cards through a switching operation performed by an operator.

What is claimed is:

1. A card reversing device which reverses a card by magnetic force, the card having a magnetic material buried therein.

2. The card reversing device as claimed in claim 1, comprising:

a detection unit that detects a change of a magnetic field depending on whether or not the magnetic material buried in the card exists; and a checking unit that checks a condition of the card by conducting a comparative examination on the change of the magnetic field detected by the detection unit.

3. A card reversing device which changes directions of a magnetic force line that passes through a card so as to reverse the card having a magnetic material buried therein.

4. A card reversing device which temporarily magnetizes a magnetic material buried in a card, and then reverses the card by repulsive force generated by applying magnetic force of the same polarity as the magnetized magnetic material to the card.

5. A card game machine comprising:

a card that having a magnetic material buried therein;

a table on which the card is placed; and a card reversing mechanism that is located below the table, and reverses the card placed on the table by magnetic force.

6. The card game machine as claimed in claim 5, wherein the card reversing mechanism changes directions of a magnetic force line passing through the card having the magnetic material buried therein.

7. The card game machine as claimed in claim 5, wherein the card reversing mechanism temporarily magnetizes the magnetic material buried in the card, and reverses the card by repulsive force generated by giving magnetic force of the same polarity as the magnetized magnetic material to the card.

8. The card game machine as claimed in claim 5, wherein the card reversing mechanism comprises a card transportation mechanism that attracts and moves the card having the magnetic material buried therein by magnetic force.

9. The card game machine as claimed in claim 5, wherein the card reversing mechanism comprises:

a plurality of electromagnets that face a lower surface of the table; and a magnetic force control unit that switches polarities of magnetic force of the plurality of electromagnets, and reverses the card placed on the table by gradually varying the magnetic force.

10. The card game machine as claimed in claim 5, wherein the card reversing mechanism comprises:

a permanent magnet that faces a lower surface of the table and is rotatably supported; and a magnetic force control unit that rotates the permanent magnet so as to switch polarities of magnetic force or gradually varying the magnetic force, thereby reversing the card placed on the table.

11. The card game machine as claimed in claim 5, wherein:

the magnetic material buried in the card is a plurality of magnetic members that are located in a direction perpendicular to an extending direction of one end of the card;

end portions on one side of the plurality of magnetic members located at one end of the card are located so as to face a first magnetic force generating unit; and end portions on the other side of the plurality of magnetic members are located so as to face a second magnetic force generating unit.

12. The card game machine as claimed in claim 11, wherein the card reversing mechanism temporarily magnetizes the magnetic material buried in the card by magnetic force generated from the first magnetic force generating unit and the second magnetic force generating unit, and changes a magnetic force line direction toward a magnetic force line generated from the second magnetic force generating unit so as to give the same polarity to the other end of the magnetic material to generate repulsive force, thereby reversing the card.

13. The card game machine as claimed in claim 5, wherein:

the magnetic material buried in the card is a plurality of magnetic members that are located in a direction perpendicular to an extending direction of one end of the card;

end portions on one side of the plurality of magnetic members are located so as to face a first magnetic force generating unit;

end portions on the other side of the plurality of magnetic members are located so as to face a second magnetic force generating unit; and when the card is rotated through 180 degrees around the end portions of the one side of the plurality of magnetic members, the end portions of the other side of the plurality of magnetic members face a third magnetic force generating unit.

14. The card game machine as claimed in claim 13, wherein the card reversing mechanism temporarily magnetizes the magnetic material buried in the card by magnetic force generating from the first magnetic force generating unit and the second magnetic force generating unit, then changes a magnetic force line direction toward a magnetic force line generating from the second magnetic force generating unit so as to give the same polarity to the other end portion of the magnetic material, thereby generating repulsive force to reverse the card, and gradually reduces magnetic force generated from the third magnetic force generating unit so as to gradually reduce the repulsive force on the other end portion of the magnetic material immediately before the reversal of the card.

15. The card game machine as claimed in claim 5, wherein the magnetic material buried in the card is a plurality of magnetic members that are arranged in parallel with each other at predetermined intervals.

16. The card game machine as claimed in claim 5, wherein the card having the magnetic material buried therein has a plurality of protrusions or concavities on a surface thereof.

17. A card reversing mechanism comprising:

a card that has a line-like magnetic material buried at an end portion thereof;

a table on which the card is placed; and a mechanism that discharges air to a card placement surface of the from under the table, wherein a virtual rotational axis is formed to reverse the card by attracting the line-like magnetic material buried in the card to a magnet located below the table, and the air-discharging mechanism discharges air to a bottom surface of the card so as to reverse the card.

18. A method of reversing a card, comprising the steps of:

placing one end of a magnetic material buried in the card so as to face a first magnetic force generating unit;

placing the other end of the magnetic material so as to face a second magnetic force generating unit;

temporarily magnetizing the magnetic material buried in the card by magnetic force generated from the first magnetic generating unit and the second magnetic force generating unit; and changing a magnetic force line direction to a magnetic force line generated from the second magnetic force generating unit so as to give the same polarity to the other end of the magnetic material, thereby generating repulsive force to reverse the card.

19. A method of reversing a card, comprising the steps of:

placing one end of a magnetic material buried in the card so as to face a first magnetic force generating unit;

placing the other end of the magnetic material so as to face a second magnetic force generating unit;

temporarily magnetizing the magnetic material buried in the card by magnetic force generated from the first magnetic force generating unit and the second magnetic force generating unit;

reversing the card by repulsive force generated by giving the same polarity to the other end of the magnetic material through changing a magnetic force line direction to a magnetic force line generated from the second magnetic force generating unit; and gradually reducing magnetic force generated form a third magnetic force generating unit by gradually reducing the repulsive force applied to the other end of the magnetic material immediately before reversal of the card.

20. A card game machine comprising:

a card having a magnetic material buried therein;

a table on which the card is placed;

a mechanism that is located below the table, and attracts the card placed on the table by magnetic force; and a moving mechanism that moves the mechanism for attracting the card by the magnetic force so as to move the card placed on the table.

21. A card game machine as claimed in claim 9, wherein the magnetic force generating unit comprises a detection unit that detects a change in a magnetic field, depending on whether or not the magnetic material buried in the card exists.

22. A card game machine as claimed in claim 21, further comprising:

a detection unit that detects a change in a magnetic field, depending on whether or not the magnetic material buried in the card exists; and a checking unit that checks a condition of the card by conducting a comparative examination on the change in the magnetic field detected by the detection unit.

23. The card game machine as claimed in claim 22, further comprising a magnetic force control unit that controls an intensity of magnetic force generated from the magnetic force generating unit in accordance with the change in the magnetic field detected by the detection unit, so that the card cannot move out of an attracting range.

24. The card game machine as claimed in claim 22, further comprising a moving speed control unit that controls a moving speed of the magnetic force generating unit that is moved by the moving mechanism in accordance with a change in a magnetic field detected by the detection unit, so that the card cannot move out from an attracting range.

25. The card game machine as claimed in claim 9, further comprising a moving speed control unit that controls a moving position of the magnetic force generating unit that is moved by the moving mechanism so that the magnetic force generating unit can be moved again through the moving passage of the card to transport the card, when the checking unit determines that the card being transported on the table has moved out from an attracting range of the magnetic force generating unit.

26. A card game machine which comprises a card collecting mechanism that collects cards from a table, the card collecting mechanism comprising:

a first card orientation adjusting mechanism that adjusts the collected cards in a longitudinal direction and a transverse direction;

a second card orientation adjusting mechanism that adjusts the collected cards so that the face sides of the collected cards face in the same direction; and a third card orientation adjusting mechanism that adjusts the orientations of the collected cards in a predetermined direction.

27. The card game device as claimed in claim 26, wherein the second card orientation adjusting mechanism comprises:

a first sensor that detects the face sides and reverse dies of the cards collected by the card collecting mechanism; and a card reversing mechanism that reverses or does not reverse the cards in accordance with detection results of the first sensor, so as to adjusts the face sides of the cards in the same direction.

28. The card game machine as claimed in claim 26, wherein the third card orientation adjusting mechanism comprises:

a second sensor that detects orientations of the cards collected by the card collecting mechanism; and a card rotating mechanism that rotates or does not rotate the cards through 180 degrees depending on detection results of the second sensor, so that the orientations of the cards become uniform.

29. A method of collecting cards from a table, comprising:

a first card orientation adjusting step of aligning the collected cards in a longitudinal direction and a transverse direction;

a second card orientation adjusting step of adjusting the collected cards so that the face sides of the collected cards face in the same direction; and a third card orientation adjusting step of adjusting the orientations of the collected cards in one predetermined direction, wherein the cards are properly stacked after going through the first to third card orientation adjusting steps.

30. A card game machine comprising:

a card discharging mechanism that discharges one card out of a plurality of cards each having a magnetic material buried therein;

a table on which the cards supplied from the card discharging mechanism are placed;

a magnetic force generating unit that is placed below the table, and attracts the cards supplied from the card discharging mechanism onto the table;

a card transportation mechanism that transports the cards placed on the table by moving the magnetic force generating unit;

a magnetic force control unit that changes magnetic force of the magnetic force generating unit so as to reverse each of the cards transported by the moving of the magnetic force generating unit to a location in front of a player; and a card collecting mechanism that collects the cards reversed on the table, adjusts the orientations of the cards, and then supplies the cards to the card discharging mechanism.

* * * * *